US009592669B2

(12) United States Patent
Tanjo

(10) Patent No.: US 9,592,669 B2
(45) Date of Patent: Mar. 14, 2017

(54) RECORDING APPARATUS

(71) Applicant: SEIKO EPSON CORPORATION, Tokyo (JP)

(72) Inventor: Toru Tanjo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/840,922

(22) Filed: Aug. 31, 2015

(65) Prior Publication Data

US 2016/0067972 A1 Mar. 10, 2016

(30) Foreign Application Priority Data

Sep. 8, 2014 (JP) ..... 2014-182424
Feb. 25, 2015 (JP) ..... 2015-034991
Jul. 2, 2015 (JP) ..... 2015-133340

(51) Int. Cl.
*B41J 2/16* (2006.01)
*B41J 2/165* (2006.01)
*B41J 11/08* (2006.01)
*B41J 11/14* (2006.01)

(52) U.S. Cl.
CPC ..... *B41J 2/16508* (2013.01); *B41J 2/16511* (2013.01); *B41J 2/16585* (2013.01); *B41J 11/08* (2013.01); *B41J 11/14* (2013.01)

(58) Field of Classification Search
CPC B41J 2/16508; B41J 2/16505; B41J 2/16585; B41J 2/16511; B41J 11/14; B41J 11/08
See application file for complete search history.

(56) References Cited

U.S. PATENT DOCUMENTS 9,227,412 B1 * 1/2016 Liu ..... B41J 2/16544
2005/0041059 A1 2/2005 Nakashima et al.
2006/0227162 A1 * 10/2006 Phillips ..... B41J 2/16585 347/33
2008/0231653 A1 9/2008 Kawashima et al.
2010/0245418 A1 9/2010 Shimizu et al.
(Continued)

FOREIGN PATENT DOCUMENTS

JP 2003-094676 A 4/2003
JP 2004-074611 A 3/2004
(Continued)

*Primary Examiner* — Matthew Luu
*Assistant Examiner* — Patrick King
(74) *Attorney, Agent, or Firm* — Workman Nydegger

(57) ABSTRACT

There is provided a recording apparatus including a recording head which performs recording on a recording medium, a support section which is displaced between a support position which faces the recording head and supports the recording medium, and a position which is retreated from the support position, a capping unit which carries out maintenance on the recording head at a facing position which faces the recording head by switching the support section, and a movement mechanism which moves the capping unit between the facing position and the position which is retreated from the facing position, and when the capping unit comes close to the facing position, or separates from the facing position, the movement mechanism moves the capping unit in a direction which is orthogonal to a head surface of the recording head.

9 Claims, 54 Drawing Sheets

(56) References Cited

U.S. PATENT DOCUMENTS

| | | | | |
|---|---|---|---|---|
| 2011/0097131 | A1* | 4/2011 | Ishida | B41J 11/14 400/611 |
| 2011/0199407 | A1* | 8/2011 | Kaiho | B41J 2/16585 347/9 |
| 2013/0083103 | A1 | 4/2013 | Kakigahara | |
| 2013/0293633 | A1* | 11/2013 | Li | B41J 2/16505 347/32 |
| 2015/0116422 | A1* | 4/2015 | Tanda | B41J 2/16511 347/29 |

FOREIGN PATENT DOCUMENTS

| | | | |
|---|---|---|---|
| JP | 2006-321239 | A | 11/2006 |
| JP | 2008-229970 | A | 10/2008 |
| JP | 2010-167618 | A | 8/2010 |
| JP | 2010-234735 | A | 10/2010 |
| JP | 2011-016314 | A | 1/2011 |
| JP | 2013/078861 | A | 5/2013 |

* cited by examiner

RECORDING APPARATUS

BACKGROUND

1. Technical Field

The present invention relates to a recording apparatus.

2. Related Art

In the related art, recording apparatuses are used which record on a recording medium. Among these, a recording apparatus is used which is provided with a maintenance unit which carries out maintenance on a recording head.

For example, in JP-A-2011-16314, a recording apparatus is disclosed which is provided with a line head as a recording head and a cap as a maintenance unit.

Here, in a type in which a recording head moves, that is, a so-called serial type printer in which recording is completed while alternately repeating a recording operation in which ink is discharged while the recording head moves, and a paper sheet transport operation of a predetermined amount, the maintenance unit is disposed outside a recording region, as necessary, the recording head is moved to the position of the maintenance unit, and maintenance is performed. However, in a type in which a recording head is not moved, that is, a so-called line head type printer which is formed by disposing an ink discharge nozzle so as to cover the entire region of the width of the paper sheet, as shown in JP-A-2011-16314 and JP-A-2013-78861, it is necessary to configure so as to switch between a platen (support section for the recording medium) and a maintenance unit.

In addition, in a recording apparatus in which a line head is provided as the recording head, there are cases where it takes time to move the line head to a maintenance position since the weight of the line head is great. In addition, even in a recording apparatus with a configuration in which a recording head other than a line head is provided, there are cases where the recording head tends to be heavy and it takes time to move the recording head to the maintenance position due to resolution enhancement in recent years. For this reason, in a recording apparatus of the related art which is provided with a maintenance unit which carries out maintenance on a recording head, it is desired to reduce the time taken for maintenance of the recording head.

However, in the ink jet printers described in JP-A-2011-16314 and JP-A-2013-78861, retreat positions of a maintenance unit being set on the lower side of a recording head particularly becomes a barrier with respect to suppressing the apparatus height dimension. In addition, the recording apparatus in JP-A-2011-16314 has a configuration in which a support section and a cap of a recording medium are rotationally moved and are switchable, and during maintenance has a configuration which is complete even without the line head being moved due to the support section of the recording medium being moved, but in order to be able to execute rotational movement, a large space is necessary particularly in the height direction leading to an increase in the size of the recording apparatus.

SUMMARY

An advantage of some aspects of the invention is to reduce the time taken for maintenance of a recording head while suppressing an increase in size of a recording apparatus by suppressing an increase in dimensions in the height direction of the apparatus in a configuration which switches between a support section which supports a recording medium and a maintenance unit in a position which faces the recording head.

The invention can be realized in the following forms or application examples.

Application Example 1

A recording apparatus including a recording head which performs recording on a recording medium, a support section which is displaced between a support position which faces the recording head and supports the recording medium and a position which is retreated from the support position, a maintenance unit which carries out maintenance on the recording head at a facing position which faces the recording head by switching the support section, and a movement mechanism which moves the maintenance unit between the facing position and the position which is retreated from the facing position in the transport direction of the recording medium, in which the movement mechanism includes a movable carriage which moves in the transport direction at a position below the maintenance unit in the vertical direction, a guide member which is provided with a guide groove that extends in the transport direction, and a link member which has a guided section that is guided by the guide groove, of which one side is rotatably linked to the movable carriage, and of which the other side is rotatably linked to the maintenance unit, and accompanying movement in the transport direction of the movable carriage, when the maintenance unit comes close to the facing position, or separates from the facing position, by the link member rotating using the guided section as a support point, the amount of movement in the one direction in the transport direction of the maintenance unit is offset by the amount of movement in the other direction in the transport direction of the guided section.

According to the application example, the amount of movement in the one direction in the transport direction of the maintenance unit is offset by the amount of movement in the other direction in the transport direction of the guided section. Thereby, when the maintenance unit comes close to the facing position which faces the recording head, or separates from the facing position, it is possible to move the maintenance unit in the direction which intersects with the head surface of the recording head.

Application Example 2

The recording apparatus described above, in which the guide groove has a first region which extends in a straight line along the transport direction, and a second region which is connected to the first region and extends along a direction which diagonally intersects with the first region.

According to the application example, it is possible to displace the position of the maintenance unit in the direction which intersects with the head surface of the recording head.

Application Example 3

The recording apparatus described above, in which the guided section is provided at a position on a side opposite to the support section away from a line which connects a linking section of the link member and the maintenance unit, and a linking section of the link member and the movable carriage, and the second region extends in a direction going away from the recording head in the intersecting direction.

According to the application example, due to the guided section being provided at a position on a side opposite to the support section away from a line which connects the linking section of the link member and the maintenance unit, and the linking section of the link member and the movable carriage, it is possible to suppress an increase in the dimension in the transport direction of the recording medium of the recording apparatus since a space region which is necessary for displacement of the support section is disposed nearer to the maintenance unit side in the transport direction of the recording medium. In addition, it is possible to suppress an increase in the dimension in the height direction of the recording apparatus if the space section which is necessary for displacement of the support section is disposed above the second region by the second region extending in a direction going away from the recording head in the direction which intersects with the head surface of the recording head.

Application Example 4

The recording apparatus described above, in which the maintenance unit is provided with a cap which seals the recording head, and the movement mechanism is moved between the facing position and the position which retreats from the facing position while maintaining the horizontal posture of the cap.

According to the application example, it is possible to suppress leaking of liquid from the cap. Here, "maintaining the horizontal posture" not only has the meaning of a completely horizontal posture, but also includes the meaning of a posture slightly tilted from the horizontal posture, that is, the meaning of including a state of being slightly tilted from the completely horizontal posture to the extent that liquid does not drip.

Application Example 5

The recording apparatus described above, further including an auxiliary link member of which one side is rotatably linked to the movable carriage, and of which the other side is rotatably linked to the maintenance unit, in which the line that connects the linking section of the link member and the maintenance unit and the linking section of the link member and the movable carriage is parallel to a line which connects the linking section of the auxiliary link member and the maintenance unit, and the linking section of the auxiliary link member and the movable carriage.

According to the application example, it is possible to easily construct a configuration in which the cap is advanced and retreated with respect to the recording head while maintaining the horizontal posture of the cap.

Application Example 6

The recording apparatus described above, in which the support section has a support surface which supports the recording medium, and is displaced between the support position and the position which is retreated from the support position while maintaining a direction of the support surface.

According to the application example, it is possible to suppress uncleanliness of the inside of the apparatus due to liquid which is adhered to the support surface dripping by the support surface being tilted. Here, "maintaining the direction of the support surface" has the meaning that a slight change in the direction of the support surface is permissible, and has the meaning including a state of slight tilting to the extent that liquid does not drip.

Application Example 7

The recording apparatus described above, in which a center of oscillation of the support section is provided on the upstream or the downstream in the transport direction, and due to the support section swinging, the support section is displaced between the support position which faces the recording head and supports the recording medium and the position which is retreated from the support position, and the maintenance unit retreats from the recording head to the downstream side in a case where the center of oscillation is on the upstream, and retreats from the recording head to the upstream side in a case where the center of oscillation is on the downstream in the transport direction, and the guide member is provided outside a swinging region which is necessary for swinging of the support section in the width direction of the recording medium which intersects with the transport direction.

According to the application example, the maintenance unit is displaced between the facing position which faces the recording head and the position which retreats from the facing position due to a movement operation which includes a displacement operation along the transport direction of the recording medium. Accordingly, it is not necessary to set the position to which the maintenance unit retreats at the lower side of the recording head, and it is possible to achieve suppression of the dimension in the height direction of the recording apparatus.

Application Example 8

The recording apparatus described above, in which the support section includes a first rotating body which is driven so as to rotate by a driving source, a second rotating body which is driven so as to be rotated, and a transport belt which is wound around the first rotating body and the second rotating body, and on which the recording medium is supported and transported, the support section is provided to be swingable with the first rotating body as the center of oscillation, and when the support section swings, the first rotating body continues to be driven to rotate.

According to the application example, it is possible to obtain a configuration for swinging the support section with the first rotating body as the center of oscillation with a simplified structure and at low cost. Additionally, it is not necessary to stop driving of the first rotating body when the support section is caused to swing, and it is possible to secure a control degree of freedom. In addition, since the first rotating body continues to be driven to rotate when the support section is caused to swing centered on the first rotating body, it is not necessary to secure the time for stopping or starting driving of the first rotating body, and it is possible to shorten the time for swinging the support section.

Application Example 9

The recording apparatus described above, further including a medium accommodating section which accommodates the recording medium, in which the guide member is disposed inside a mounting region of the recording medium in the medium accommodating section in the transport direction.

According to the application example, it is possible to suppress an increase of the dimension in the transport direction of the recording medium of the recording apparatus.

Application Example 10

A recording apparatus, including a recording head which performs recording on a recording medium, a support section which is displaced between a support position which faces the recording head and supports the recording medium and a position which is retreated from the support position, a maintenance unit which carries out maintenance on the recording head at a facing position which faces the recording head by switching the support section, and a movement mechanism which moves the maintenance unit between the facing position and the position which is retreated from the facing position in the transport direction of the recording medium, in which when the maintenance unit comes close to the facing position, or separates from the facing position, the movement mechanism moves the maintenance unit in a direction which is orthogonal to a head surface of the recording head.

According to the application example, when the maintenance unit is comes close to the facing position, or separates from the facing position, the movement mechanism moves the maintenance unit in a direction which is orthogonal to a head surface of the recording head. Thereby, since the maintenance unit does not slide on the head surface of the recording head, it is possible to suppress wear to the head surface of the recording head by the maintenance unit. In addition, sealing properties are high in the case where a cap which is provided in the maintenance unit comes close to the recording head and adheres to the head surface of the recording head. In addition, since the maintenance unit is retreated in the transport direction of the recording medium, it is not necessary to set the position to which the maintenance unit retreats on the lower side of the recording head, and it is possible to suppress the dimension in the height direction of the apparatus.

Application Example 11

A recording apparatus, including a recording head which performs recording on a recording medium, a support section which has a support surface that supports the recording medium and is displaced between a support position which faces the recording head and supports the recording medium and a position which is retreated from the support position, a maintenance unit which carries out maintenance on the recording head at a facing position which faces the recording head by switching the support section, and a movement mechanism which moves the support section and the maintenance unit, and switches between the support section and the maintenance unit while maintaining the direction of the support surface at the facing position, in which the movement mechanism moves the support section at least from the facing position to a first direction and moves the maintenance unit at least from the facing position to a second direction on the side opposite side to the first direction.

According to this configuration, the movement mechanism moves the support section and the maintenance unit, and switches between the support section and the maintenance unit while maintaining the direction of the support surface at the facing position. For this reason, since even if, for example, the recording head is heavy, it is not necessary to move the recording head, it is possible to reduce the time taken for maintenance of the recording head.

In addition, since the support section and the maintenance unit are switched while maintaining the direction of the support surface, it is also possible to suppress uncleanliness of the inside of the apparatus due to liquid which is adhered to the support surface dripping due to the support surface being tilted.

In addition, by providing a movement path on which the support section moves on the first direction side and providing a movement path on which the maintenance unit moves on the opposite side to the first direction side (the second direction side) with reference to the facing position, it is possible to easily configure the both movement paths without inference from the support section and the maintenance unit without increasing the size of the recording apparatus particularly in the height direction (the direction which intersects with the support surface).

Application Example 12

The recording apparatus described above, in which the movement mechanism moves the support section in a direction away from the recording head, and then moves the support section in the first direction when moving the support section from the facing position, and the movement mechanism moves the maintenance unit in a direction away from the recording head, and then moves the maintenance unit in the second direction when moving the maintenance unit from the facing position.

According to this configuration, the movement mechanism moves the support section in a direction away from the recording head, and then moves the support section in the first direction when moving the support section from the facing position, and the movement mechanism moves the maintenance unit in a direction away from the recording head, and then moves the maintenance unit in the second direction when moving the maintenance unit from the facing position. For this reason, it is possible to easily bring the support section and the maintenance unit close to and separate the sections from the recording head. That is, it is possible to easily adjust the distance between the recording head and the support section and the maintenance unit at the facing position.

Application Example 13

The recording apparatus described above, in which the movement mechanism is provided with a guide section which guides the movement of the support section and the maintenance unit.

According to this configuration, the movement mechanism is provided with a guide section which guides the movement of the support section and the maintenance unit. For this reason, movement of the support section and the maintenance unit is facilitated.

Application Example 14

The recording apparatus described above, further including a support section guide groove and a maintenance unit guide groove as the guide members, in which the support section guide groove and the maintenance unit guide groove are disposed so as not to overlap viewed from a direction from the recording head toward the facing position.

According to this configuration, the support section guide groove and the maintenance unit guide groove are disposed so as not to overlap viewed from a direction from the recording head toward the facing position. For this reason, it is possible to easily suppress the interference of the support section and the maintenance unit with each other when moving both.

Application Example 15

The recording apparatus described above, in which the movement mechanism has a support section base which supports the support section and moves.

According to this configuration, the movement mechanism has the support section base which supports the support section and moves. For this reason, it is possible to easily configure the configuration of the support section itself.

Application Example 16

The recording apparatus described above, in which the movement mechanism has a maintenance unit base which supports the maintenance unit and moves.

According to this configuration, the movement mechanism has the maintenance unit base which supports the maintenance unit and moves. For this reason, it is possible to easily configure the configuration of the maintenance unit itself.

Application Example 17

The recording apparatus described above, in which the movement mechanism has a feeding screw, and at least one of the support section and the maintenance unit has a bearing section which engages with the feeding screw.

According to this configuration, the movement mechanism has the feeding screw, and at least one of the support section and the maintenance unit has the bearing section which engages with the feeding screw. For this reason, it is possible to easily configure the movement mechanism.

BRIEF DESCRIPTION OF THE DRAWINGS

The invention will be described with reference to the accompanying drawings, wherein like numbers reference like elements.

DESCRIPTION OF EXEMPLARY EMBODIMENTS

A recording apparatus according to examples of the invention will be described below in detail with reference to the attached drawings.

Example 1

First, the entire configuration of a recording apparatus 1 of the example will be described.

Figure 1:
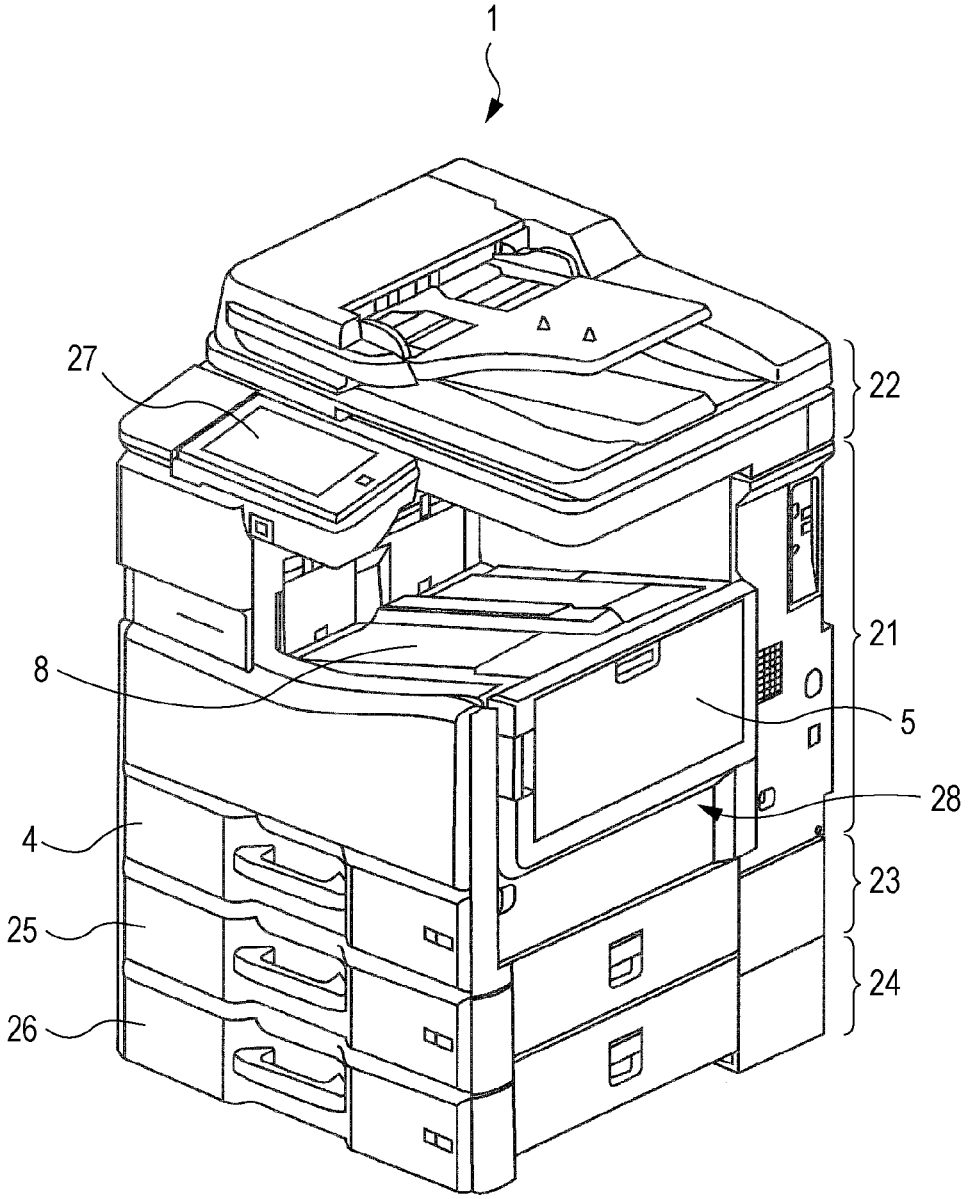
FIG. 1 is an outer appearance perspective view representing a recording apparatus.

FIG. 1 is an outer appearance perspective view of the recording apparatus 1 of the example.

The recording apparatus 1 in FIG. 1 is provided with a scanner device 22 on an upper section of an apparatus main body 21 which performs recording on a recording medium P (refer to FIG. 26), and is provided with extension units 23 and 24 on the lower side of the apparatus main body 21. The apparatus main body 21 is provided with a cassette 4, the extension unit 23 is provided with a cassette 25, and the extension unit 24 is provided with a cassette 26. The cassettes 25 and 26 which are provided in the extension units 23 and 24 are optional units for increasing the number of accommodated sheets of the recording medium P and are arbitrarily attached to the apparatus main body 21.

In addition, an operation section 27 which performs each operation of the recording apparatus 1 is provided in the recording apparatus 1 of the example. In addition, a discharge section 8 is provided that receives the recording medium P on which recording is performed and which is discharged. Here, in more detail, the discharge section 8 is a face down discharge tray which receives the recording medium P which is discharged by the recording surface on which the recording is just performed facing down. In addition, in the recording apparatus 1 of the example, a feeding unit 28 is provided which is able to open and close with respect to the apparatus main body 21 by rotating centered on a rotation fulcrum which is not shown in the drawings. In addition, a tray 5 is provided in the feeding unit 28, and it is possible for a user to manually feed the recording medium P by setting the recording medium P in the tray 5 and feeding the recording medium P.

Here, in the recording apparatus 1 of the example, the side at which the operation section 27 is disposed is the front side of the apparatus, and the side at which the tray 5 is provided is the right side surface of the apparatus. That is, feeding, transport, and discharge of the recording medium P in the recording apparatus 1 are performed along the left and right direction of the apparatus.

Next, the internal configuration of the apparatus main body 21 of the recording apparatus 1 of the example will be described.

Figure 2:
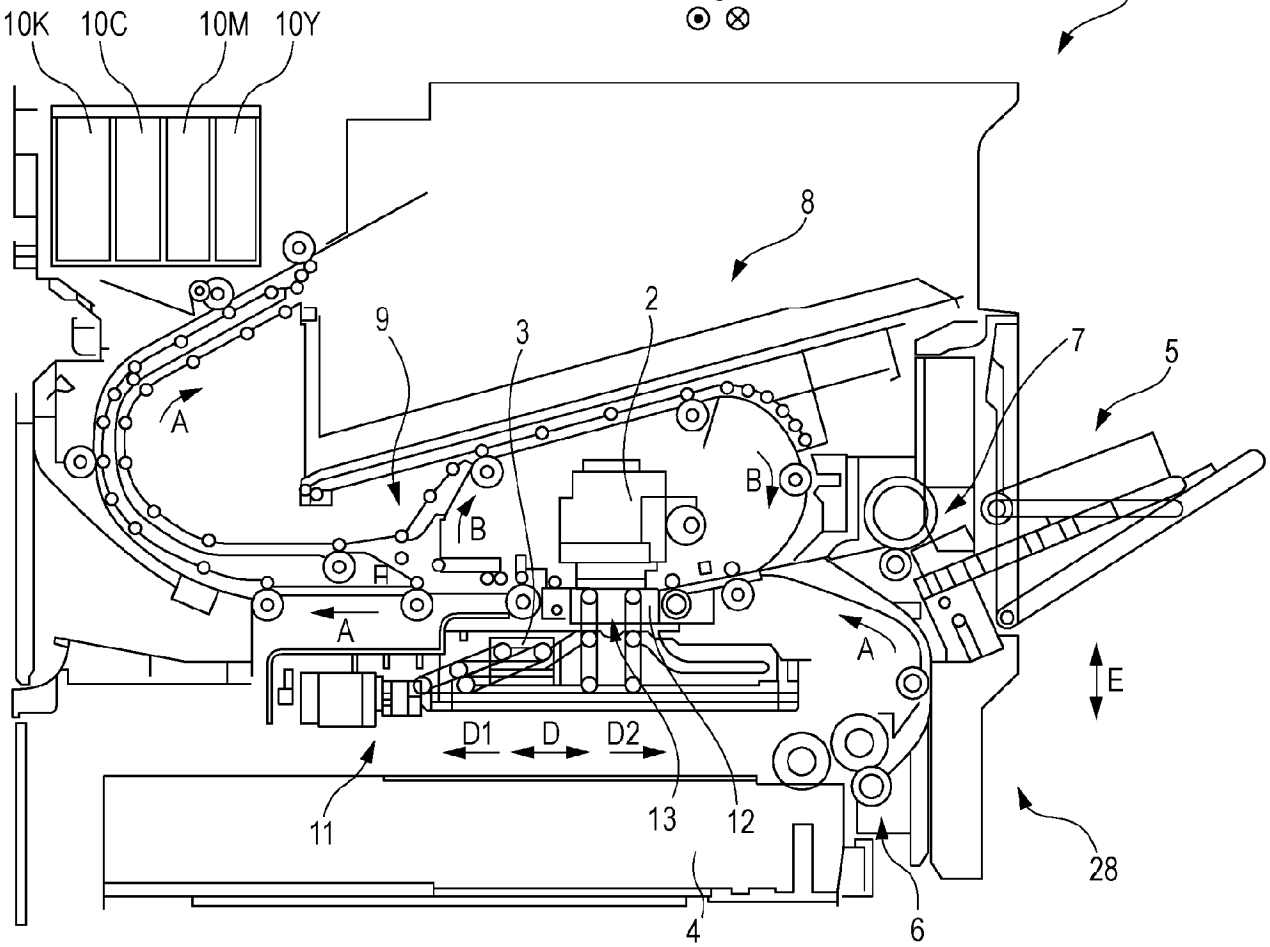
FIG. 2 is a side surface outline sectional view representing the recording apparatus.
Figure 3:
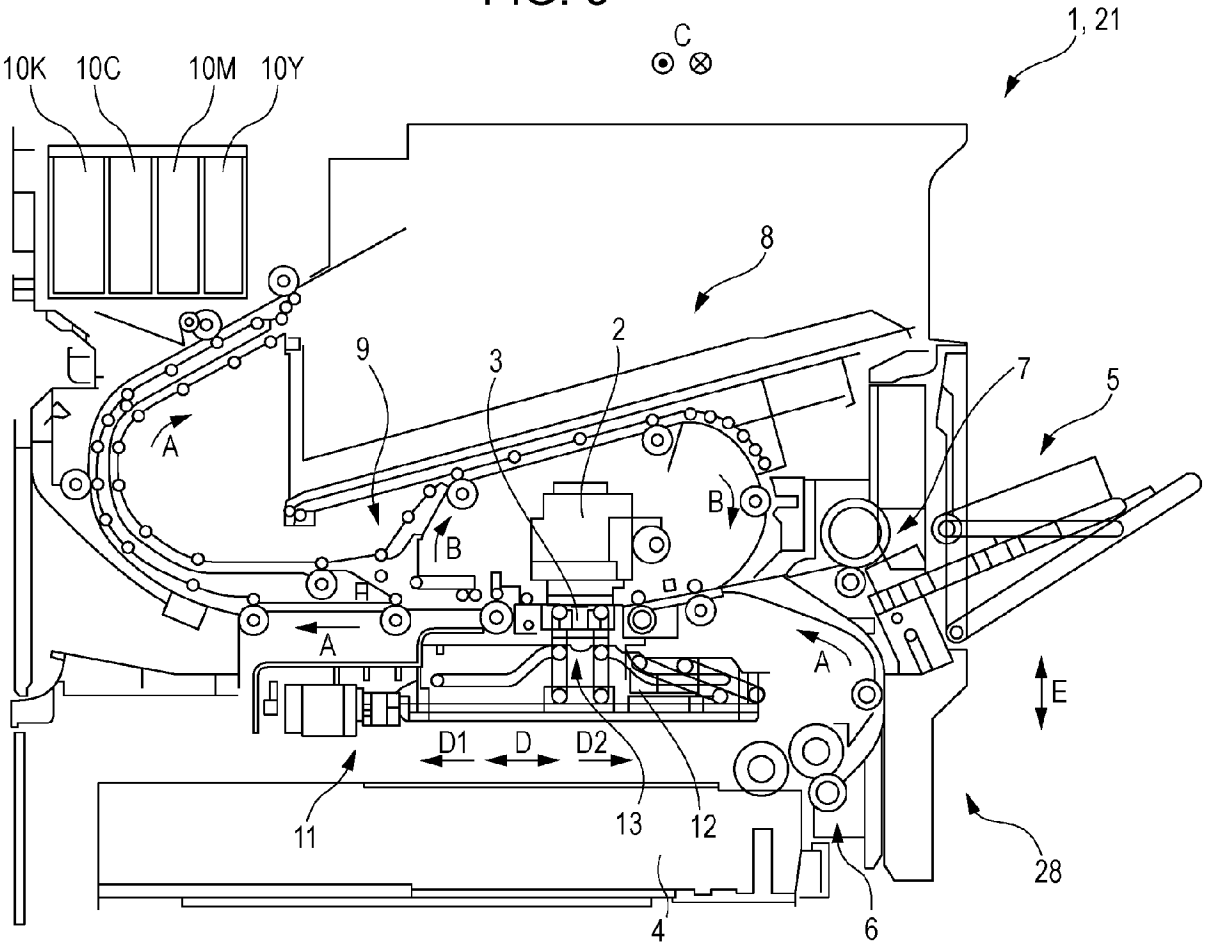
FIG. 3 is a side surface outline sectional view representing the recording apparatus.
Figure 4:
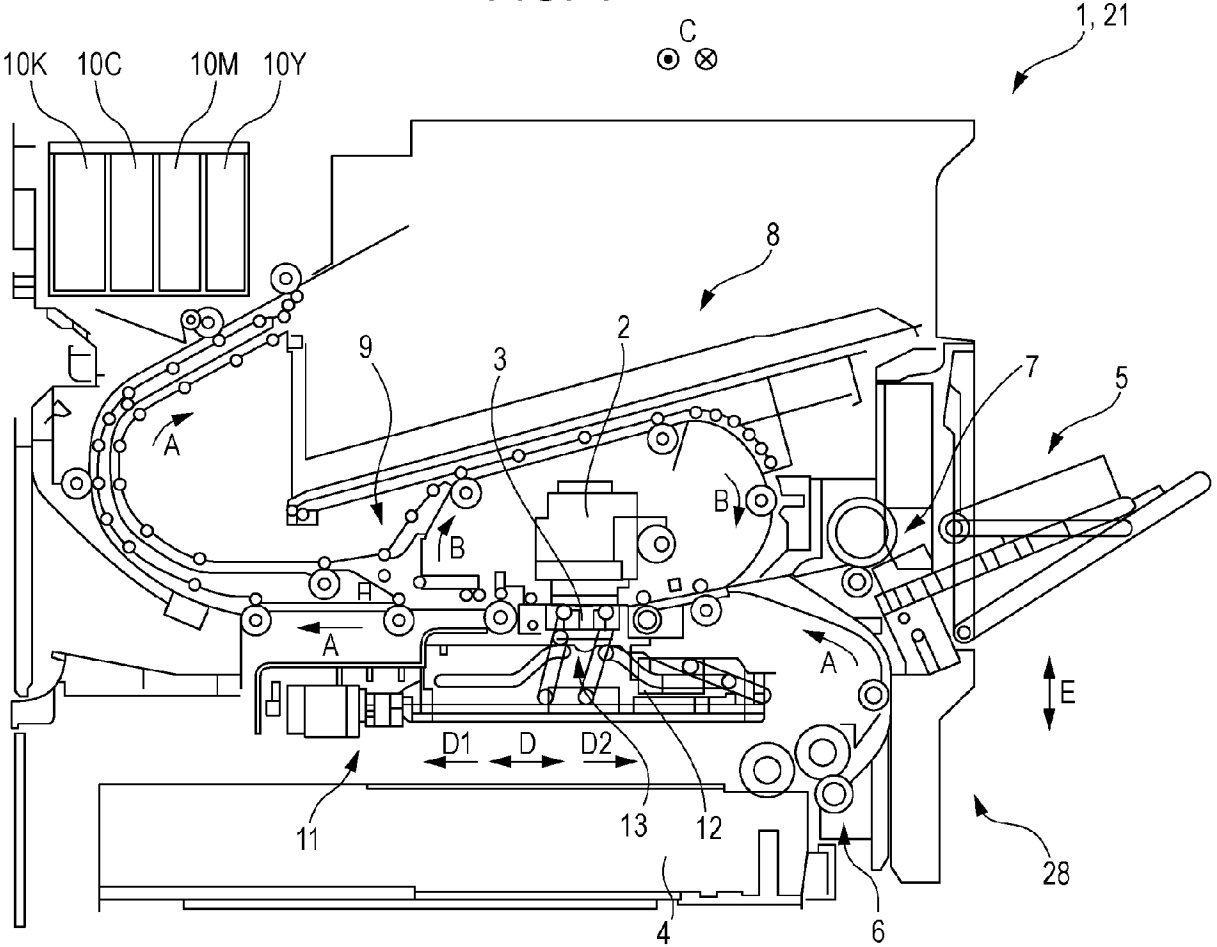
FIG. 4 is a side surface outline sectional view representing the recording apparatus.

FIG. 2 to FIG. 4 are outline side surface sectional diagrams representing the recording apparatus 1 of the example. Here, FIG. 2 represents a state in which recording is performed on the recording medium P. Here, FIG. 3 represents a state in which a recording head 2 which is a recording section is capped by a capping unit 3 which is a maintenance unit. In addition, FIG. 4 represents a state in which flushing (an ink discharge operation accompanying recording) is carried out from the recording head 2 to the capping unit 3.

As represented in FIG. 1 and FIG. 2 to FIG. 4, the recording apparatus 1 of the example is provided with the cassette 4 and the tray 5 which are able to set the recording medium P to be fed. Then, as represented in FIG. 2 to FIG. 4, using a transport section which is configured by a plurality of rollers such as rollers 6 and 7 the recording medium P is transported to the discharge section 8 by transporting the recording medium P which is set in the cassette 4 and the tray 5 in the transport direction A.

The recording head 2 is provided on the transport path of the recording medium P from the cassette 4 and the tray 5 to the discharge section 8, and in the recording apparatus 1 of the example, it is possible to carry out recording (image formation) on the recording medium P by discharging ink from the recording head 2.

In addition, an inverting mechanism 9 is provided in the recording apparatus 1 of the example, after recording on one surface of the recording medium P by the recording head 2 it is possible to record on both surfaces of the recording medium P by inverting the recording medium P by transporting the recording medium P once in a transport direction B using the inverting mechanism 9, and transporting the recording medium P to the discharge section 8 by recording using the recording head 2 on the other surface of the recording medium P.

Here, the recording apparatus 1 of the example is configured so as to be able to discharge, from the recording head 2, black ink, cyan ink, magenta ink, and yellow ink which is accommodated in ink cartridges 10K, 10C, 10M, and 10Y using a supply mechanism which is not shown in the drawings. However, a configuration which uses another ink, a configuration in which ink from a bottle which accommodates ink in place of an ink cartridge is supplied to the recording head, or the like may be set.

Although described later in detail, in the recording head 2 of the example, a nozzle region which is formed in an intersecting direction C which intersects with the transport direction A of the recording medium P has a line head which is provided so as to be able to cover the entirety of the intersecting direction C of the recording medium P. However, the nozzle region in the intersecting direction C of the line head may be configured so as not to be able to cover the entirety of the intersecting direction C of the entire recording medium P which corresponds to the recording apparatus 1. In addition, there may be a configuration in which, in place of the line head, a recording head is provided which records on the recording medium P while moving reciprocally in the intersecting direction C which intersects with the transport direction A of the recording medium P.

In addition, on a side which faces the recording head 2, the recording apparatus 1 of the example is provided with a support section 12 which supports the recording medium P on a support surface 38 (refer to FIG. 20) at a facing position 13 which faces the recording head 2 during recording, and the capping unit 3 which carries out maintenance on the recording head 2 during maintenance. Then, a movement mechanism 11 is provided which switches between the support section 12 and the capping unit 3 while maintaining the direction of the support surface 38 in the facing position 13 by moving the support section 12 and the capping unit 3.

Here, "maintenance" has the meaning including all operations for improving and maintaining the recording state of the recording head 2. In the recording apparatus 1 of the example, the capping unit 3 is used as the maintenance unit in capping and flushing operations, but there may be a configuration in which another cleaning operation such as wiping, suctioning, and the like is performed by the maintenance unit which is switchable with the support section 12.

By configuring in this manner, the recording apparatus 1 of the example need not move the recording head 2 during recording, capping, or flushing. That is, the configuration is able to reduce the time which is taken for maintenance of the recording head 2.

In addition, the support section 12 and the capping unit 3 are switched while maintaining the direction of the support surface 38. In another representation, since the support surface 38 is moved in a state in which the upward orientation (horizontal state) is maintained (at least a portion of the movement path of the support section 12 is a movement path along which the support section 12 moves in the horizontal direction), it is possible to suppress uncleanliness of the inside of the apparatus due to ink which is adhered to the support surface 38 dripping due to the support surface 38 being tilted. Here, "maintaining the direction of the support surface 38" has the meaning that slight change in the direction of the support surface 38 is permissible, and has the meaning including a state of slight tilting to the extent that ink does not drip.

Next, the movement mechanism 11 which is a main section of the recording apparatus 1 of the example will be described in detail.

Figure 5:
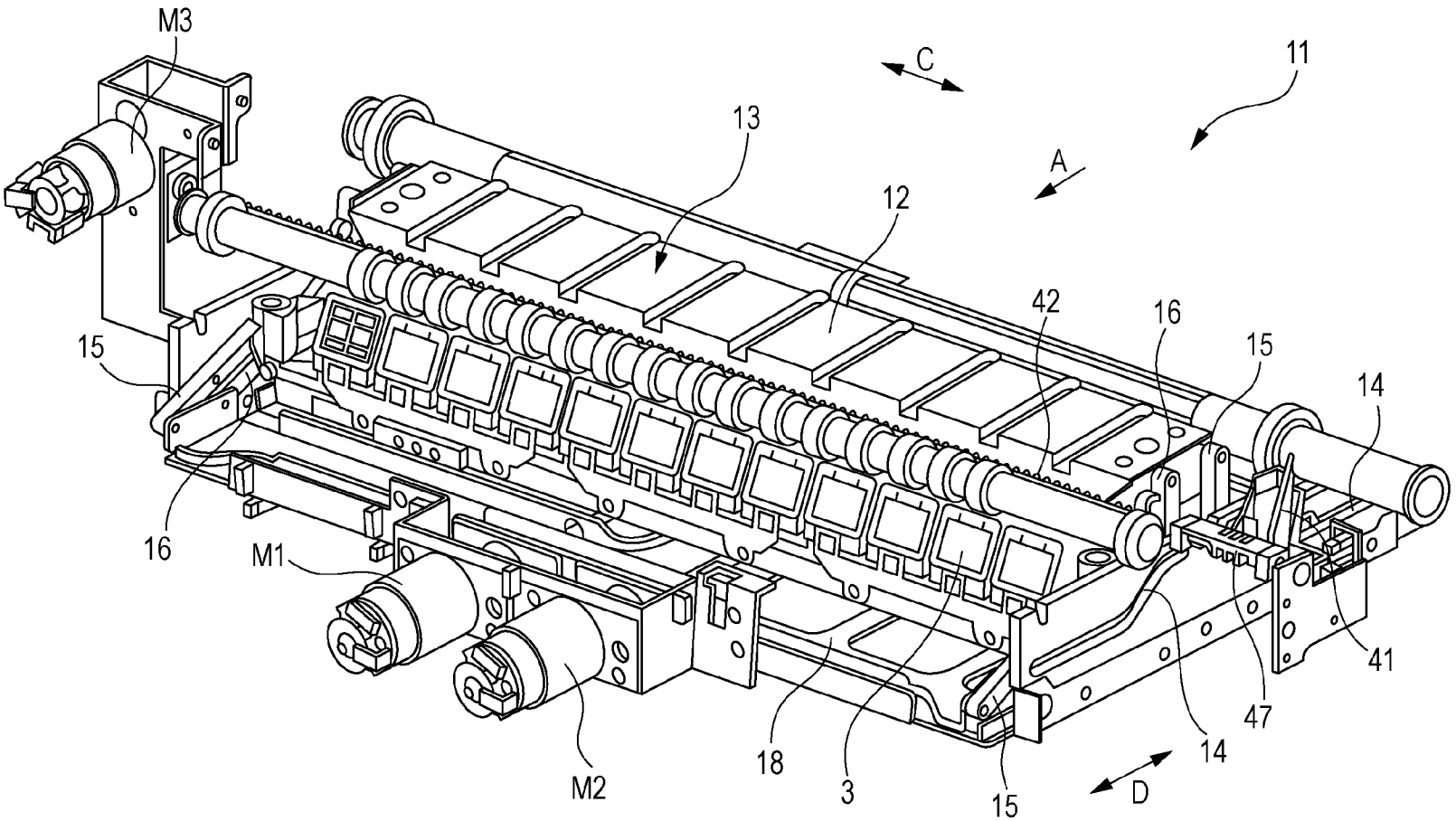
FIG. 5 is a schematic perspective view representing the main section (a movement mechanism) of the recording apparatus.
Figure 6:
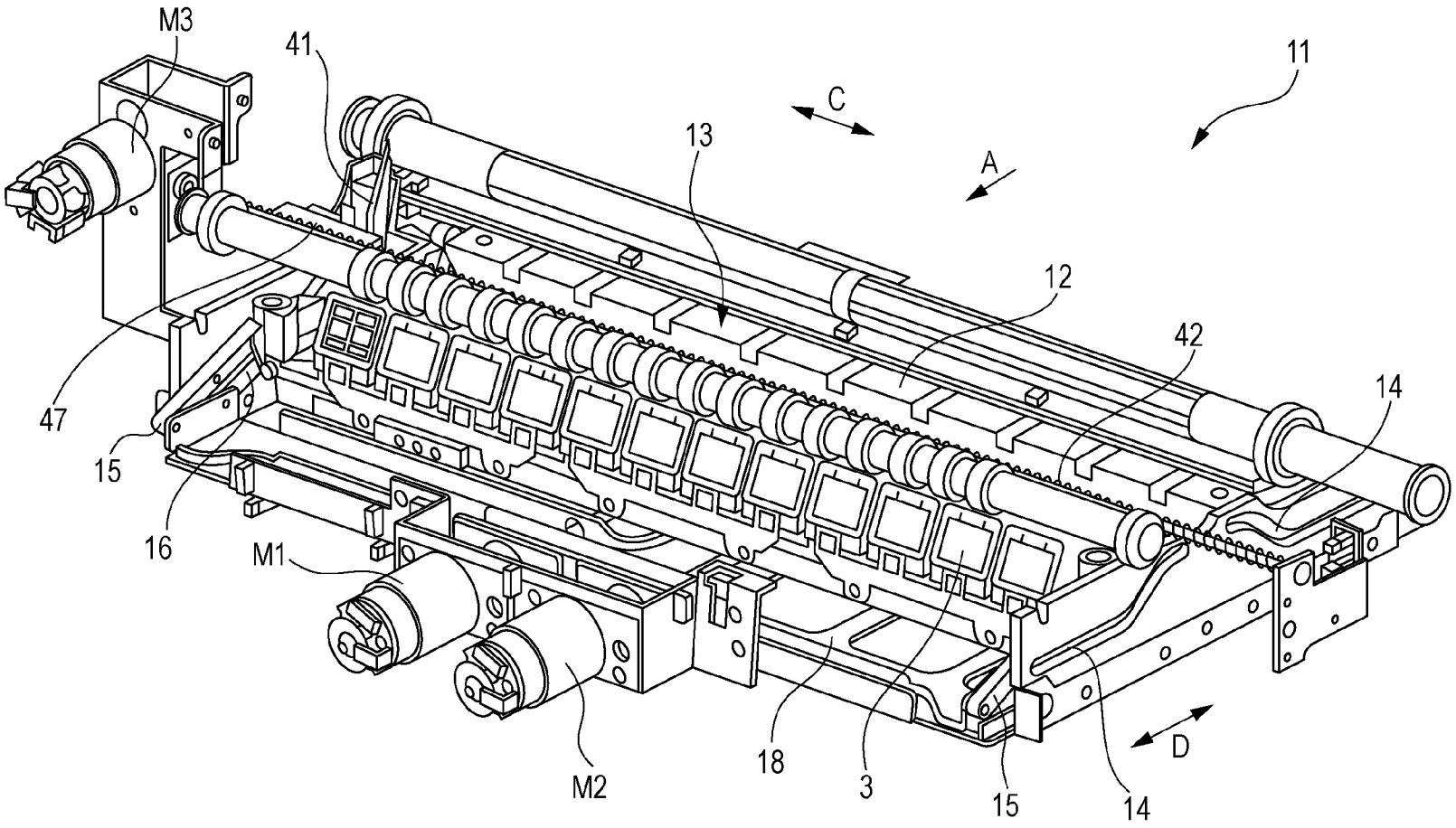
FIG. 6 is a schematic perspective view representing the main section (the movement mechanism) of the recording apparatus.
Figure 7:
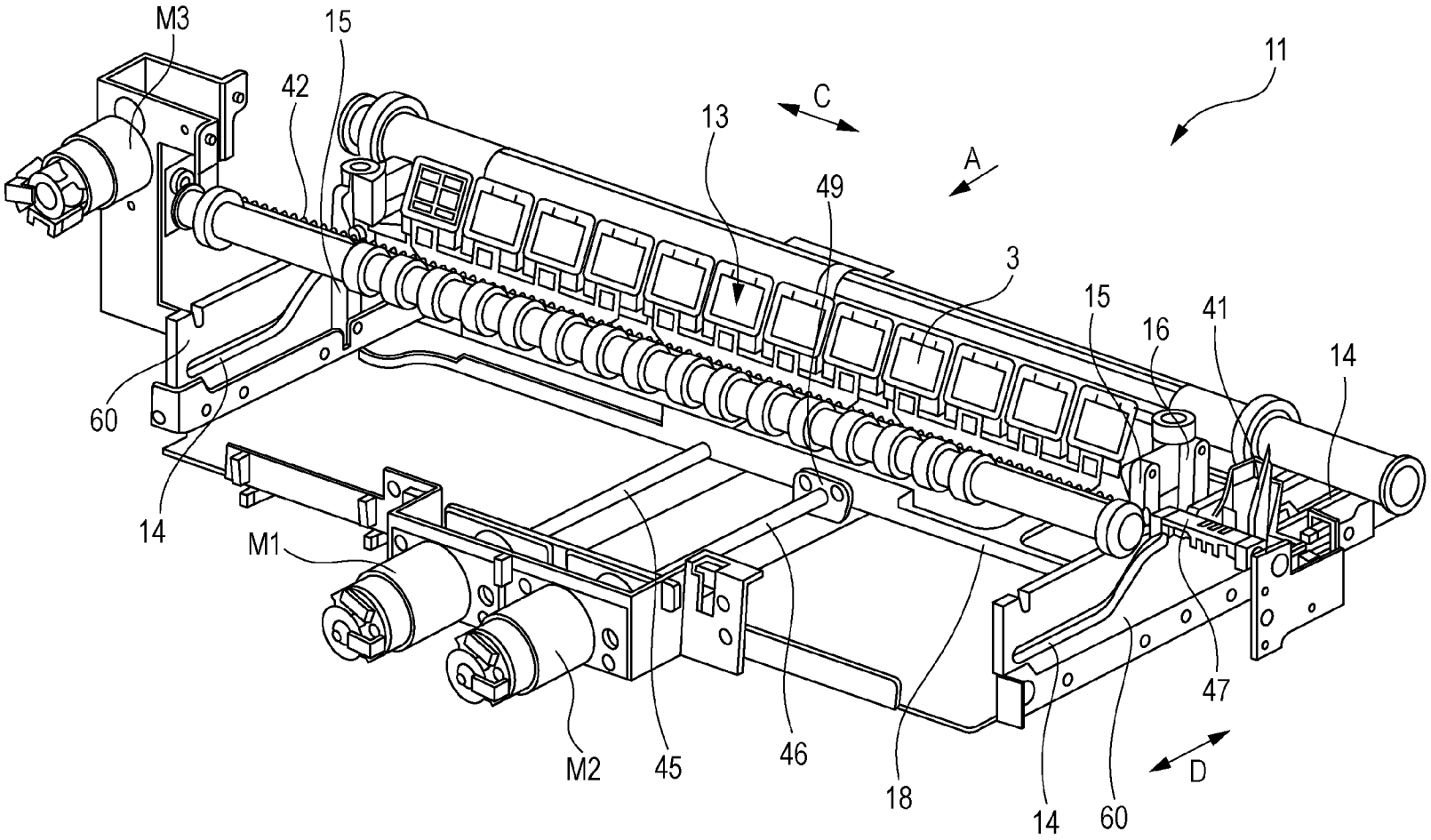
FIG. 7 is a schematic perspective view representing the main section (the movement mechanism) of the recording apparatus.

FIGS. 5 to 7 are schematic perspective views representing the movement mechanism 11 which is the main section of the recording apparatus 1 of the example. Here, FIG. 5 represents a state in which recording is performed on the recording medium P. In addition, FIG. 6 represents a state of transitioning from a state of performing recording on the recording medium P to a state of capping the recording head 2 using the capping unit 3. In addition, FIG. 7 represents a state of capping the recording head 2 using the capping unit 3.

Figure 8:
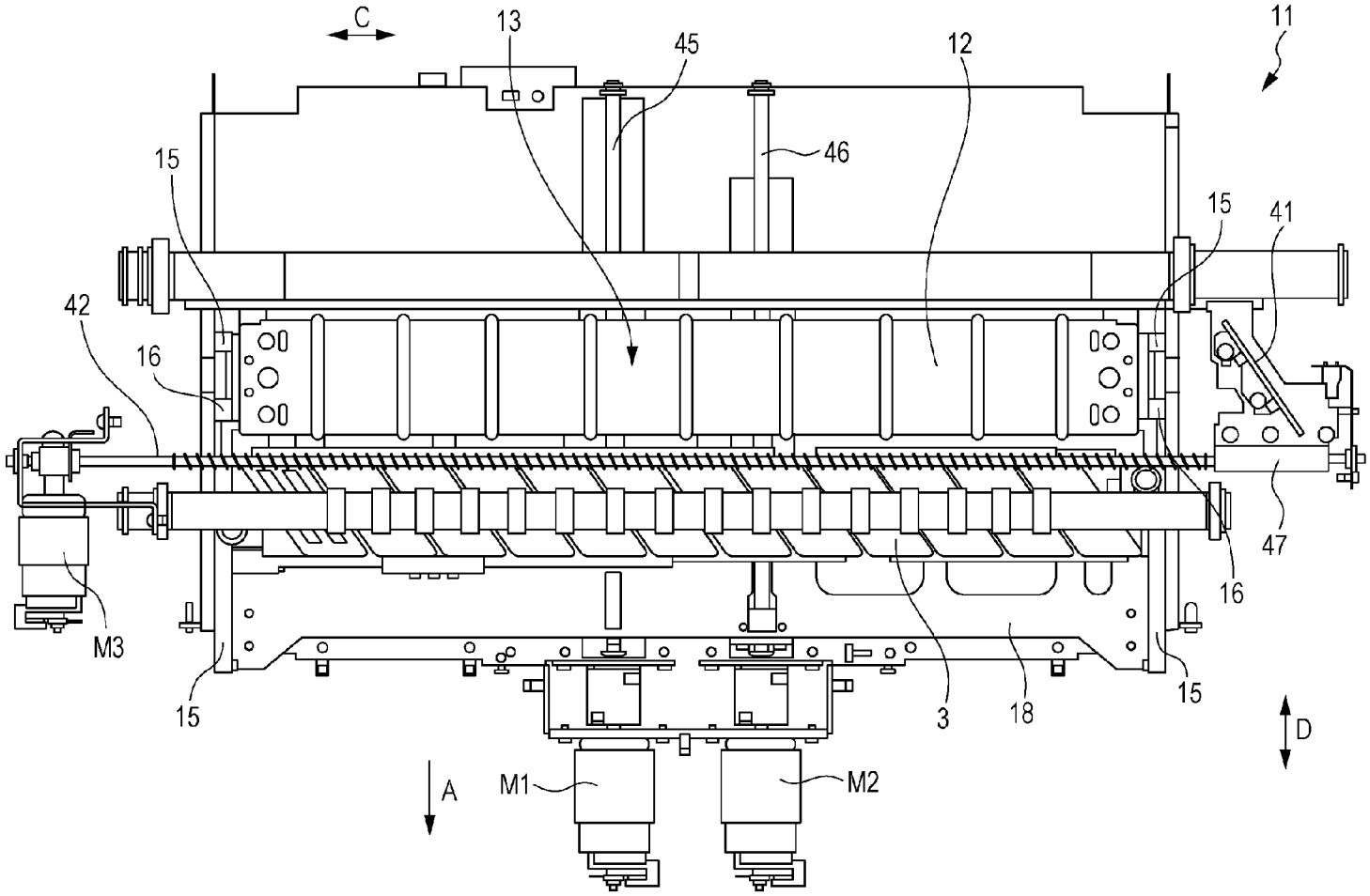
FIG. 8 is a schematic planar view representing the main section (the movement mechanism) of the recording apparatus.
Figure 9:
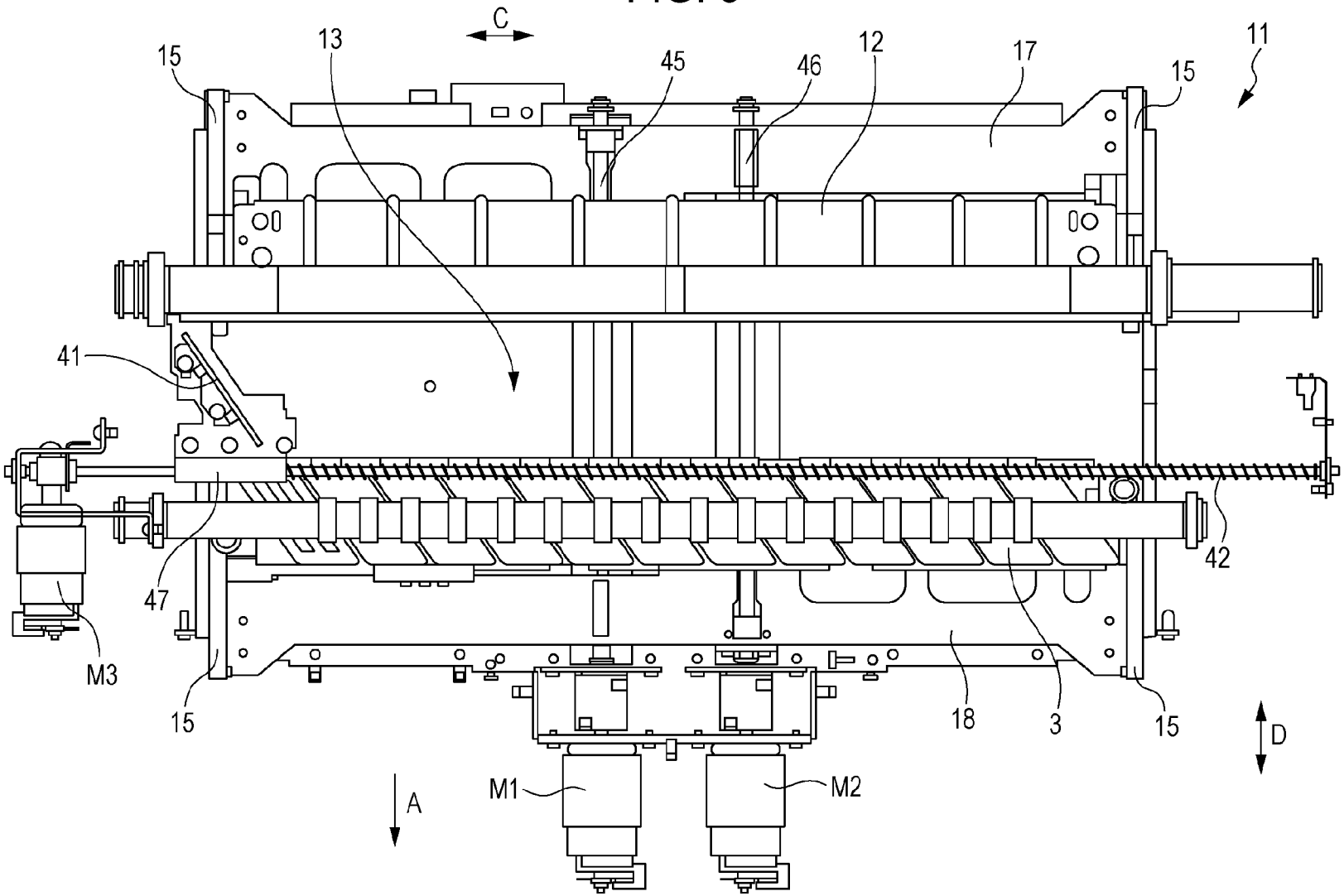
FIG. 9 is a schematic planar view representing the main section (the movement mechanism) of the recording apparatus.
Figure 10:
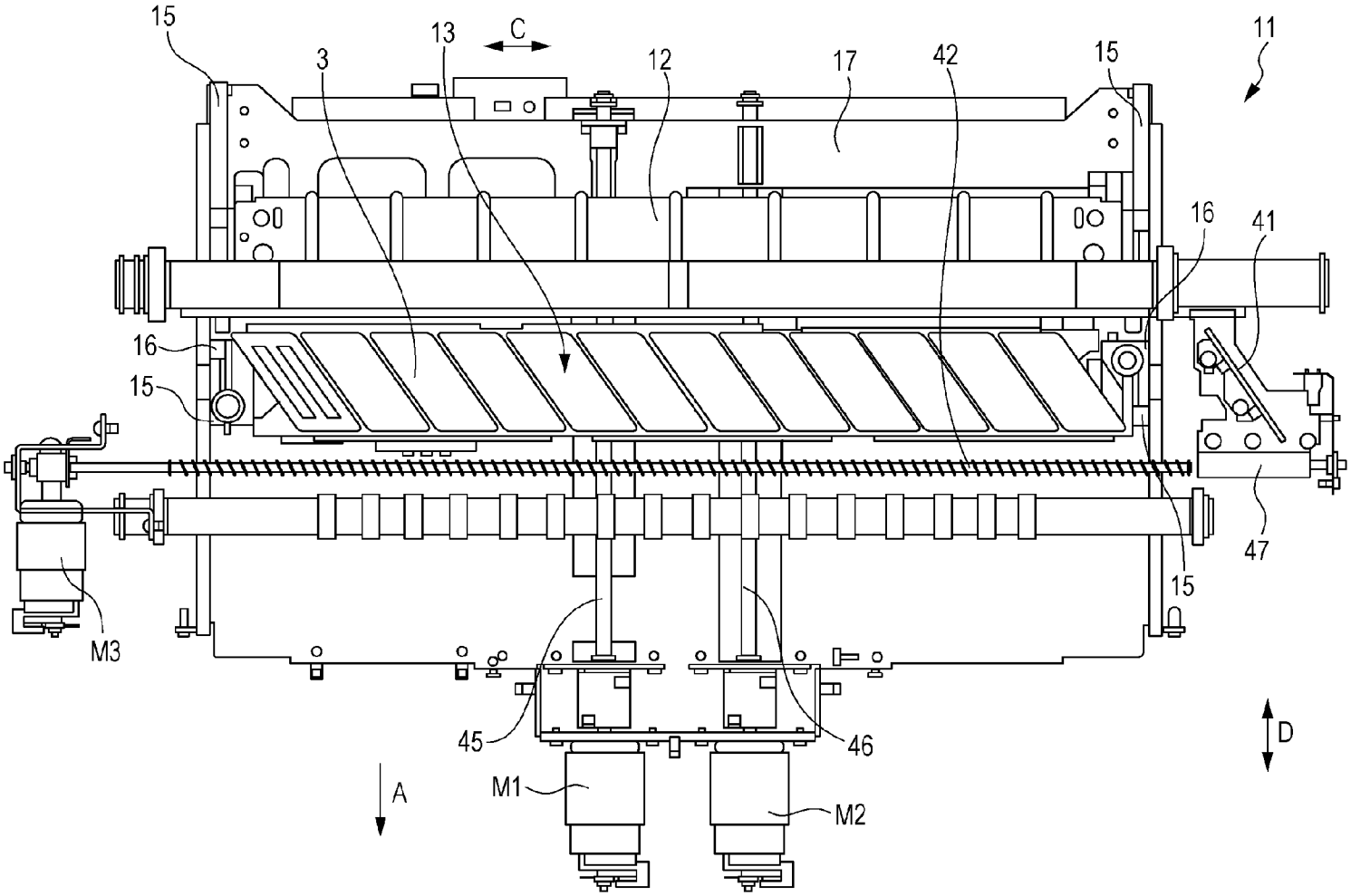
FIG. 10 is a schematic planar view representing the main section (the movement mechanism) of the recording apparatus.

In addition, FIGS. 8 to 10 are schematic planar views of the movement mechanism 11 which is the main section of the recording apparatus 1 of the example. Here, FIG. 8, which corresponds to FIG. 5, represents a state in which recording is performed on the recording medium P. In addition, FIG. 9, which corresponds to FIG. 6, represents a state of transitioning from a state of performing recording on the recording medium P to a state of capping the recording head 2 using the capping unit 3. In addition, FIG. 10, which corresponds to FIG. 7, represents a state of capping the recording head 2 using the capping unit 3.

As represented in FIGS. 5 and 8, when the movement mechanism 11 of the example performs recording on the recording medium P, the support section 12 is positioned at the facing position 13 which faces the recording head 2. It is possible to reliably support the recording medium P at the facing position 13, and quality of images which are formed on the recording medium P is improved by positioning the support section 12 at the facing position 13.

Then, in a case where capping is performed on the recording head 2 the movement mechanism 11 is transitioned from a state in which recording is performed on the recording medium P which is represented in FIG. 5 and FIG. 8 to a state which is represented by FIG. 7 and FIG. 10 via the state which is represented in FIG. 6 and FIG. 9.

As represented in FIGS. 7 and 10, when the movement mechanism 11 of the example performs capping on the recording head 2, the capping unit 3 is positioned at the facing position 13. By positioning the capping unit 3 at the facing position 13, it is possible to reliably carry out capping of the recording head 2 at the facing position 13 without moving the recording head 2, and it is possible to suppress evaporation of ink in a nozzle N which is formed on a nozzle formation surface F (refer to FIG. 25) of the recording head 2.

Here, the state in which recording is performed on the recording medium P which is represented in FIG. 5 and FIG. 8 corresponds to FIG. 2, and the state in which capping is carried out on the recording head 2 by the capping unit 3 which is represented in FIG. 7 and FIG. 10 corresponds to FIG. 3.

As represented in FIGS. 2 to 10, the movement mechanism 11 of the example is able to transport the support section 12 and the capping unit 3 in a direction D which intersects with respect to the intersecting direction C which intersects with the transport direction A.

In detail, as represented in FIG. 2 and FIG. 3, the movement mechanism 11 is able to move at least the support section 12 from the facing position 13 in a direction D2 set as a first direction of a direction D, and is able to move at least the capping unit 3 from the facing position 13 in a direction D1 as a second direction that is on the opposite side to the direction D2.

That is, with reference to the facing position 13, the movement path on which the support section 12 moves is provided on the direction D2 side, and the movement path on which the capping unit 3 moves is provided on the opposite side (the direction D1 side). Then, by configuring in this manner, both movement paths are simply configured such that the support section 12 and the capping unit 3 do not interfere particularly without increasing the size of the recording apparatus 1 in a direction E which is the height direction (a direction which intersects with the support surface 38).

Here, the example is configured such that the support section 12 is movable in the direction D2 from the facing position 13, and the capping unit 3 is movable in the direction D1 from the facing position 13, but the invention is not limited to such a configuration, and, for example, the movement directions of the support section 12 and the capping unit 3 may each be reversed.

In addition in the manner described above, as represented in FIG. 4, the movement mechanism 11 of the example is able to take a state in which flushing is carried out from the recording head 2 to the capping unit 3 (a state in which the capping units 3 are provided at a predetermined gap while being made to face the recording head 2). From the state represented in FIG. 3, this state is a state in which the capping unit 3 is moved in the direction E (corresponding to the vertical direction in the example) which is a direction which intersects with the intersecting direction C and the direction D.

In this manner, the movement mechanism 11 of the example is able to move the support section 12 in a direction which is separated from the recording head 2 (a downward direction in the direction E), and then move the support section 12 in the direction D2 when the support section 12 is moved from the facing position 13. In addition, when the capping unit 3 is moved from the facing position 13, it is possible to move the capping unit 3 in the direction which is separated from the recording head 2, and then move the support section 12 in the direction D1. Accordingly, in the configuration, it is possible to simply bring the support section 12 and the capping unit 3 close to the recording head 2 and separate the support section 12 and the capping unit 3 from the recording head 2. That is, there is a configuration in which it is possible to easily adjust the distance between the recording head 2 and the support section 12 and the capping unit 3 in the facing position 13.

In addition, as represented in FIGS. 5 to 10, the movement mechanism 11 of the example has a guide groove 14 which configures a guide section that guides the movement of the support section 12 and the capping unit 3, a first guide bar 15 as a link member, and a second guide bar 16 as an auxiliary link member. Then, the movement mechanism 11 has a support base 17 which moves supporting the support section 12, and a support base 18 which moves supporting the capping unit 3.

Here, the movement mechanism 11 of the example is provided with the guide groove 14 as the guide section, and is provided with the guide bar which moves the guide groove 14. The guide groove 14 is provided in a guide member 60 of FIG. 7, which is provided so as to have both end portions face each other in the intersecting direction C. However, the invention is not limited to such a configuration, and the movement mechanism 11 may have a guide section with another configuration in which movement of at least one of the support section 12 and the capping unit 3 is guided.

Here, FIG. 6 and FIG. 9 represent a state of transitioning from a state of performing recording on the recording medium P to a state of capping the recording head 2 using the capping unit 3, but in this state, the movement mechanism 11 of the example is able to wipe the nozzle formation surface F of the recording head 2. As represented in FIG. 5 and FIG. 10, the movement mechanism 11 of the example is provided with a wiper 41 which is able to wipe the nozzle formation surface F by moving in the intersecting direction C along a movement shaft 42 which is a feeding screw using the driving force of a motor M3.

Next, the guide groove 14 which configures the guide section of the support section 12 and the capping unit 3, the first guide bar 15 and the second guide bar 16, and the support bases 17 and 18 for the support section 12 and the capping unit 3 will be described.

Figure 11:
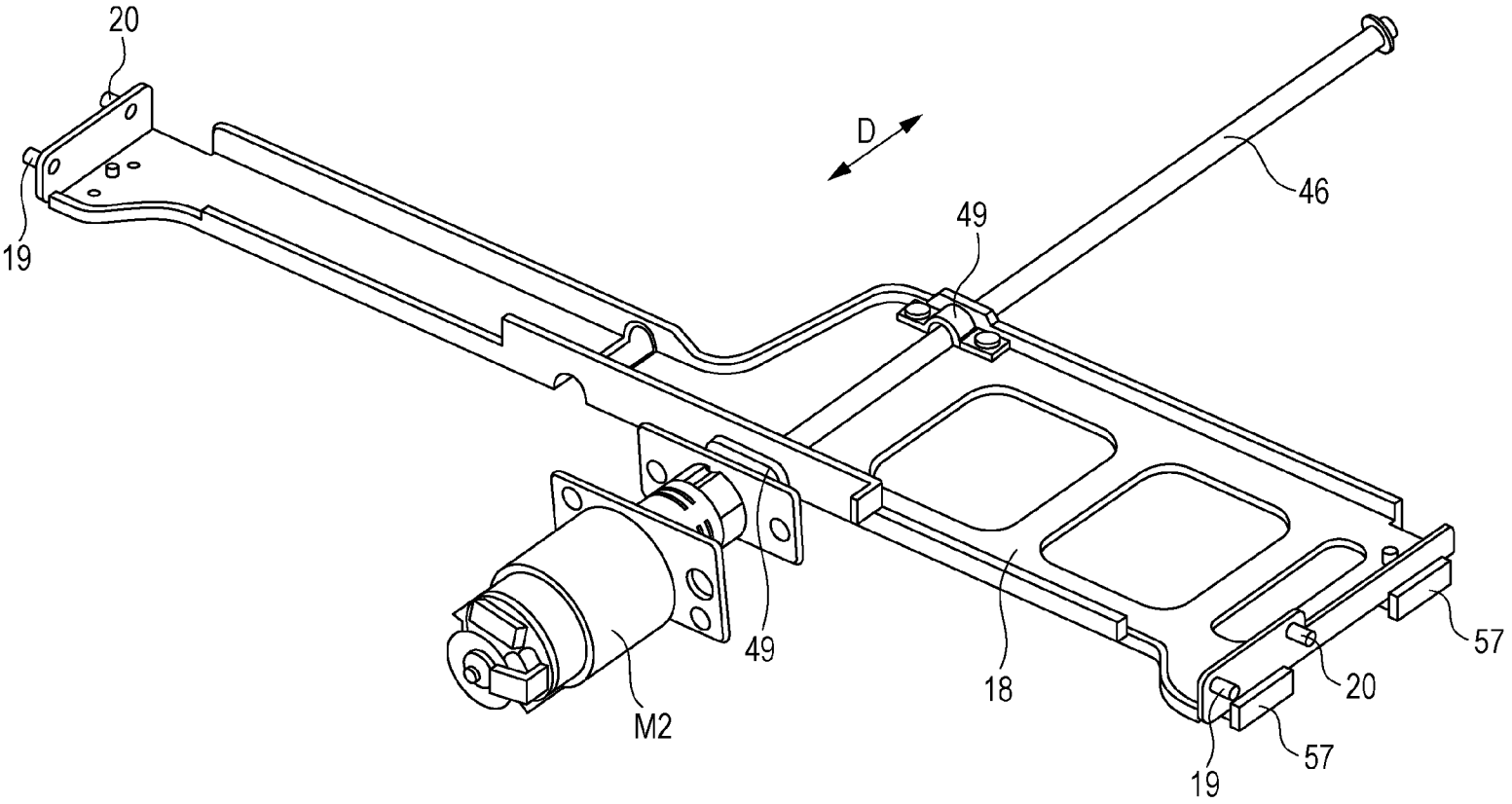
FIG. 11 is a schematic perspective view representing the main section (a portion of the movement mechanism) of the recording apparatus.
Figure 12:
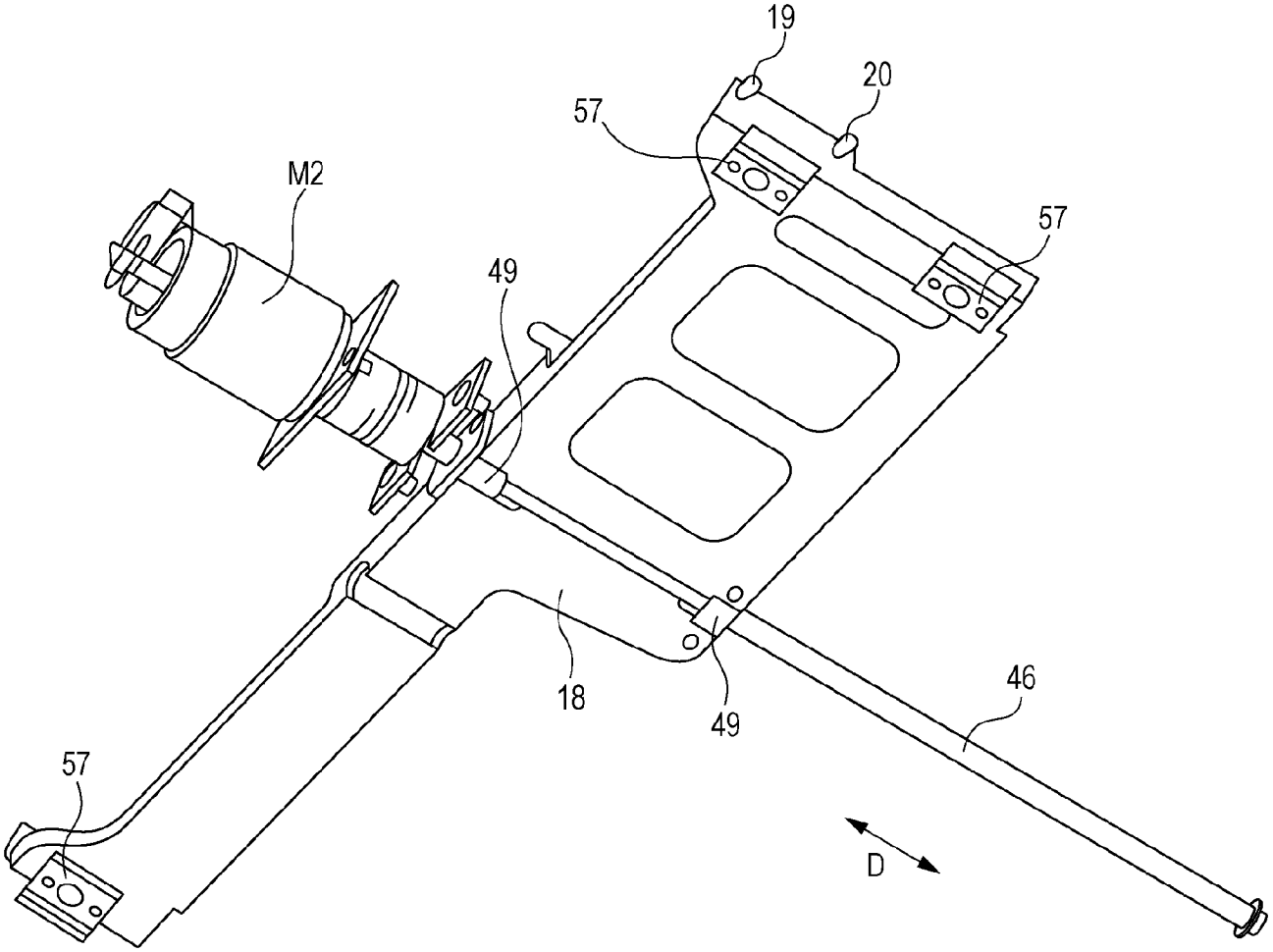
FIG. 12 is a schematic perspective view representing the main section (a portion of the movement mechanism) of the recording apparatus.

FIG. 11 and FIG. 12 are schematic perspective views representing the support base 18 which is a portion of the main section of the movement mechanism 11 of the example. Here, the configuration of the support base 17 is the same as the support base 18, and the support base 18 is configured in the movement mechanism 11 so as to be inverse in the horizontal direction. In this manner, the support bases 17 and 18 have a long portion and a short portion in the direction D, and the long portion and the short portion are disposed in a different manner from each other. By being configured in this manner, the support bases 17 and 18 support the support section 12 and the capping unit 3 in a wide area, and the length of the entirety of the movement mechanism 11 in the direction D is set so as not to be excessively long. Furthermore, by being configured in this manner, the distance between bearing sections 49 in the support bases 17 and 18 becomes longer, and movement of the support base 17 and the support base 18 in the direction D is stabilized.

Here, in order to maintain the lower portions of the support base 17 and the support base 18 parallel to an installation surface of the recording apparatus 1, contact sections 57 are provided at three places with respect to a bottom surface of the movement mechanism 11 in the support base 17 and support base 18.

Figure 13:
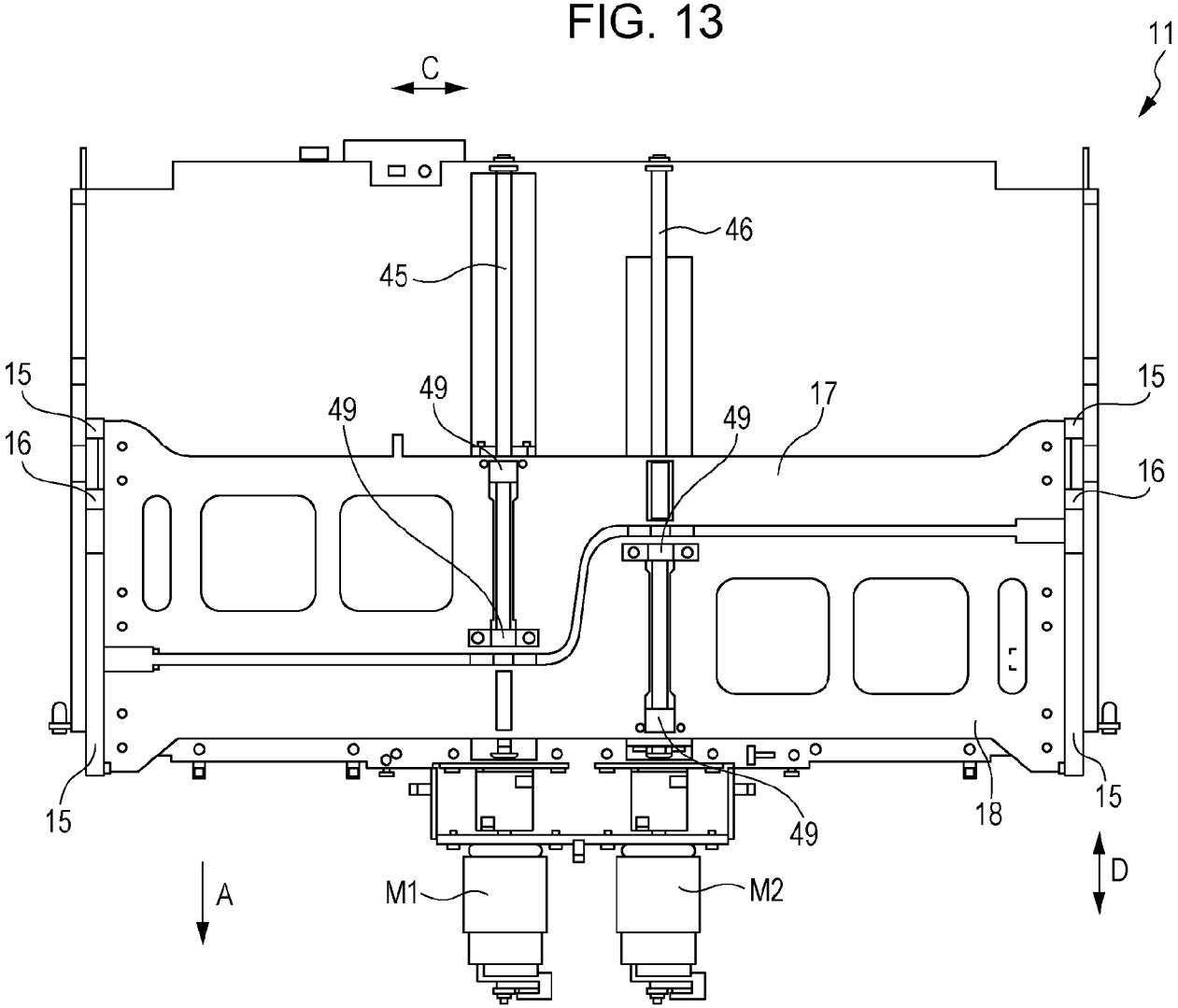
FIG. 13 is a schematic planar view representing the main section (a portion of the movement mechanism) of the recording apparatus.
Figure 14:
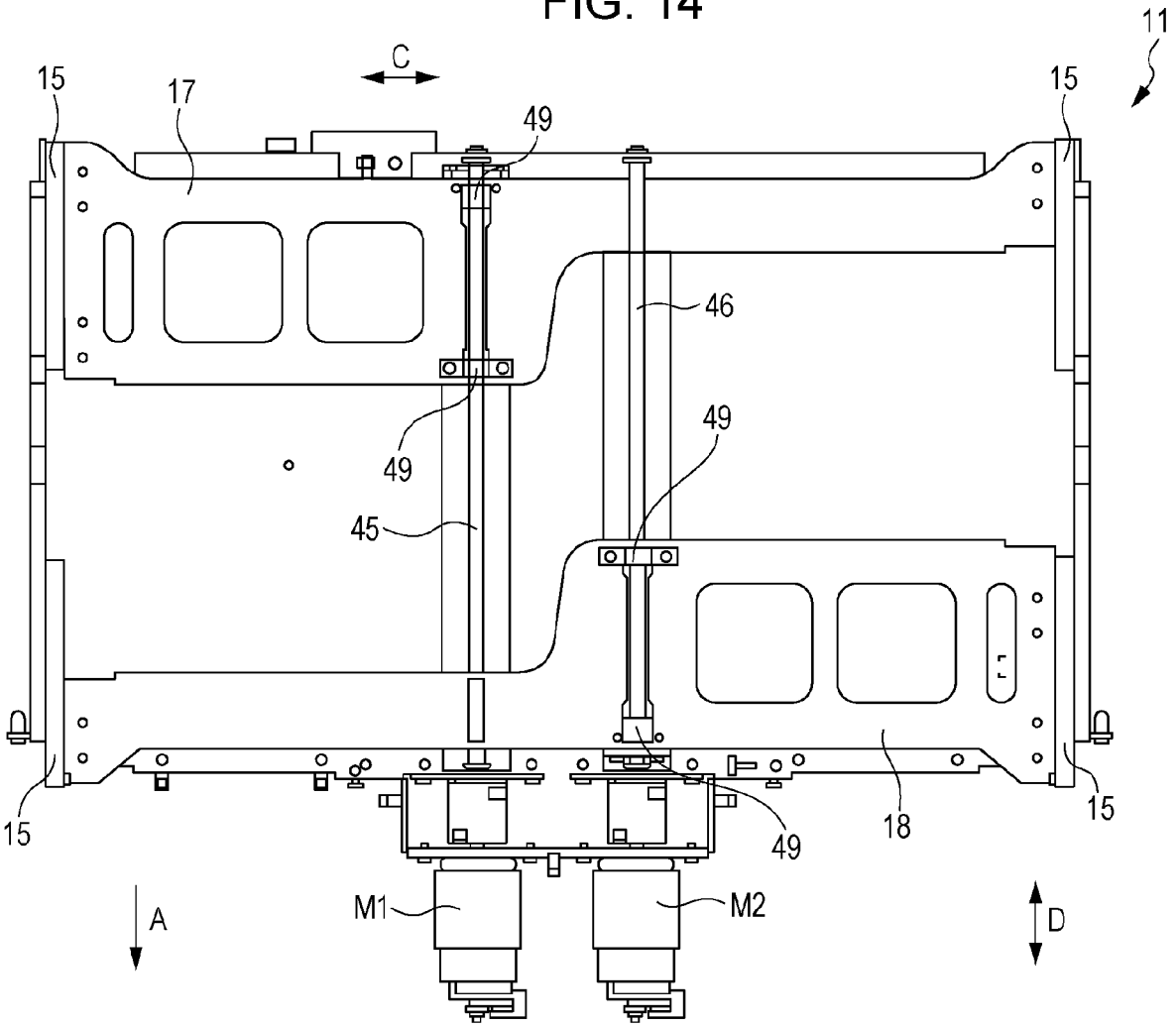
FIG. 14 is a schematic planar view representing the main section (a portion of the movement mechanism) of the recording apparatus.
Figure 15:
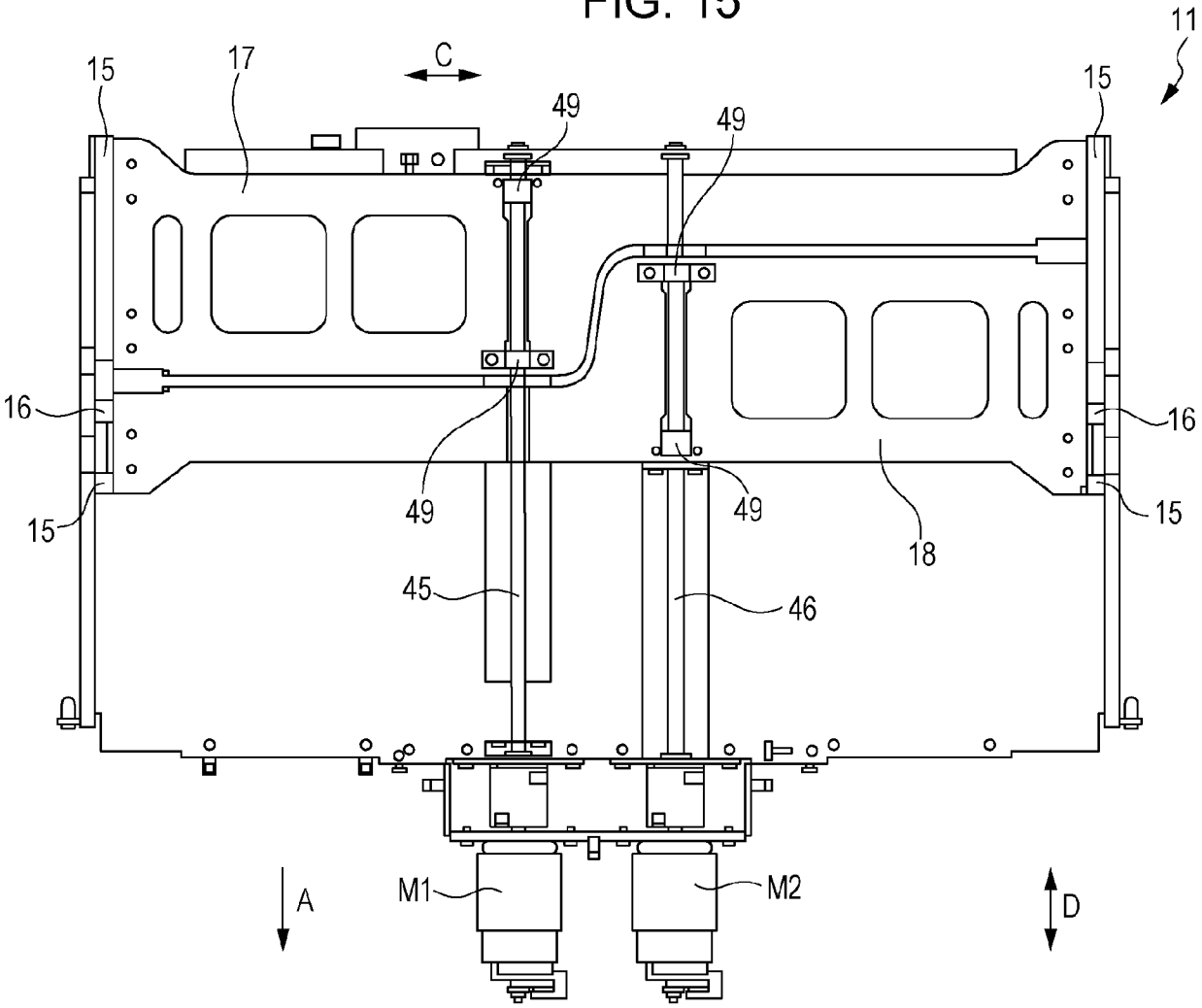
FIG. 15 is a schematic planar view representing the main section (a portion of the movement mechanism) of the recording apparatus.

In addition, FIG. 13 to FIG. 15 are schematic planar views representing the min section of the movement mechanism 11 of the example. Here, FIG. 13 corresponds to a state in which recording is performed on the recording medium P. In addition, FIG. 14 corresponds to a state of transitioning from the state of performing recording on the recording medium P to a state of capping the recording head 2 using the capping unit 3. In addition, FIG. 15 corresponds to a state of capping the recording head 2 using the capping unit 3.

Figure 16:
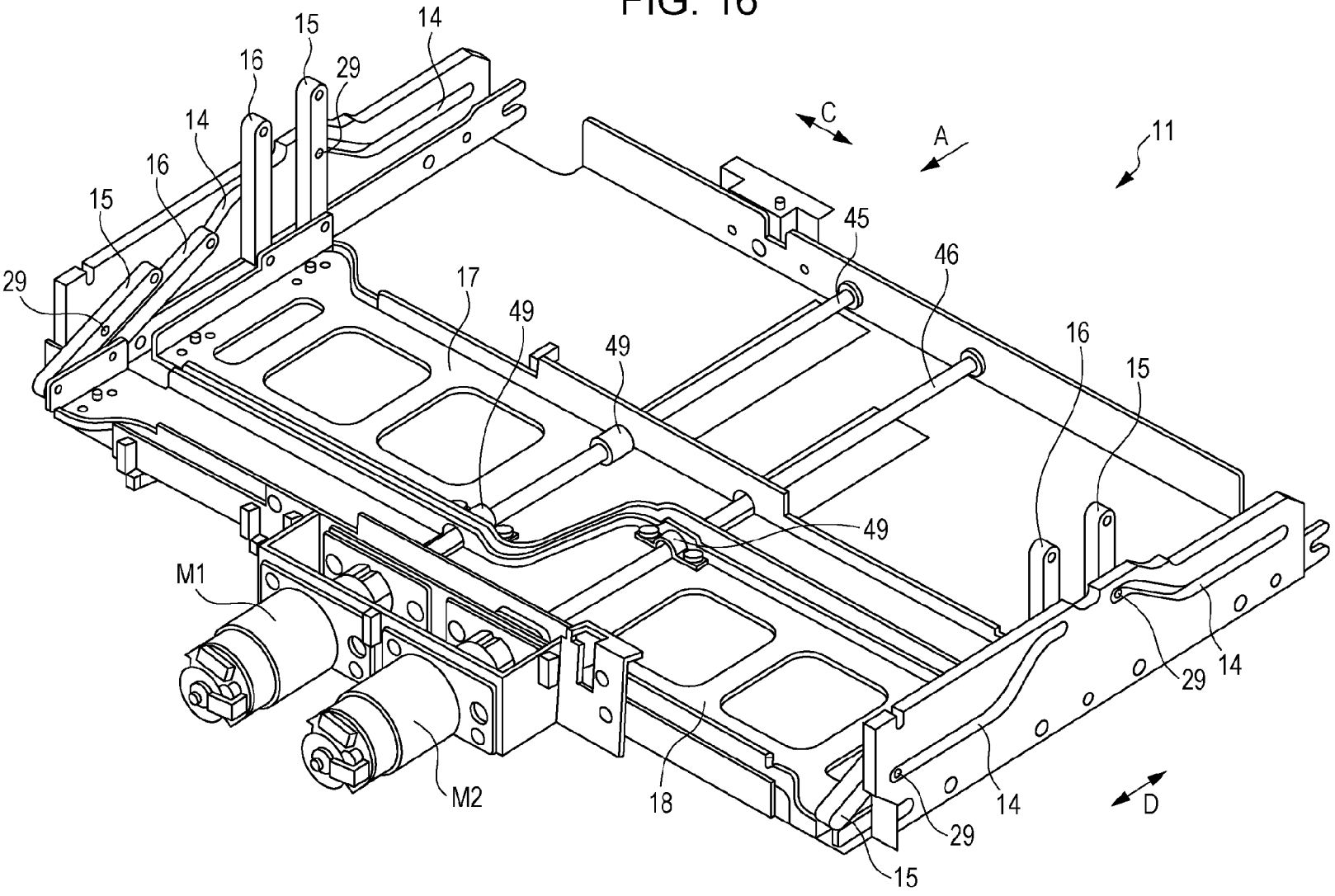
FIG. 16 is a schematic perspective view representing the main section (a portion of the movement mechanism) of the recording apparatus.
Figure 17:
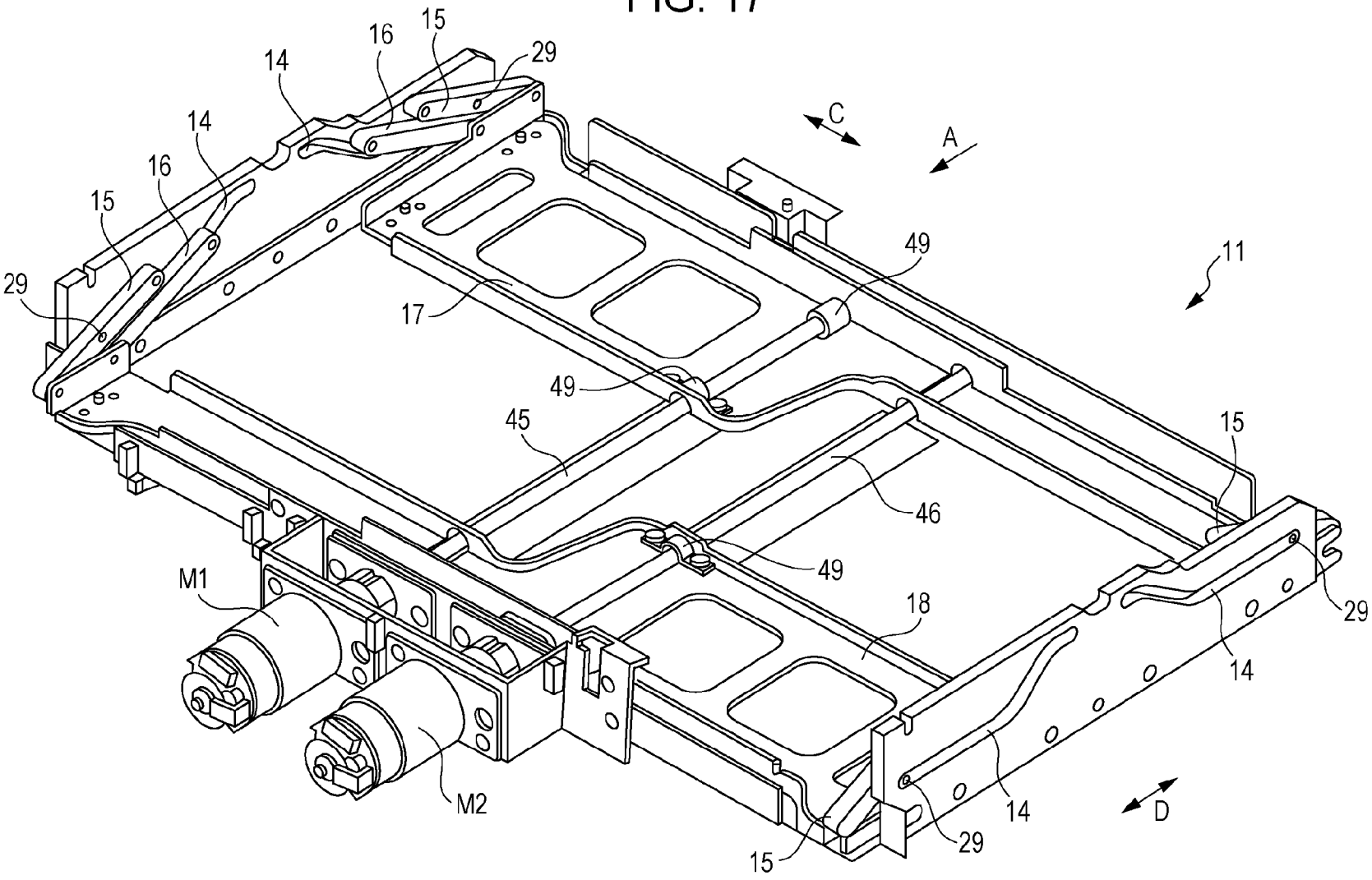
FIG. 17 is a schematic perspective view representing the main section (a portion of the movement mechanism) of the recording apparatus.

In addition, FIG. 16 and FIG. 17 are schematic perspective views of the main section of the movement mechanism 11 of the example. Here, FIG. 16, which corresponds to FIG. 13, corresponds to a state in which recording is performed on the recording medium P. In addition, FIG. 17, which corresponds to FIG. 14, corresponds to a state of transitioning from a state of performing recording on the recording medium P to a state of capping the recording head 2 using the capping unit 3.

Figure 18:
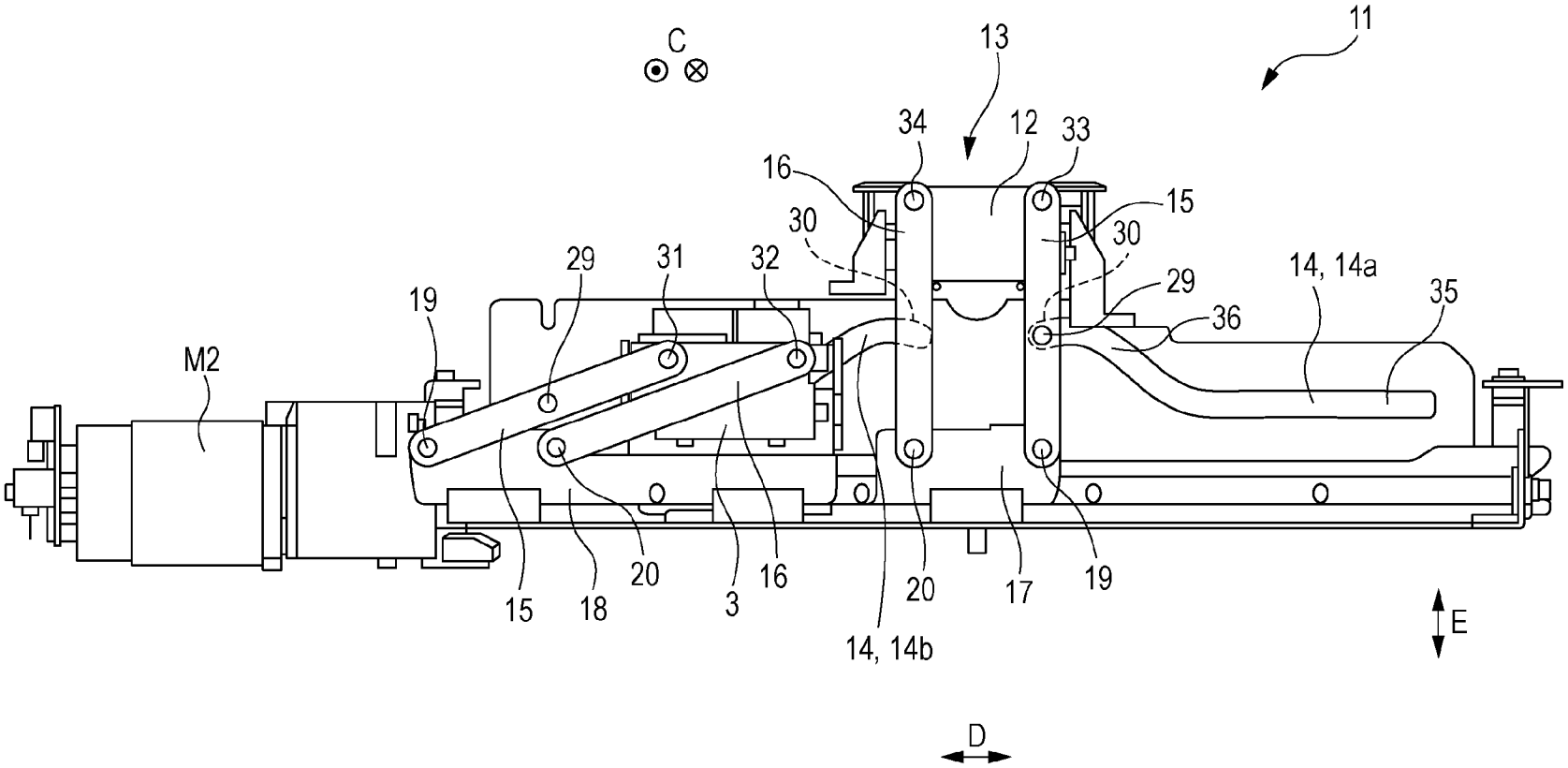
FIG. 18 is a side surface outline view representing the main section (the movement mechanism) of the recording apparatus.

In addition, FIG. 18 is a side surface outline view of the movement mechanism 11 of the example, and represents a state in which recording is performed on the recording medium P.

As represented in FIG. 5 to FIG. 10 and FIG. 13 to FIG. 18, the movement mechanism 11 of the example has the guide groove 14 which guides the movement of the support section 12 and the capping unit 3, the first guide bar 15, and the second guide bar 16, and the guide grooves 14 are configured on both end portions of the support bases 17 and 18 in the intersecting direction C.

In detail, as represented in FIG. 11, FIG. 12, and FIG. 18, projecting sections 19 and 20 are configured on both end portions of the support bases 17 and 18 in the intersecting direction C, one end portion of the first guide bar 15 in the longitudinal direction is fitted in the projecting section 19 in a rotatably movable state, and one end portion of the second guide bar 16 in the longitudinal direction is fitted in the projecting section 20 in a rotatably movable state.

Here, as represented in FIG. 18, the other end portion of the first guide bar 15 which is attached to the support base 17 is fitted in a projecting section 33 which is attached to the end portion of the support section 12 in the intersecting direction C in a rotatably movable state, and the other end portion of the second guide bar 16 which is attached to the support base 17 is fitted in a projecting section 34 which is attached to the end portion of the support section 12 in the intersecting direction C in a rotatably movable state.

Then, as represented in FIG. 18, the other end portion of the first guide bar 15 which is attached to the support base 18 is fitted in a projecting section 31 which is attached to the end portion of the capping unit 3 in the intersecting direction C in a rotatably movable state, and the other end portion of the second guide bar 16 which is attached to the support base 18 is fitted in a projecting section 32 which is attached to the end portion of the capping unit 3 in the intersecting direction C in a rotatably movable state.

By configuring in such a manner, the first guide bar 15 and the second guide bar 16 are moved in parallel. In this manner, it is possible to simply maintain the support section 12 and the capping unit 3 horizontally (parallel to the nozzle formation surface F of the recording head 2) at the facing position 13 by providing two (a plurality of) the guide bars of the first guide bar 15 and the second guide bar 16. For this reason, in addition to it being possible to set a constant distance between the recording head 2 (the nozzle formation surface F) and the recording medium P (so-called PG), it is possible to suppress the ink which is discharged to the capping unit 3 from spilling.

In addition, a projecting section 29 is configured to be in the vicinity of a center section in the longitudinal direction in the first guide bar 15, and the projecting section 29 is fitted in the guide groove 14.

As represented in FIG. 18, the guide groove 14 is configured by a straight section 35 (a first region) along the direction D at a position which is separated from the facing position 13, and is configured by a curved section 36 (a second region) which faces the recording head 2 side at a position close to the facing position 13 and which extends in a direction which diagonally intersects with the straight section 35. By the guide groove 14 being set with such a form, the first guide bar 15 and the second guide bar 16 are maintained in a tilted state in a state in which the support section 12 and the capping unit 3 are positioned separated from the facing position 13. Then, when the support section 12 and the capping unit 3 come to be in a position which is close to the facing position 13, the first guide bar 15 and the second guide bar 16 come to have postures such that the longitudinal direction thereof comes close to the vertical direction by bringing the support section 12 and the capping unit 3 close to the facing position 13.

By configuring in such a manner, the movement of the support section 12 and the capping unit 3 of the example are respectively guided in the direction D at the position which is separated from the facing position 13 and in the direction E at the position which is close to the facing position 13.

In this manner, since the guide grooves 14 which guide the movement of the support section 12 and the capping unit 3 are provided in the movement mechanism 11 of the example, the movement of the support section 12 and the capping unit 3 is facilitated.

In addition, as represented in FIG. 18, by configuring in the manner described above, the movement mechanism 11 of the example is disposed such that a guide groove 14*a* as the guide groove for the support section and a guide groove 14*b* as the guide groove for the capping unit do not overlap when viewed from the direction E which is the direction from the recording head 2 toward the facing position 13.

For this reason, in the configuration, when moving the support section 12 and the capping unit 3, it is difficult for the support section 12 and the capping unit 3 to interfere with each other.

In addition, as represented in FIG. 5 to FIG. 18, the movement mechanism 11 of the example is provided with motors M1 and M2, the support base 17 is movable in the direction D along a movement shaft 45 by the driving force of the motor M1, and the support base 18 is movable in the direction D along a movement shaft 46 by the driving force of the motor M2. That is, movement of the support section 12 in the direction D and in the direction E is realized using one driving source, and movement of the capping unit 3 in the direction D and in the direction E is realized using one driving source.

In other words, movement of the support section 12 and the capping unit 3 in the direction D and in the direction E are respectively realized using one driving source due to the movement mechanism 11 being configured so as to be provided with the support bases 17 and 18. That is, the configuration of the support section 12 itself is simply made by having the support base 17 as a support section base which supports the support section 12 and moves, and the configuration of the capping unit 3 itself is simply made by having the support base 18 as a maintenance unit base which supports the capping unit 3 and moves.

In addition, in the guide groove 14 of the example, a leading end portion 30 of the curved section 36 (the leading end portion on the facing position 13 side of the guide groove 14) is provided so as to be tilted on the side which is separated from the recording head 2 (lower side) in the direction E. For this reason, the projecting section 29 is suppressed from unintentionally returning to the straight section 35 side (the support section 12 and the capping unit 3 being moved from the facing position 13) by being reliably held at the leading end portion 30 when the projecting section 29 is positioned at the leading end portion 30 (when the support section 12 and the capping unit 3 are positioned at the facing position 13).

Next, the internal structure of the support section 12 will be described.

Figure 19:
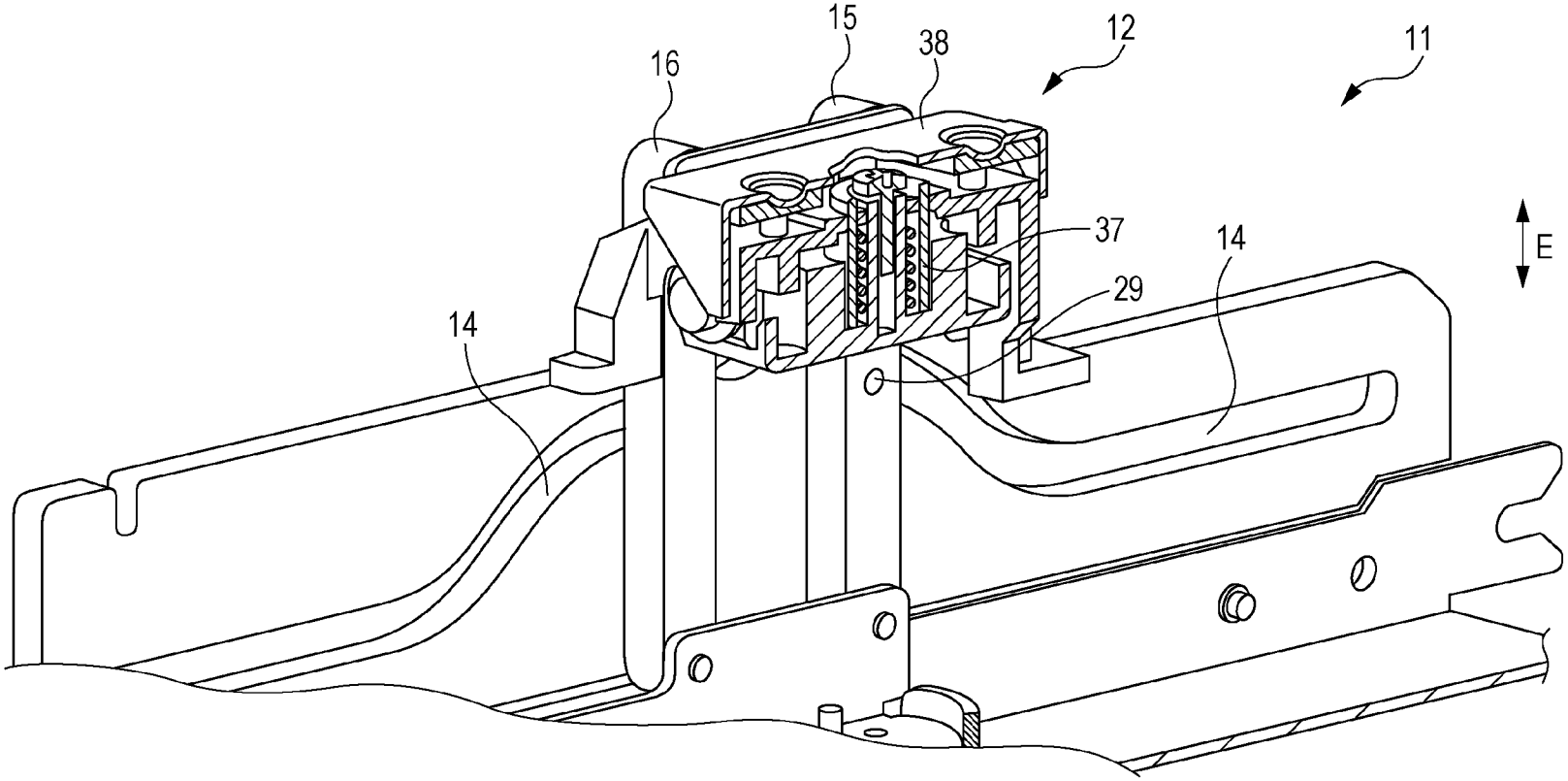
FIG. 19 is a schematic perspective view representing the main section (the movement mechanism) of the recording apparatus.
Figure 20:
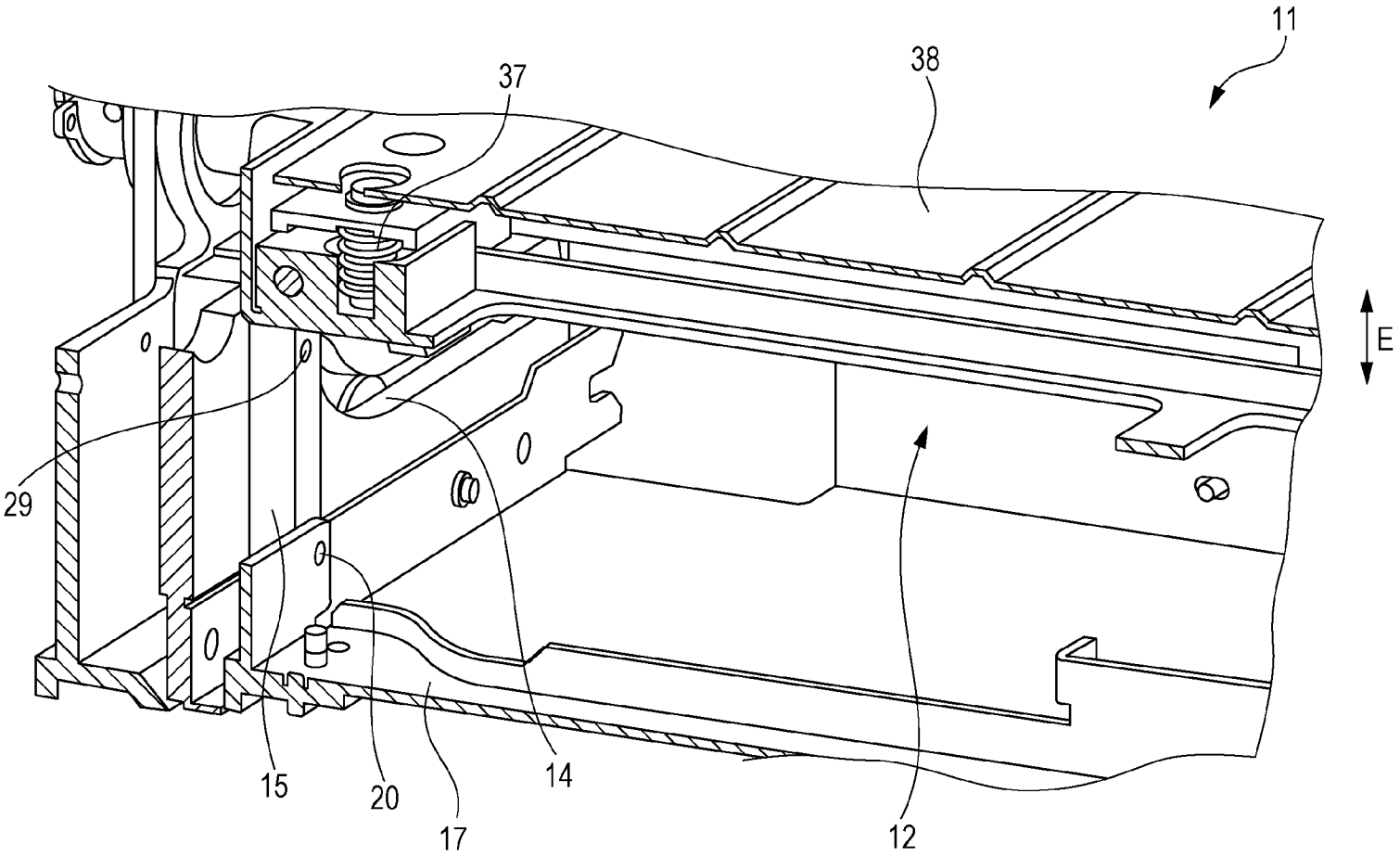
FIG. 20 is a schematic perspective view representing the main section (the movement mechanism) of the recording apparatus.

FIG. 19 and FIG. 20 are a schematic perspective view representing the main section of the movement mechanism 11 of the example, and a sectional view representing the internal structure of the support section 12.

As represented in FIG. 19 and FIG. 20, a spring 37 is provided inside the support section 12, and the support surface 38 of the support section 12 is biased to the upper side by a spring 37. However, it is also possible to move the support surface 38 to the lower side by pressing the support surface 38 using force equal to or more than the biasing force of the spring 37.

By setting such a configuration, the support section 12 of example is able to reliably support the recording medium P, and it is possible to suppress damage to the recording head 2 due to the recording medium P strongly coming into contact with the recording head 2 when the recording medium P causes transport failure or the like.

Next, the internal structure of the capping unit 3 will be described.

Figure 21:
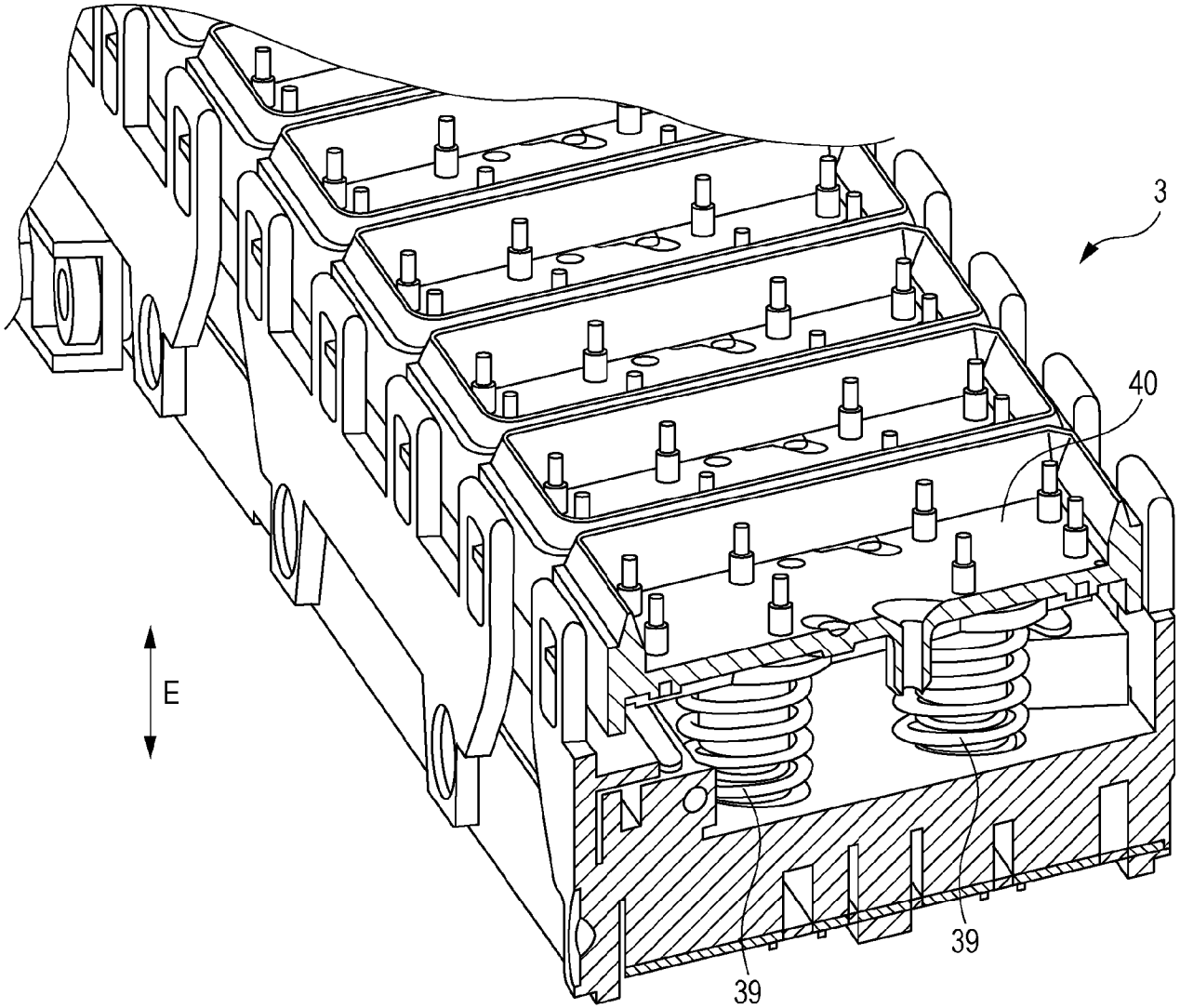
FIG. 21 is a schematic perspective view representing the main section (the movement mechanism) of the recording apparatus.
Figure 22:
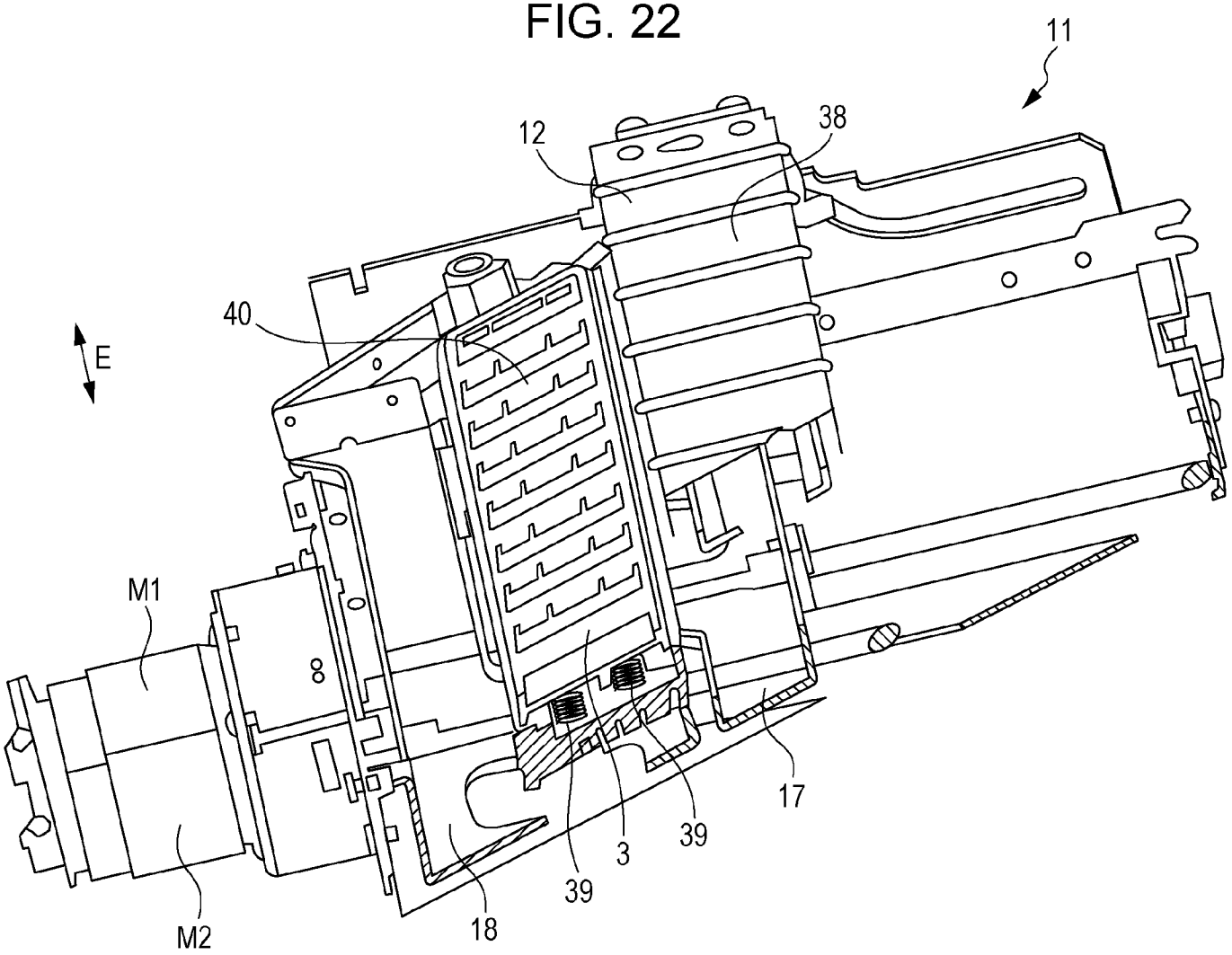
FIG. 22 is a schematic perspective view representing the main section (the movement mechanism) of the recording apparatus.

FIG. 21 and FIG. 22 are a schematic perspective view representing the main section of the movement mechanism 11 of the example, and a sectional view representing the internal structure of the capping unit 3. Here, FIG. 21 and FIG. 22 represent a state in which the cap is removed from the capping unit 3.

As represented in FIG. 21 and FIG. 22, a spring 39 is provided inside the capping unit 3, and a cap holding surface 40 of the capping unit 3 is biased to the upper side by the spring 39.

By setting such a configuration, the capping unit 3 of the example is able to reliably press the cap (carry out capping) on the recording head 2.

Figure 23:
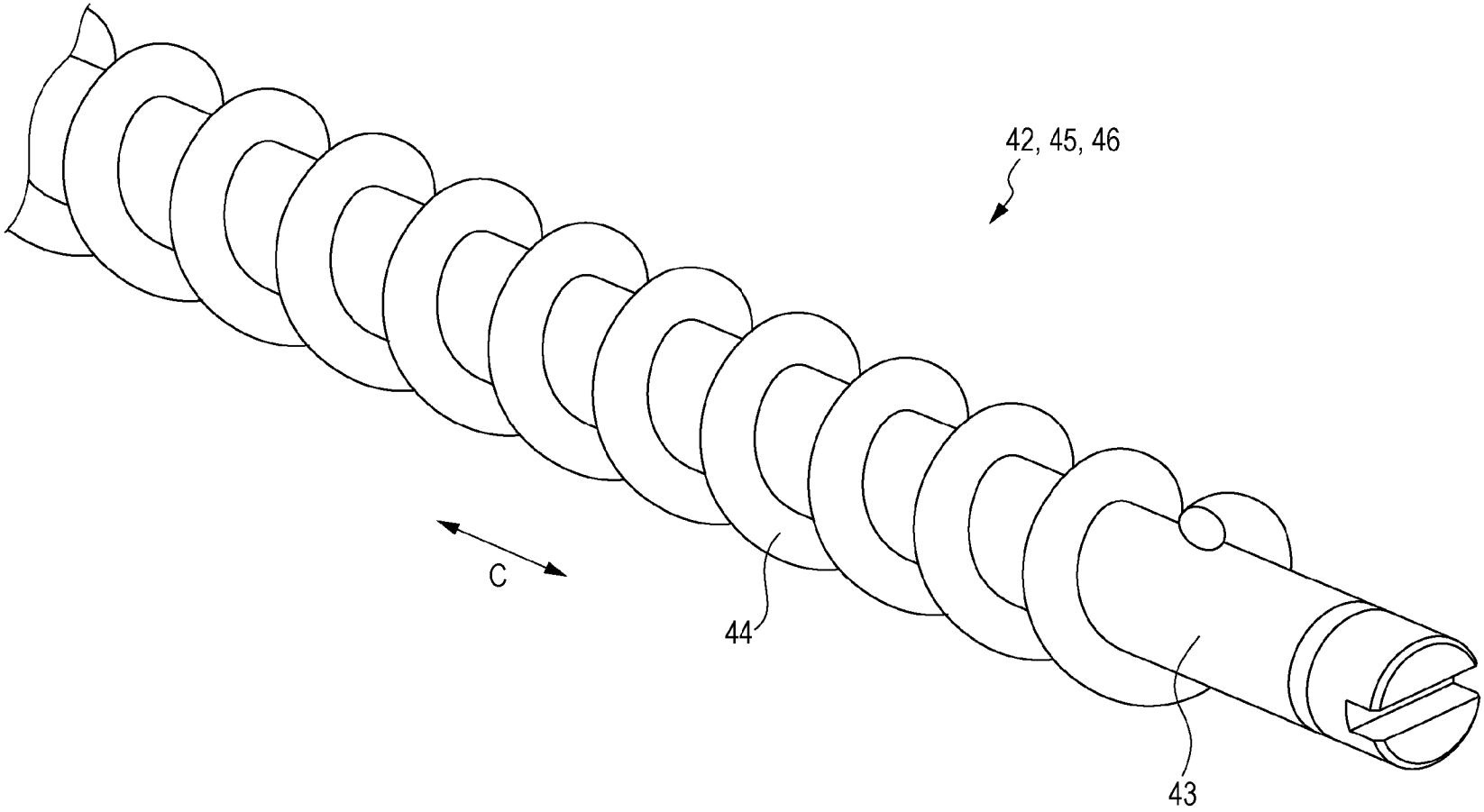
FIG. 23 is a schematic perspective view representing the main section (a portion of the movement mechanism) of the recording apparatus.

Here, as described above, the movement mechanism 11 of the example is provided with the wiper 41, and is able to wipe the nozzle formation surface F of the recording head 2 using the wiper 41. Then, as represented in FIG. 5 to FIG. 10, the wiper 41 is movable in the intersecting direction C along the movement shaft 42. As represented in FIG. 23 which is an enlarged view of the movement shaft 42, the movement shaft 42 is formed such that a spiral section 44 is fixed to a shaft section 43. Then, as represented in FIG. 5 to FIG. 10, the wiper 41 is supported on the spiral section 44 by a bearing section 47, and the movement mechanism 11 of the example moves the wiper 41 in the intersecting direction C along the shaft section 43 by rotating the movement shaft 42 using a motor M3.

Here, in the example, the movement shaft 42 is configured by annealing in which the spiral section 44 of iron is heated and fixed to the shaft section 43.

In addition, as described above, the movement mechanism 11 of the example is moved along the movement shaft 45 which is the feeding screw when the support base 17 (support section 12) is moved in the direction D. Then, when the support base 18 (capping unit 3) is moved in the direction D, the support base 18 (capping unit 3) is moved along the movement shaft 46. Here, the movement shaft 45 and the movement shaft 46 are configured in the same manner as the movement shaft 42 which is represented in FIG. 23. That is, the movement mechanism 11 of the example has the movement shaft 45 and the movement shaft 46 as the feeding screw, and the support section 12 and the capping unit 3 have the bearing sections 49 which engage with the movement shaft 45 and the movement shaft 46 (refer to FIG. 11 to FIG. 17). In this manner, the movement mechanism 11 is simply configured by the movement mechanism 11 being configured to have the feeding screw and by at least one of the support section 12 and the capping unit 3 being configured to have the bearing sections 49 which engage with the feeding screw.

Here, since the movement mechanism 11 of the example takes a state which is represented by FIG. 6, FIG. 9, FIG. 14, and FIG. 17 when carrying out wiping (a state in which the support section 12 and the capping unit 3 retreat to both sides in the direction D), the movement mechanism 11 is configured such that the support section 12 and the capping unit 3 are moved (the movement mechanisms are respectively provided) using the two shafts of the movement shaft 45 and the movement shaft 46. However, in a configuration in which the wiper 41 is not provided, one movement shaft (the movement mechanism is common) may be set for the support section 12 and the capping unit 3.

Next, a state in which the capping unit 3 (maintenance unit) that is at a position at which maintenance is performed by abutting against the head surface 2*a* of the recording head 2 separates from the head surface 2*a* of the recording head 2 and retreats will be described. FIGS. 51A to 51C and FIGS. 52A and 52B are schematic views for describing a state in which the capping unit 3 separates from the head surface 2*a* of the recording head 2 and retreats, viewed from the intersecting direction C which intersects with the transport direction A of the paper sheet P.

The movement mechanism 11 is configured so as to include the support base 18 (movable carriage) which moves in the transport direction of the paper sheet P at a position below the capping unit 3 in the direction E, the guide member 60 (refer to FIG. 7) which is provided with the guide groove 14*b* which extends in the direction D, and the first guide bar 15 (link member) which has the projecting section 29 (guided section) which is guided by the guide groove 14*b*, of which one side is rotatably linked to the projecting section 19 (linking section) which is provided on the support base 18, and of which the other side is rotatably linked to the projecting section 31 (linking section) which is provided on the capping unit 3.

In addition, the movement mechanism 11 is provided with the second guide bar 16 (auxiliary link member) of which one side is rotatably linked to the projecting section 20 (linking section) which is provided on the support base 18, and of which the other side is rotatably linked to the projecting section 32 (linking section) which is provided on the capping unit 3.

Figure 51A:
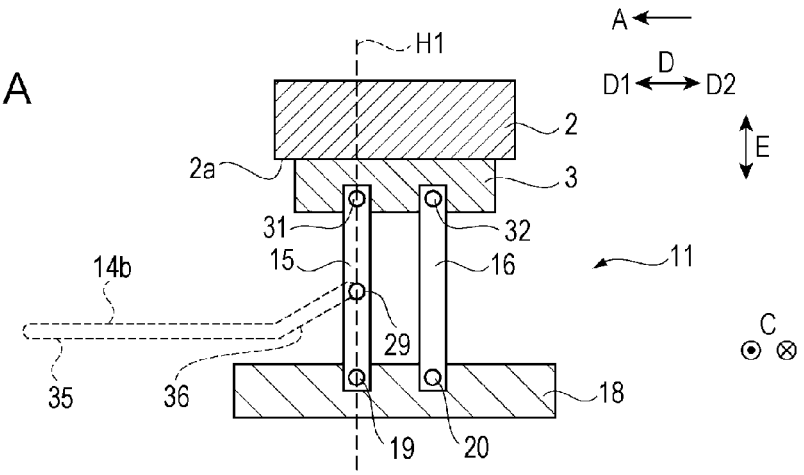
FIGS. 51A to 51C are schematic views for describing a state in which a capping unit separates from the recording head and retreats.

The capping unit 3 in FIG. 51A is positioned facing the recording head 2 to perform maintenance by abutting against the head surface 2*a* of the recording head 2. The projecting section 29 which is provided in the center section of the first guide bar 15 is provided in a state of penetrating into the guide groove 14*b* which is indicated by a broken line. The projecting section 29 of FIG. 51A is positioned in the end portion at the direction D2 side of the guide groove 14*b*. In this state, in the first guide bar 15 and the second guide bar 16, the longitudinal direction is in a state of the posture along the direction E.

Figure 51B:
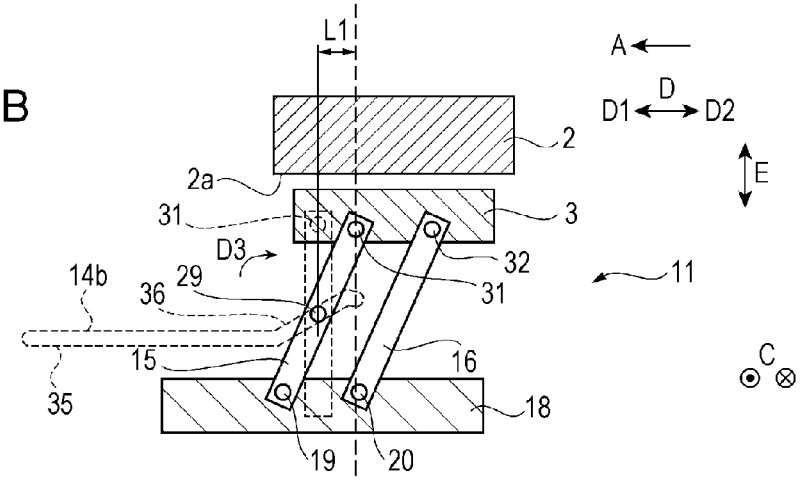

As shown in FIG. 51B, when the support base 18 is moved in the direction D1, the projecting section 29 is moved along the curved section 36 in the guide groove 14*b*. The first guide bar 15 moves in the direction D1 while rotating in the direction D3 with the projecting section 29 as a support point.

Here, for description, the amount of movement in the direction D of the projecting section 31 will be described in each of a case where the first guide bar 15 performs only the movement operation in the direction D1, or a case where the first guide bar 15 performs only the movement operation in the direction D3.

In a case where the first guide bar 15 performs only the movement operation in the direction D1, the first guide bar 15 moves in the direction D1 while maintaining the posture with the longitudinal direction being along the direction E, and the amount of movement in the direction D1 of the projecting section 31 at the position of the first guide bar 15 which is indicated by the broken line in FIG. 51B is a distance L1.

Meanwhile, in a case where the first guide bar 15 is rotated in the direction D3 without moving to the left side in the drawing in the direction D, the amount of movement in the direction D2 of the projecting section 31 is the distance L1.

Accordingly, when the first guide bar 15 simultaneously performs the movement operation to the left side in the drawing, and the rotation operation in the direction D3, the distance L1 as the amount of movement in the direction D1 is offset by the distance L1 as the amount of movement in the direction D2 in the direction D of the projecting section 31. For this reason, when the support base 18 is moved in the direction D1, the capping unit 3 moves below (lower side in the drawing) the direction E which intersects with the head surface 2*a* at the position which is indicated by the broken line H1. Thereby, since the capping unit 3 does not slide in the direction D on the head surface 2*a* of the recording head 2, wear to the head surface 2*a* due to the capping unit 3 is suppressed. Here, the result of a numerical value where the distance L1 as the amount of movement in the direction D1 is offset by the distance L1 as the amount of movement in the direction D2 may be a value close to 0.

Figure 51C:
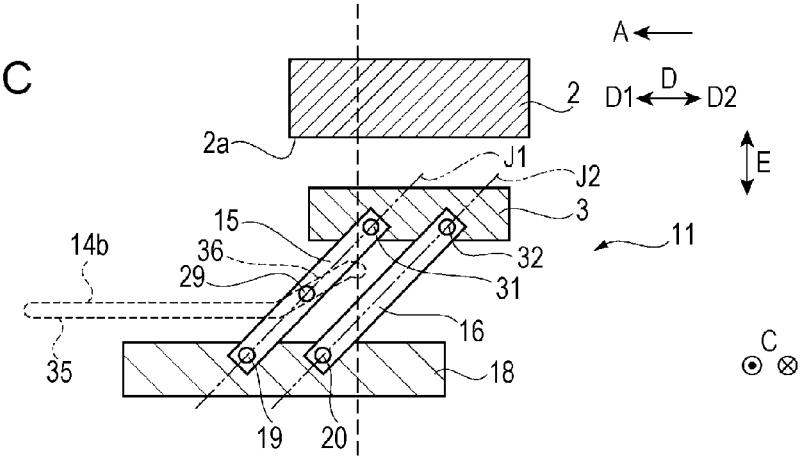

Furthermore, when the support base 18 in FIG. 51C is moved in the direction D1, the projecting section 29 is moved in the direction D1 and downward along the curved section 36 in the guide groove 14*b*, and the first guide bar 15 is moved in the direction D1 while rotating in the direction D3 with the projecting section 29 as a support point.

Figure 52A:
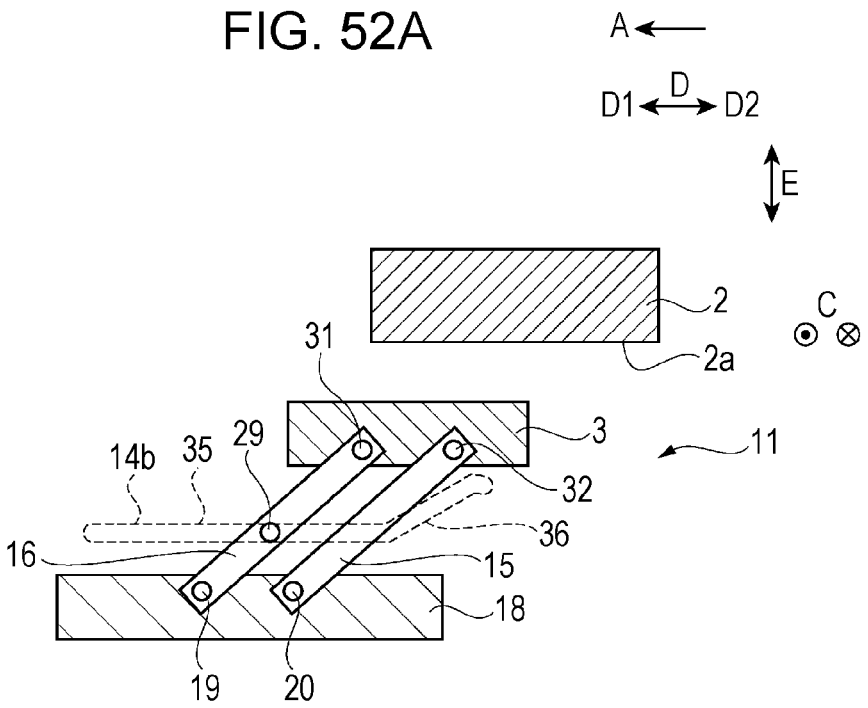
FIGS. 52A and 52B are schematic views for describing a state in which the capping unit separates from the recording head and retreats.
Figure 52B:
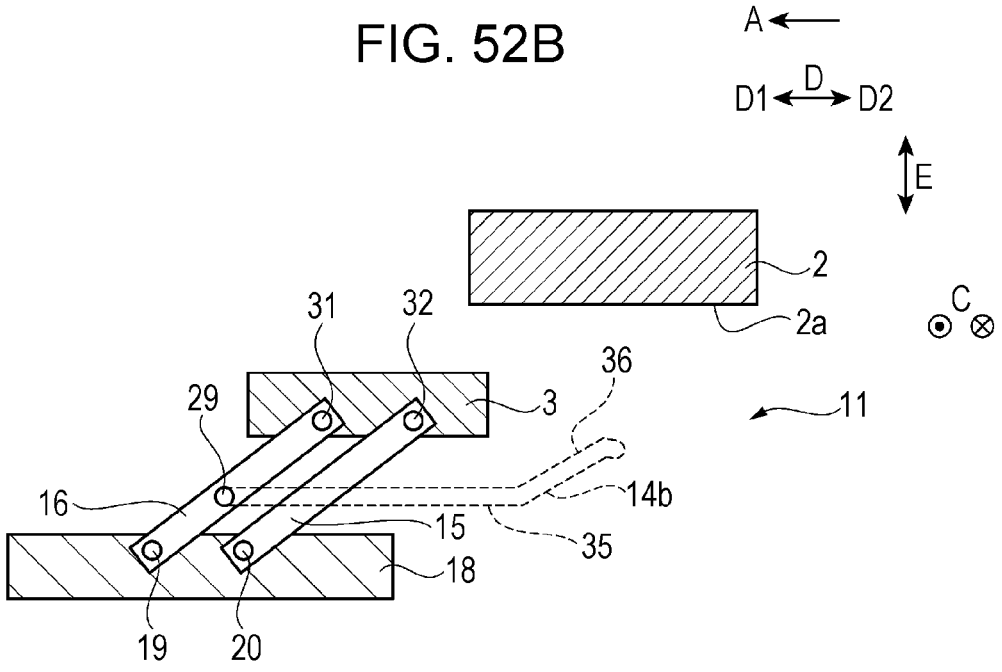

Furthermore, as shown in FIG. 52A, the projecting section 29 is guided along the straight section 35 in the guide groove 14*b*, and the capping unit 3 moves in the direction D1. Then, as shown in FIG. 52B, the projecting section 29 is positioned in the end portion on the direction D1 side in the guide groove 14*b*, and the capping unit 3 is positioned at the retreat positions.

As used in FIG. 51B, when the capping unit 3 is separated from the recording head 2, a description is given of a state in which the capping unit 3 is moved downward, and in the same manner, when the capping unit 3 at the retreat positions comes close to the head surface 2*a* of the recording head 2, the capping unit 3 moves upward in the direction E (the upper side in the drawing). Thereby, since the capping unit 3 does not slide in the direction D on the head surface 2*a* of the recording head 2, wear to the head surface 2*a* due to the capping unit 3 is suppressed.

In FIG. 51C, a line J1 which connects the projecting section 31 to the projecting section 19 is parallel to a line J2 which connects the projecting section 32 and the projecting section 20. Thereby, accompanying movement of the support base 18, when the first guide bar 15 and the second guide bar 16 move in the direction D while rotating, the capping unit 3 is movable in a state in which the posture in the horizontal direction is held. For this reason, it is possible to suppress leaking of ink (liquid) from the capping unit 3.

Here, when the capping unit 3 is separated from the recording head 2 or is close to the recording head 2, the movement direction of the capping unit 3 may be a diagonal direction with respect to the direction which is orthogonal to the head surface 2*a* of the recording head 2.

Next, the recording head 2 of the example and a protective section 48 of the recording head 2 will be described.

Figure 25:
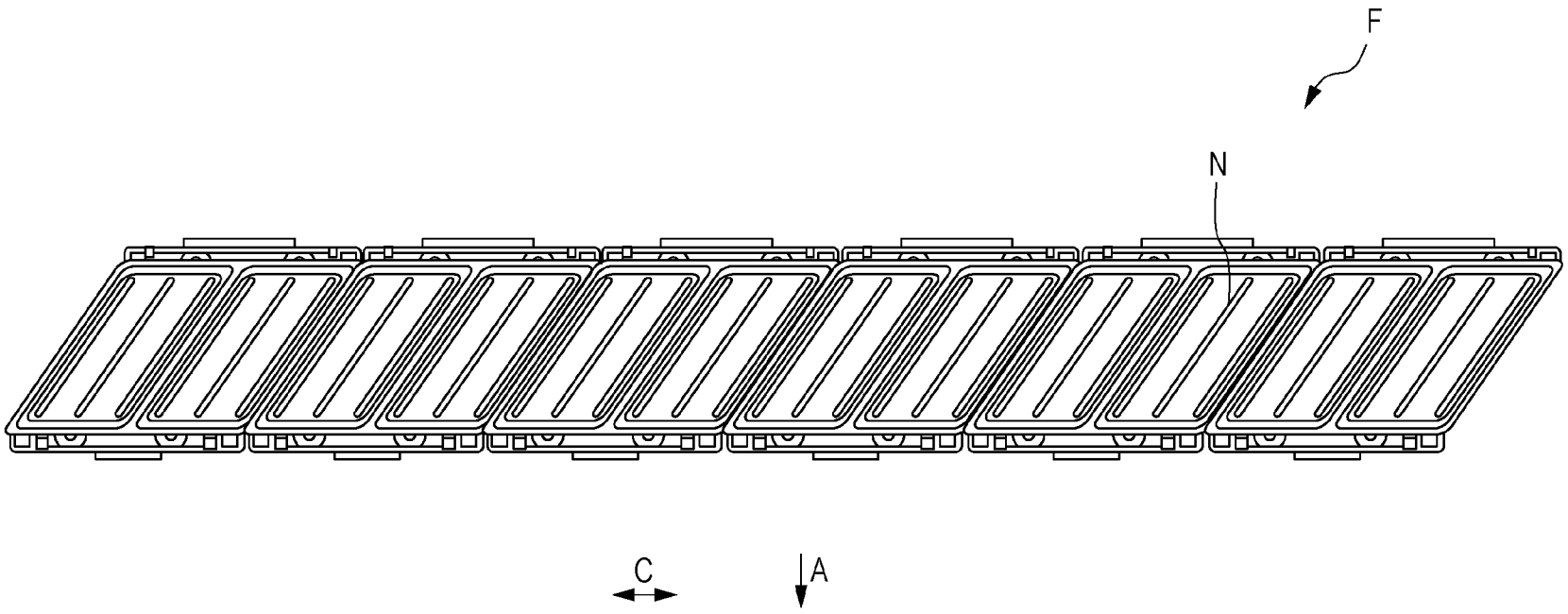
FIG. 25 is a schematic perspective view representing the main section (a nozzle formation surface of the recording head) of the recording apparatus.
Figure 26:
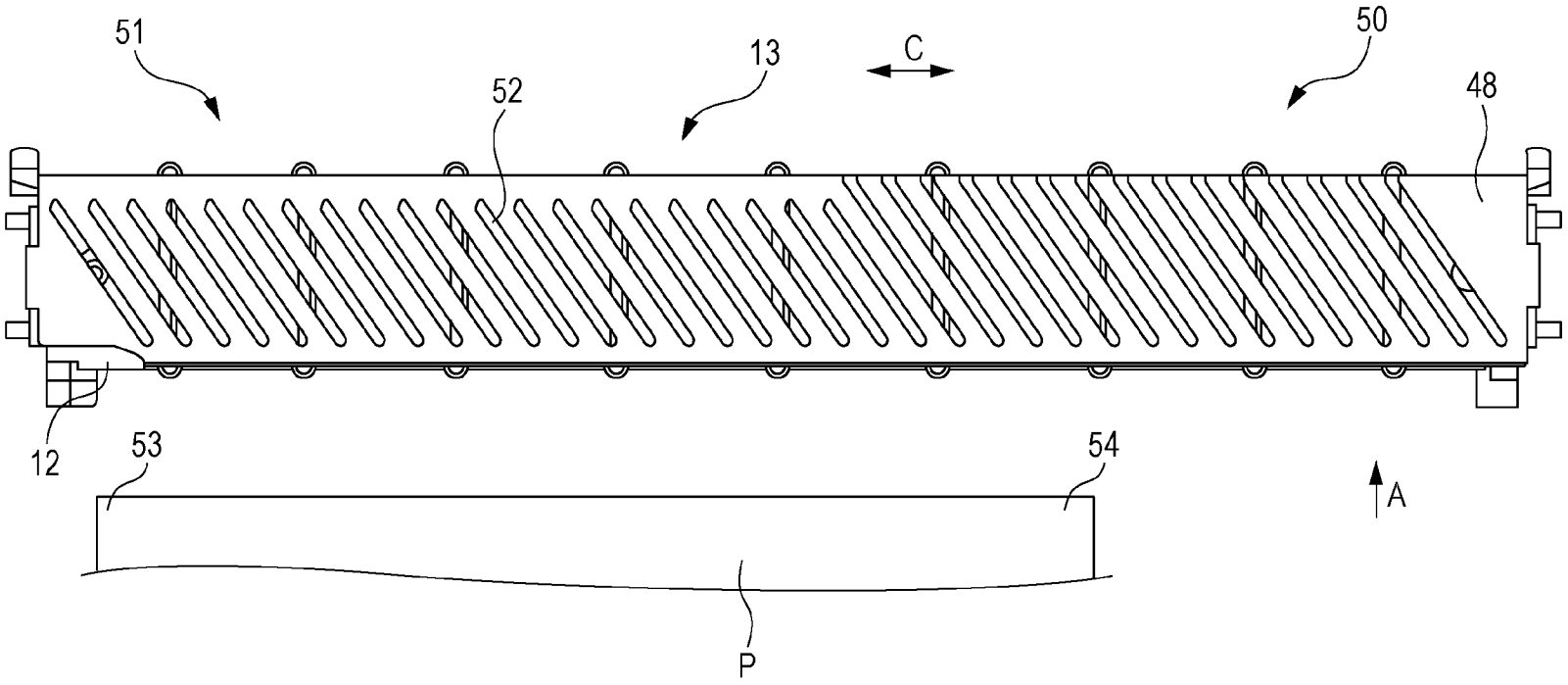
FIG. 26 is a schematic planar view representing the main section (a protective section of the recording head) of the recording apparatus.
Figure 27:
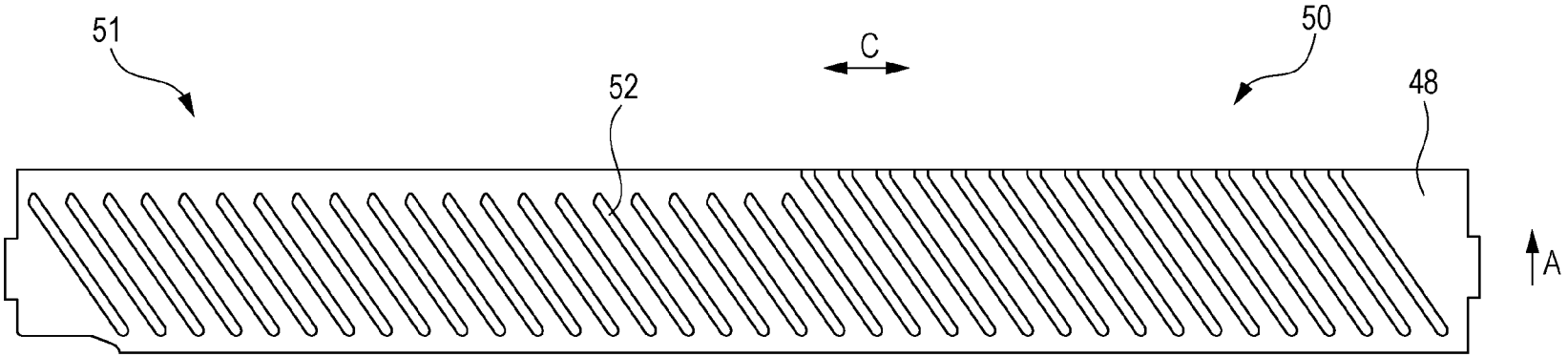
FIG. 27 is a schematic planar view representing the main section (the protective section of the recording head) of the recording apparatus.

FIG. 24 is a side surface outline diagram representing peripheral portions of the recording head 2 of the example. In addition, FIG. 25 is a schematic perspective view representing the nozzle formation surface F of the recording head 2 of the example. In addition, FIG. 26 and FIG. 27 are schematic planar views representing the protective section 48 of the recording head 2 of the example.

Figure 24A:
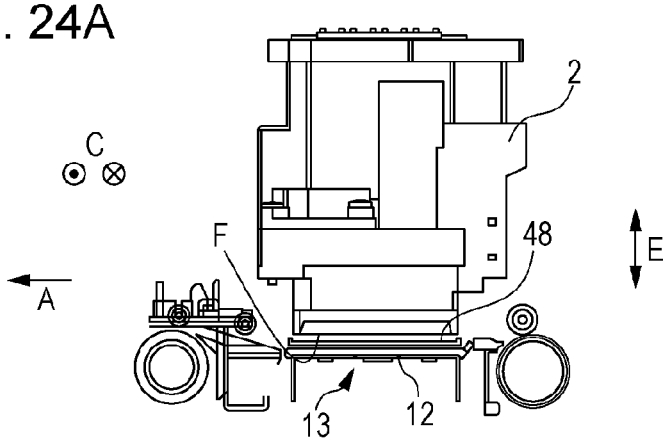
FIGS. 24A to 24C are side surface outline views representing the main section (a peripheral portion of a recording head) of the recording apparatus.
Figure 24B:
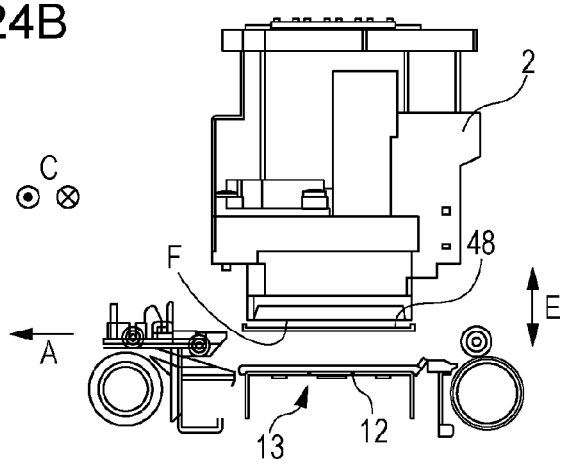
Figure 24C:
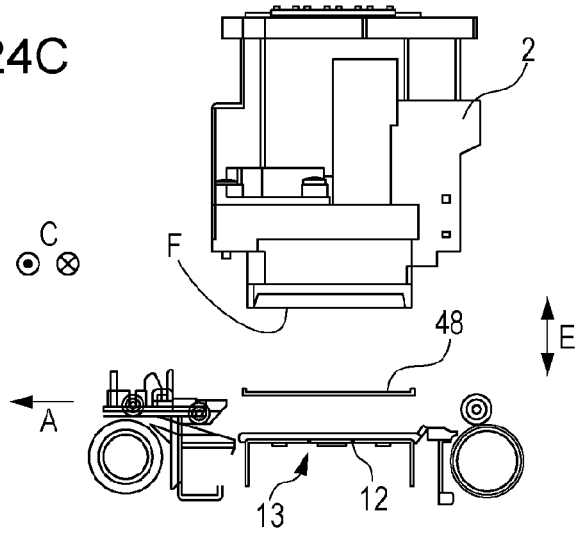

As represented in FIGS. 24A to 24C, the recording apparatus 1 of the example is provided with the protective section 48 in order to protect the nozzle formation surface F of the recording head 2. Here, it is possible to bring the protective section 48 close to and separate the section from (retreat) the recording head 2 in the direction E. Here, FIG. 24A represents a positional relationship between the recording head 2 and the protective section 48 during recording, FIG. 24B represents a state in which the protective section 48 is in the process of starting to retreat from the recording head 2, and FIG. 24C represents a state in which the protective section 48 completes retreating from the recording head 2.

When the protective section 48 retreats from the recording head 2, first, the protective section 48 moves to a predetermined upward position (a direction which separates from the support section 12) along with the recording head 2. That is, the state in FIG. 24A transitions to the state in FIG. 24B.

When the protective section 48 and the recording head 2 move to the predetermined position, only the recording head 2 is moved further to the predetermined upward position. That is, the state in FIG. 24B transitions to the state in FIG. 24C.

By configuring in this manner, it is possible to record using a predetermined PG while reliably holding the recording head 2 using the protective section 48 during recording, and it is possible to sufficiently separate the recording head 2 from the protective section 48 in a case where the recording head 2 is to be separated from the protective section 48. However, the protective section 48 may be configured to be fixed to the recording head 2.

In addition, as represented in FIG. 25, in the recording head 2 of the example, a plurality of nozzle rows, which are configured by a plurality of nozzles N, are disposed to be tilted in the transport direction A. In this manner, by disposing a plurality of nozzle rows to be tilted in the transport direction A, it is not possible to set a portion in which the nozzle N is not formed with a predetermined gap or more in the transport direction A. Here, the nozzle formation surface F which is represented in FIG. 25 is provided by a plurality being lined up in the transport direction A corresponding to the respective ink (black ink, cyan ink, magenta ink, and yellow ink).

In addition, as represented in FIG. 26 and FIG. 27, a hole section 52 is provided in the protective section 48 of the example, and the hole section 52 corresponds to a nozzle row which is configured by the nozzle N which is provided on the nozzle formation surface F. Here, FIG. 26 represents a state directly before the recording medium P is transported to a position of the support section 12 in FIG. 26 (the facing position 13), and FIG. 27 represents a simple protective section 48.

Here, as represented in FIG. 26, in the recording apparatus 1 of the example the recording medium P is transported in a state of being near to the left side of the support section 12 at the facing position 13. For this reason, it is easier for a leading end portion 54 on the right side in the transport direction A of the recording medium P to catch the hole section 52 than the leading end portion 53 on the left side.

Therefore, in the protective section 48 of the example, the hole section 52 is cut out on the downstream side in the transport direction A in a right side portion 50 which corresponds to the leading end portion 54 on the right side. For this reason, even if the leading end portion 54 on the right side catches in the hole section 52 of the right side portion 50, the leading end portion 54 is cut out from the hole section 52 accompanying transport of the recording medium P.

Meanwhile, in a left side portion 51 which corresponds to a leading end portion 53, it is difficult for the leading end portion 53 on the left side to catch the hole section 52. For this reason, in order that the intensity of the protective section 48 be increased, the hole section 52 in the left side portion 51 is not cut out on the downstream side in the transport direction A.

That is, by configuring in this manner, the protective section 48 of the example protects the nozzle formation surface F and suppresses transport failure of the recording medium P.

Example 2

Next, a recording apparatus of example 2 will be described in detail with reference to the attached drawings.

Figure 28A:
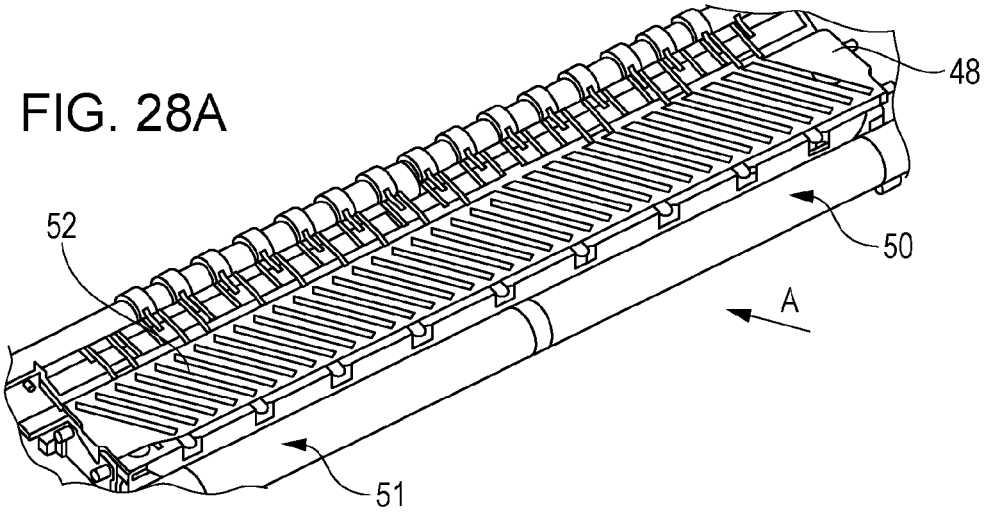
FIGS. 28A to 28C are schematic planar views representing the main section (a protective section of the recording head) of the recording apparatus according to examples 1 to 3.
Figure 28B:
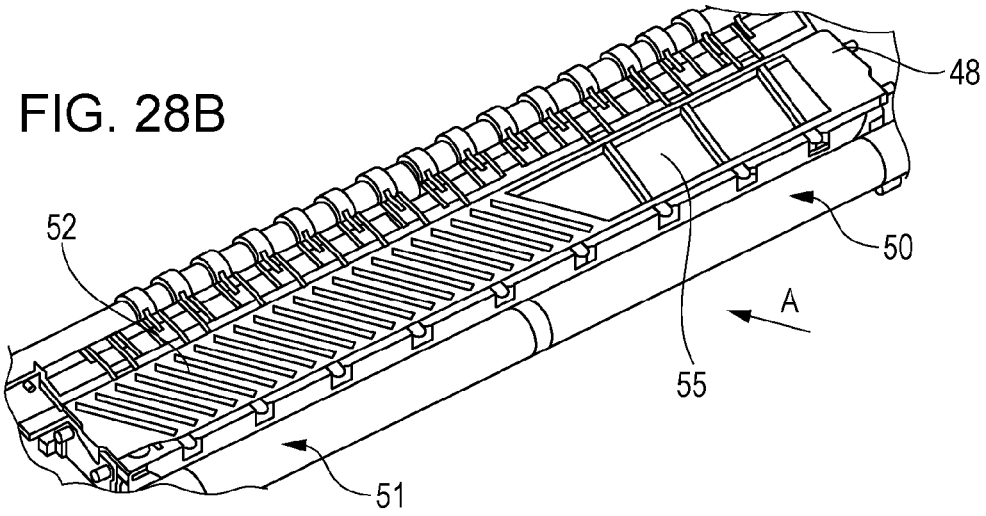

FIG. 28B is a schematic perspective view representing the protective section 48 which is the main section of the recording apparatus 1 of the example. Here, configuring members which are common with example 1 described above are shown with the same reference numerals and detailed description thereof is omitted. In addition, the protective section 48 of example 1 which corresponds to FIG. 28B is illustrated in FIG. 28A.

Here, other than the configuration of the protective section 48, the recording apparatus 1 of the example has the same configuration as the recording apparatus 1 of example 1.

As represented in FIG. 28B, the protective section 48 of the example is provided with a large space section 55 which is cut out on the downstream side in the transport direction A in the right side portion 50 in place of the plurality of hole sections 52 which correspond to a nozzle row of the recording head 2. By configuring in this manner, the protective section 48 protects the nozzle formation surface F accompanying transport of the recording medium P in the left side portion 51 and suppresses transport failure of the recording medium P.

Example 3

Next, a recording apparatus of example 3 will be described in detail with reference to the attached drawings.

Figure 28C:
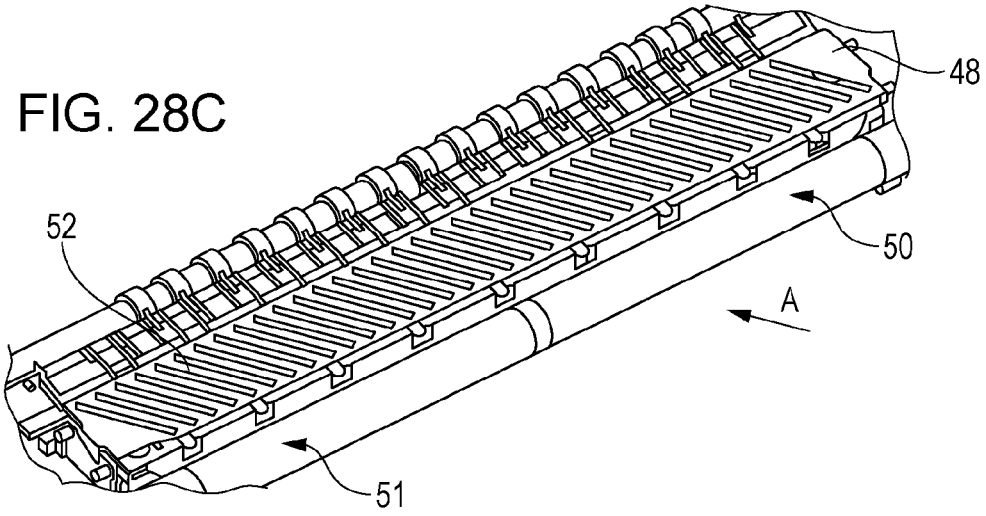

FIG. 28C is a schematic perspective view representing the protective section 48 which is the main section of the recording apparatus 1 of the example. Here, configuring members which are common with example 1 and example 2 described above are shown with the same reference numerals and detailed description thereof is omitted.

Here, other than the configuration of the protective section 48, the recording apparatus 1 of the example has the same configuration as the recording apparatus 1 of examples 1 and 2.

As represented in FIG. 28C, in the right side portion 50, the protective section 48 of the example is provided with the hole section 52 which is not cut out on the downstream side in the transport direction A in the same manner as the left side portion 51 in place of the hole section 52 which is cut out on the downstream side in the transport direction A. By configuring in this manner the nozzle formation surface F is protected accompanying transport of the recording medium P.

Example 4

Next, a recording apparatus of example 4 will be described in detail with reference to the attached drawings.

FIG. 29 is a schematic view representing the protective section 48 which is the main section of the recording apparatus 1 of the example. Here, configuring members which are common with examples 1 to 3 described above are shown with the same reference numerals and detailed description thereof is omitted.

Here, other than the configuration of the protective section 48, the recording apparatus 1 of the example has the same configuration as the recording apparatus 1 of examples 1 to 3.

Figure 29A:
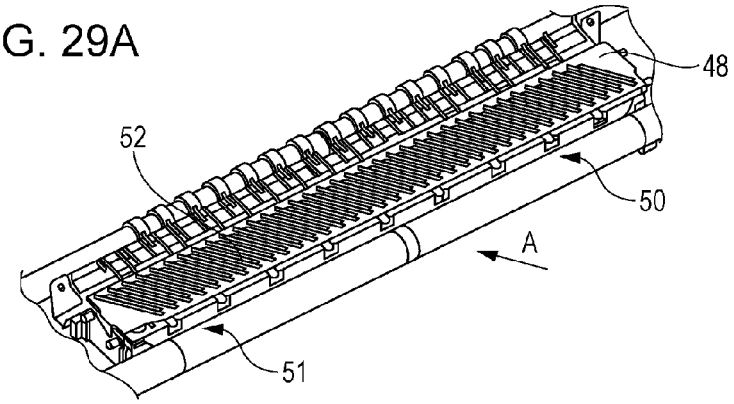
FIG. 29A to 29C are schematic views representing the main section (a protective section of the recording head) of the recording apparatus according to example 4.
Figure 29B:
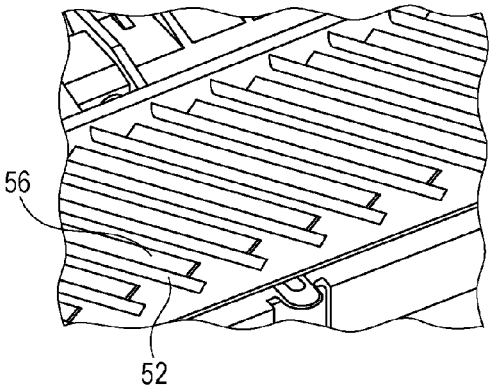

FIG. 29A is a schematic perspective view representing the protective section 48 of the example which corresponds to FIGS. 28A to 28C. In addition, FIG. 29B is a schematic enlarged view of the protective section 48 of the example. Then, FIG. 29C is a schematic sectional view of the protective section 48 of the example.

Figure 29C:
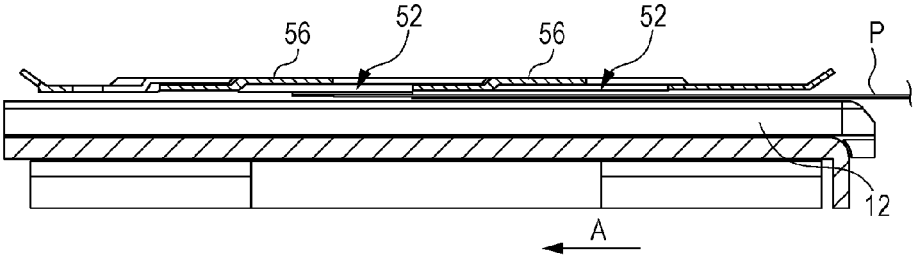

As represented in FIGS. 29A to 29C, the entirety of the protective section 48 of the example is provided with the hole section 52 which is not cut out on the downstream side in the transport direction A from the left side portion 51 to the right side portion 50 and is provided with eave sections 56 adjacent in the longitudinal direction in the hole section 52. For this reason, as represented in FIG. 29C, when the recording medium P is transported, it is possible to suppress the leading end portion 54 of the recording medium P from slipping out from the lower side of the hole section 52 to the upper side using the eave sections 56. That is, by configuring in this manner, the protective section 48 protects the nozzle formation surface F accompanying transport of the recording medium P and suppresses transport failure of the recording medium P.

Here, as any configuration of the protective section 48 of examples 1 to 4 described above or a different configuration, for example, a configuration may be set where suppressing of lifting of the recording medium P is provided at susceptible position by adding sheet metal or the like which configures the transport path of the recording medium P.

Example 5

Next, a recording apparatus of example 5 will be described in detail with reference to the attached drawings.

Figure 30:
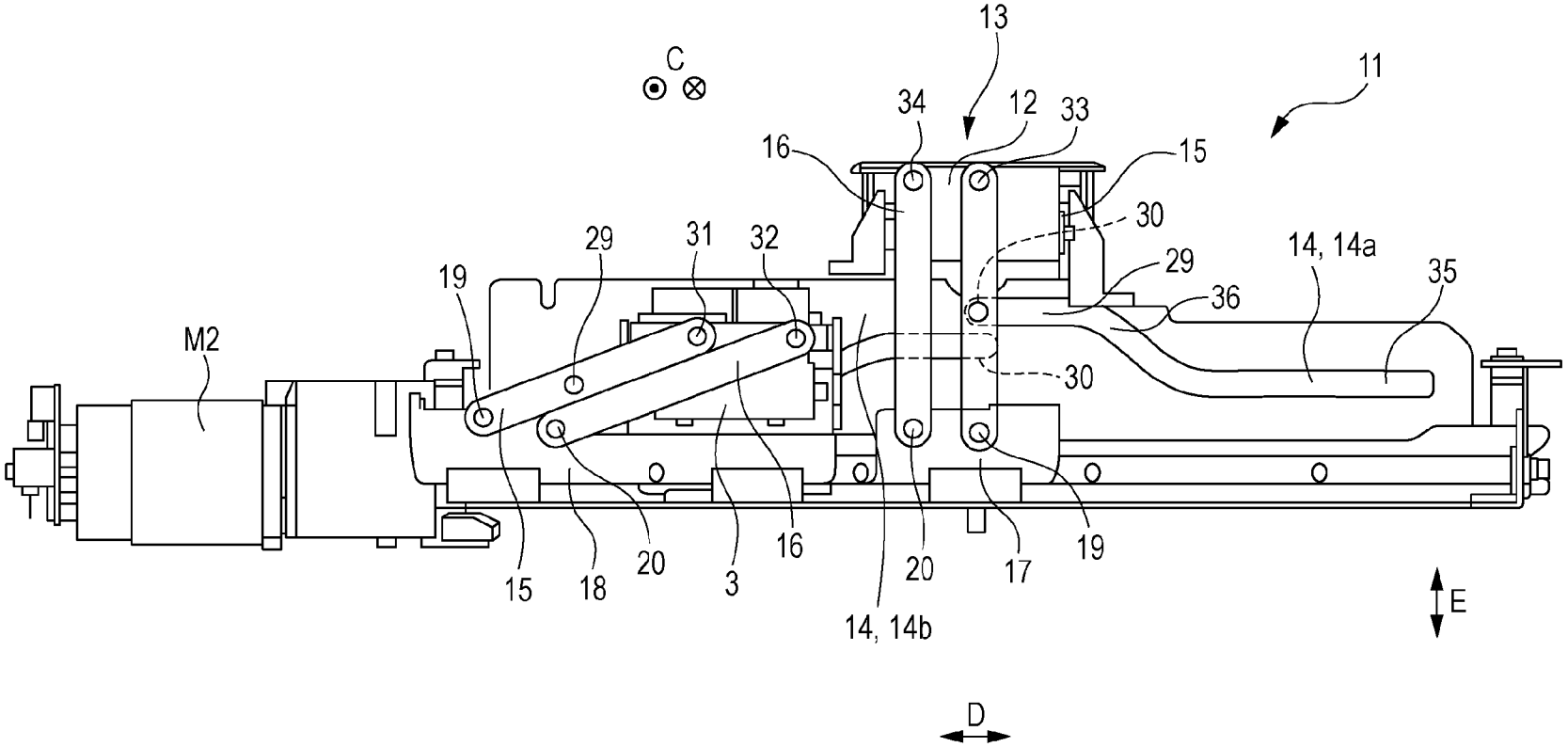
FIG. 30 is a side surface outline view representing the main section (a movement mechanism) of a recording apparatus according to example 5.

FIG. 30 is a side surface outline view representing the movement mechanism 11 which is the main section of the recording apparatus 1 of the example, and is a view which corresponds to FIG. 18 in the recording apparatus 1 of example 1. Here, configuring members which are common with examples 1 to 4 described above are shown with the same reference numerals and detailed description thereof is omitted.

Here, other than the configuration of the movement mechanism 11, the recording apparatus 1 of the example has the same configuration as the recording apparatus 1 of example 1.

As represented in FIG. 18, in the recording apparatus 1 of example 1, the guide groove 14 of the movement mechanism 11 is disposed such that the guide groove 14*a* and the guide groove 14*b* do not overlap when viewed from the direction E which is the direction from the recording head 2 toward the facing position 13. Meanwhile, the guide groove 14 of the movement mechanism 11 of the example is disposed such that the leading end portion 30 of the guide groove 14*a* and the leading end portion 30 of the guide groove 14*b* overlap when viewed from the direction E. In the manner of the guide groove 14 of the movement mechanism 11 of the example, a configuration is possible in which the length in the direction D of the movement mechanism 11 is short, and it is possible to reduce the size of the movement mechanism 11 and furthermore the recording apparatus 1 by disposing the guide groove 14*a* and the guide groove 14*b* so as to overlap when viewed from the direction E.

Example 6

Next, a recording apparatus of example 6 will be described in detail with reference to the attached drawings.

Figure 31:
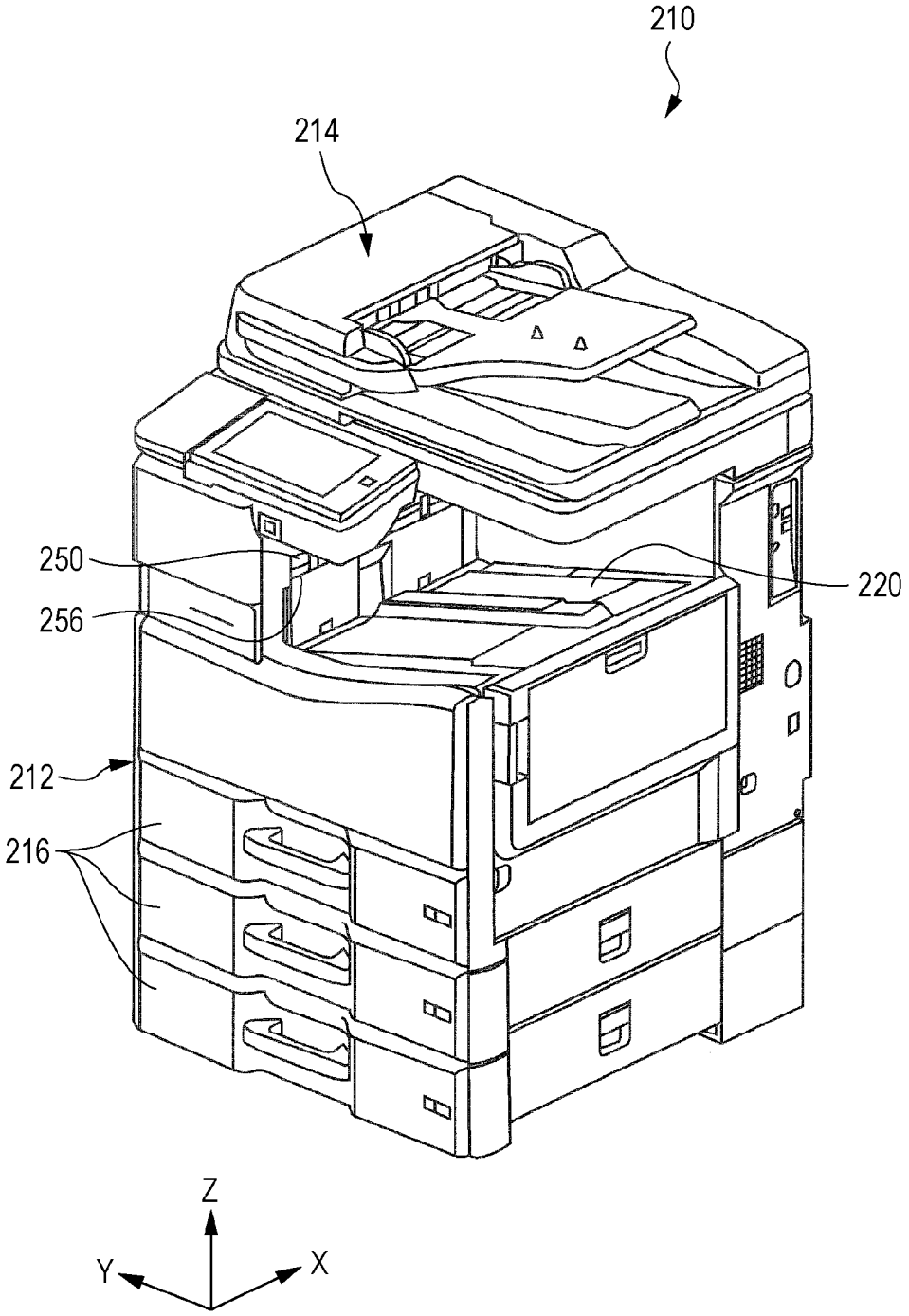
FIG. 31 is an outer appearance perspective view representing a recording apparatus according to example 6.
Figure 32:
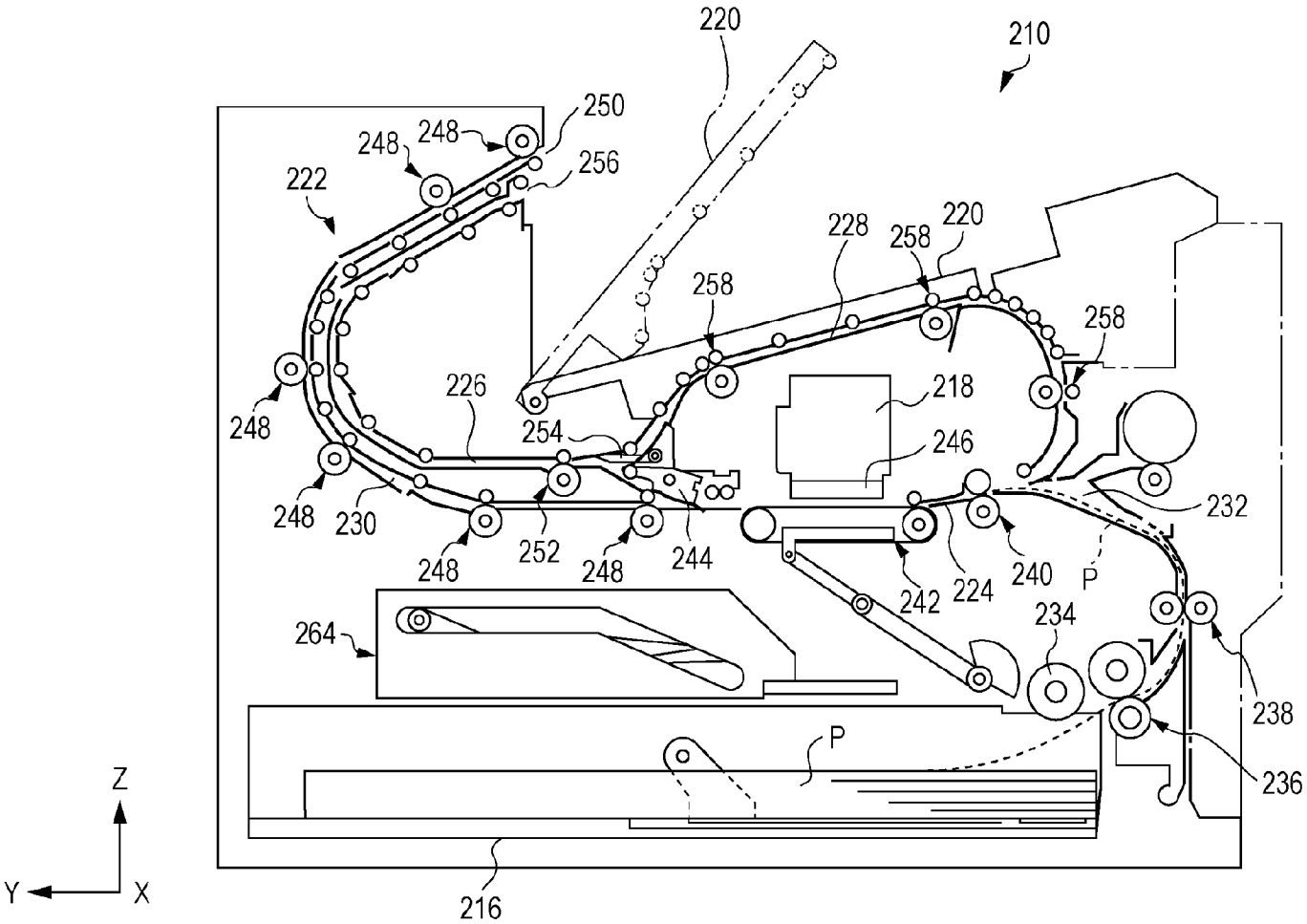
FIG. 32 is a side sectional view illustrating a first state of a paper sheet transport path of the recording apparatus according to example 6.
Figure 33:
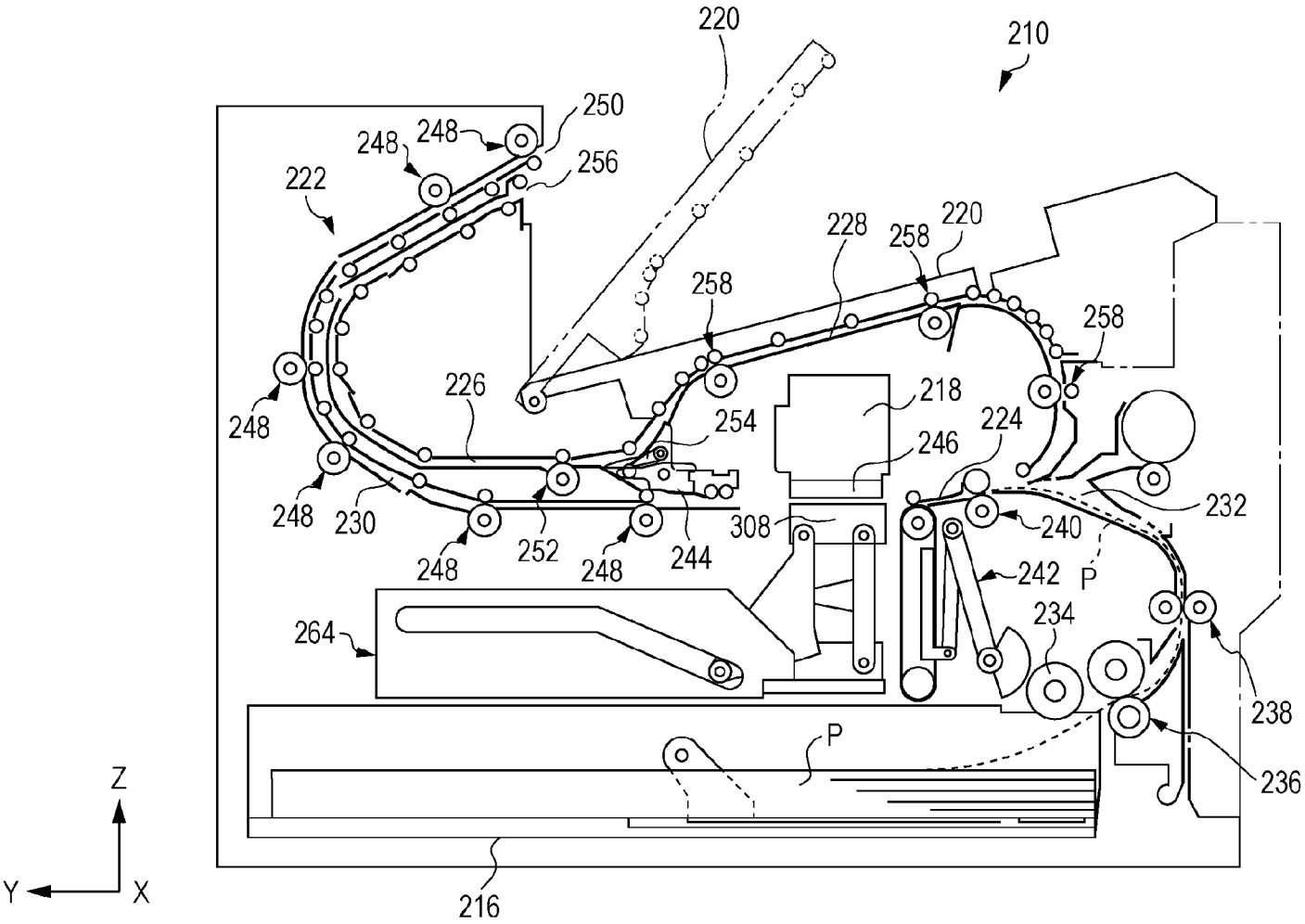
FIG. 33 is a side sectional view illustrating a second state of the paper sheet transport path of the recording apparatus according to example 6.
Figure 34:
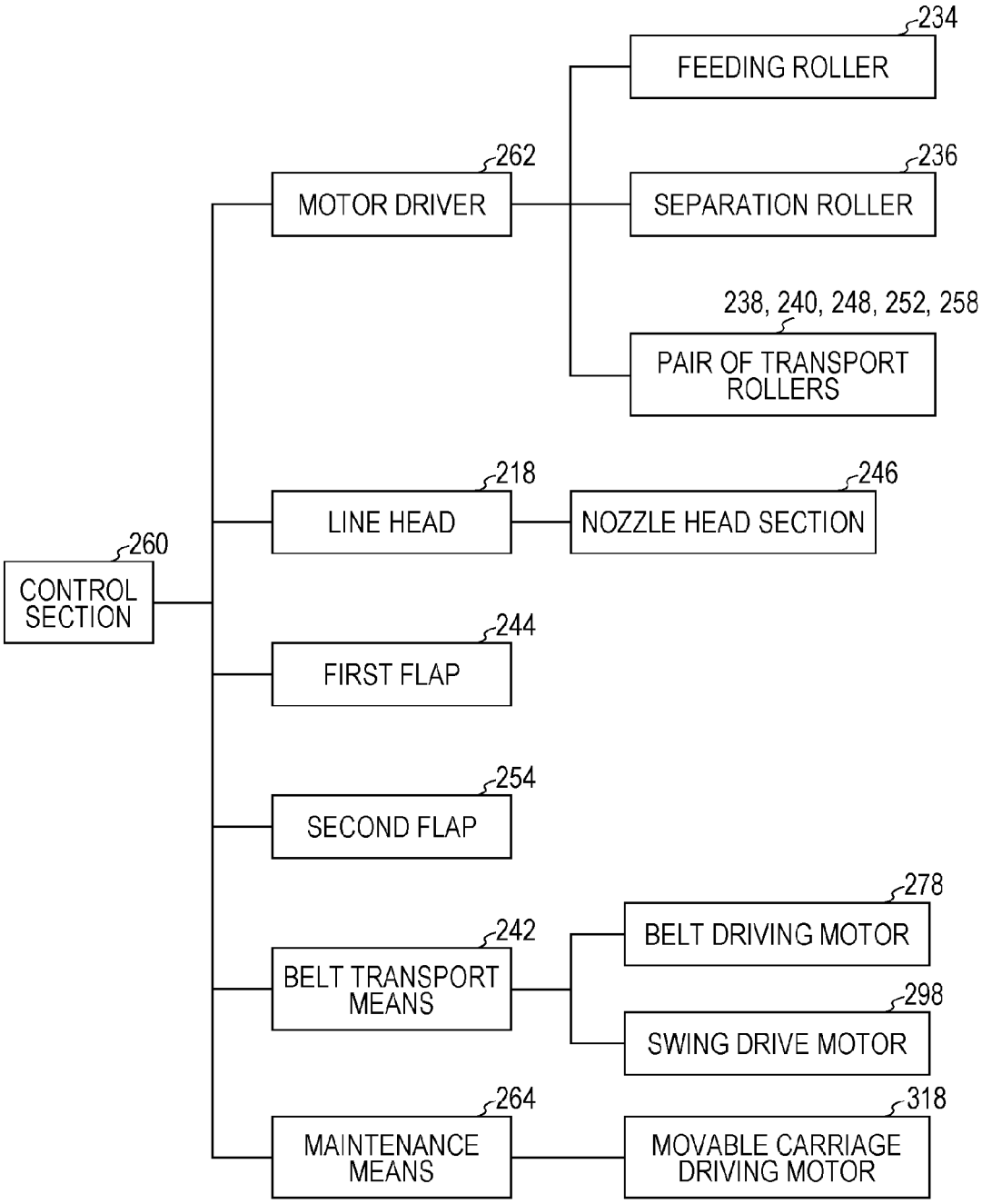
FIG. 34 is a block diagram illustrating a configuration of the recording apparatus according to example 6.
Figure 35:
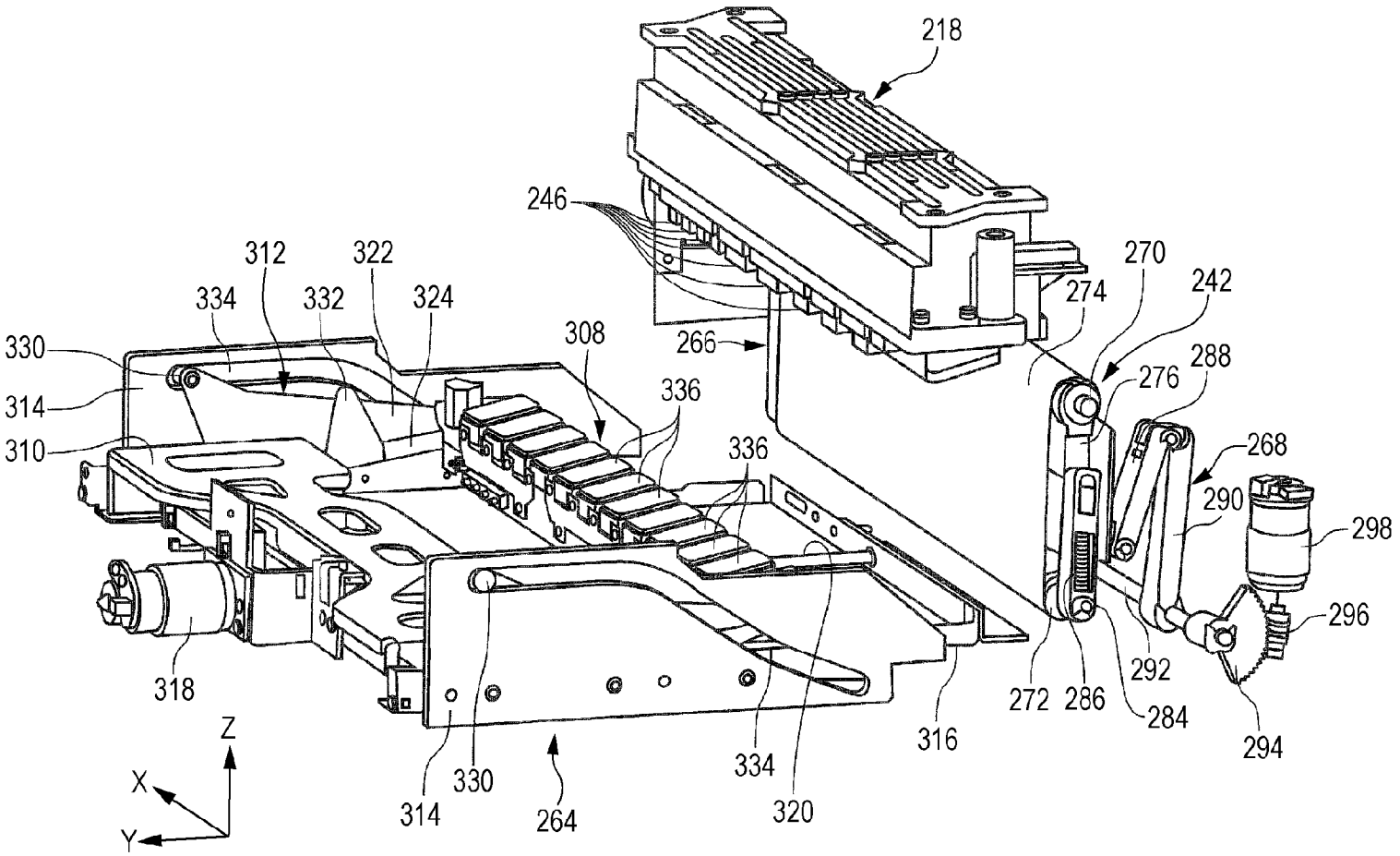
FIG. 35 is a perspective view illustrating the relationship between a line head, a belt transport section, and a maintenance section according to example 6.

FIG. 31 is an outer appearance perspective view of a printer according to example 6, FIG. 32 is a side sectional view illustrating a first state of a paper sheet transport path of the printer according to the invention, FIG. 33 is a side sectional view illustrating a second state of the paper sheet transport path of the printer according to the invention, FIG. 34 is block diagram illustrating a configuration of the printer according to the invention, and FIG. 35 is perspective view illustrating the relationship between a line head, a belt transport section, and a maintenance section according to the invention.

Figure 36:
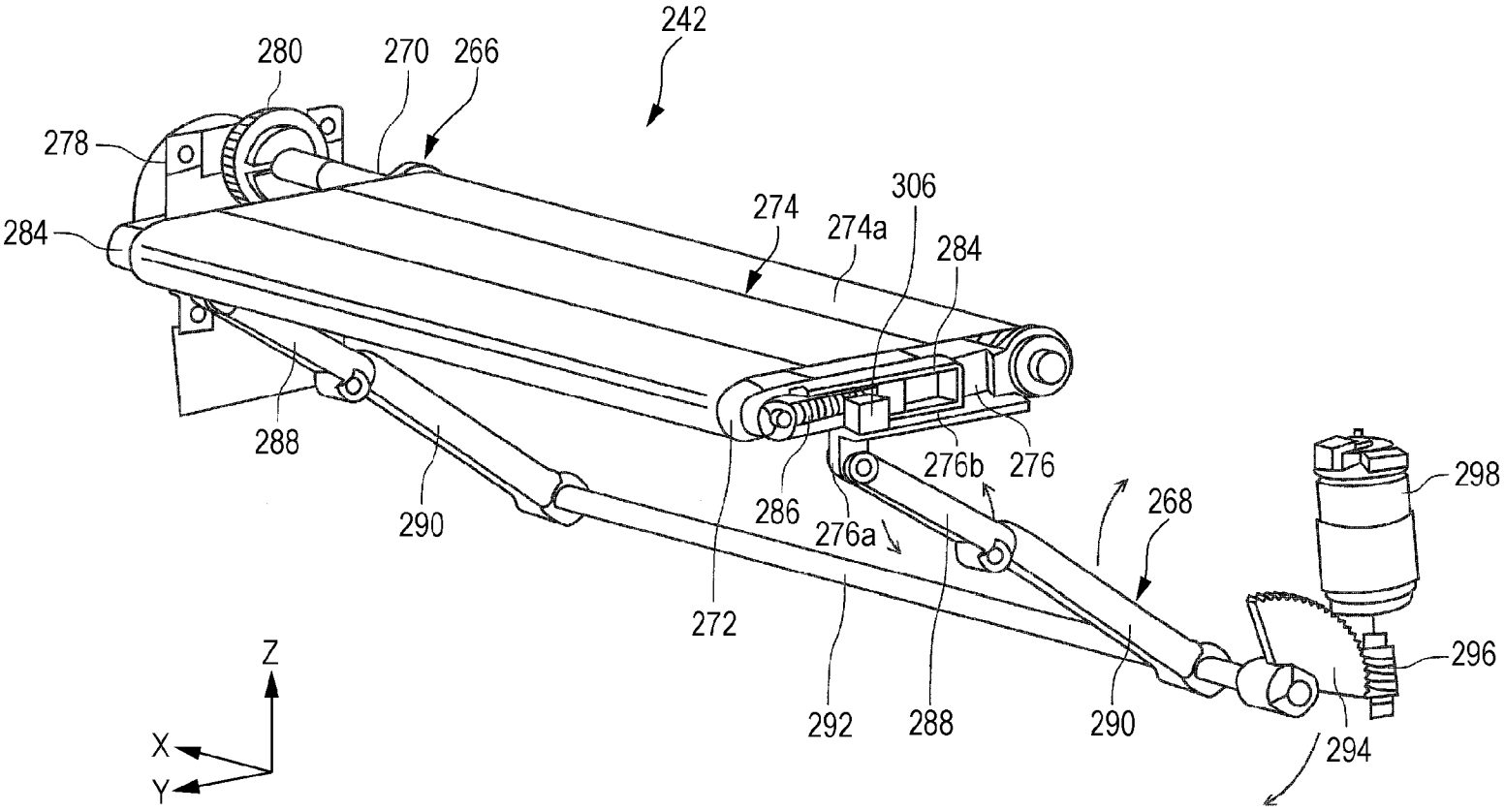
FIG. 36 is a perspective view illustrating a first state of the belt transport section according to example 6.
Figure 37:
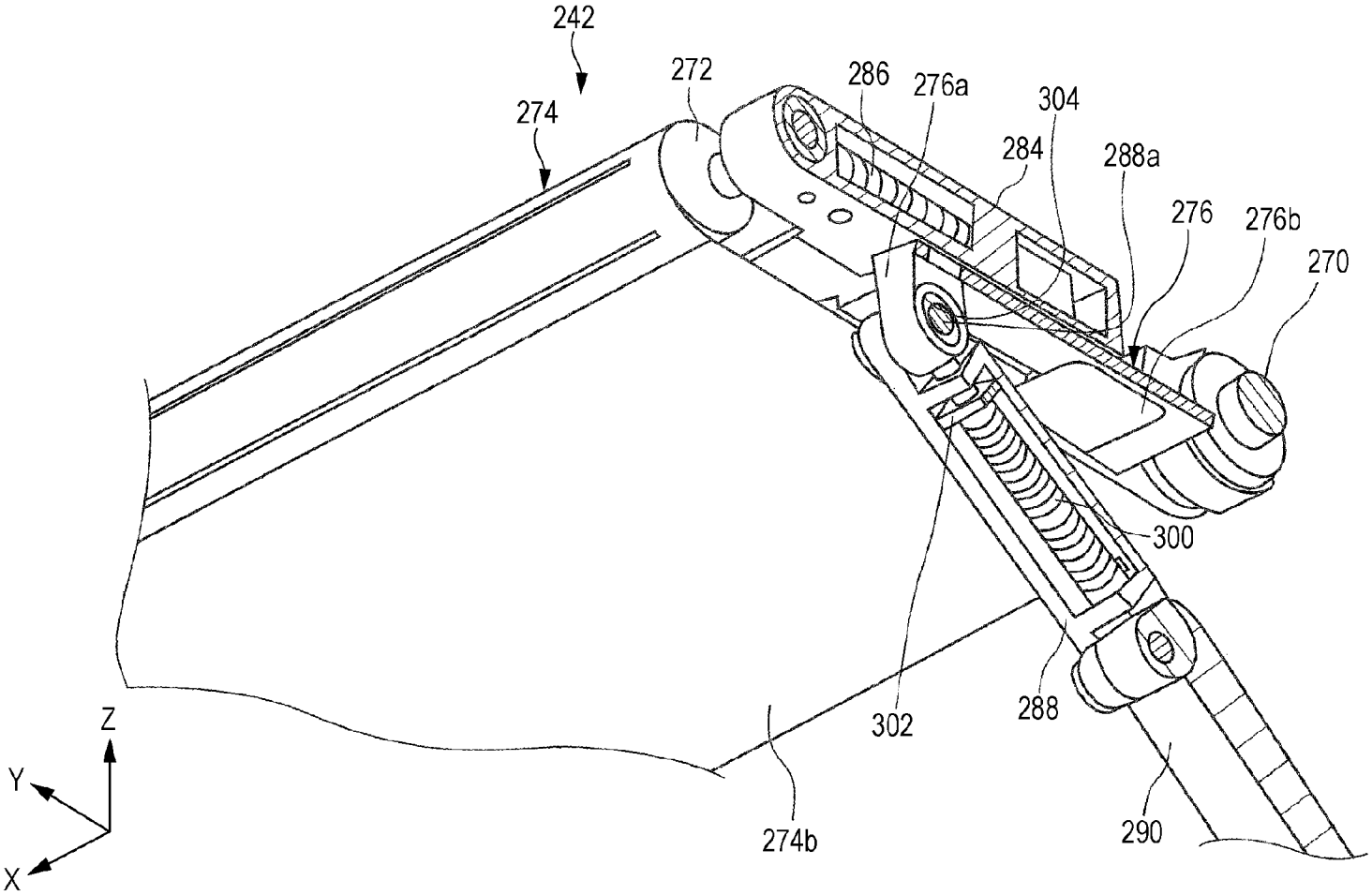
FIG. 37 is a partial sectional view of a structure of an arm section which displaces the belt transport section in the belt transport section according to example 6.
Figure 38:
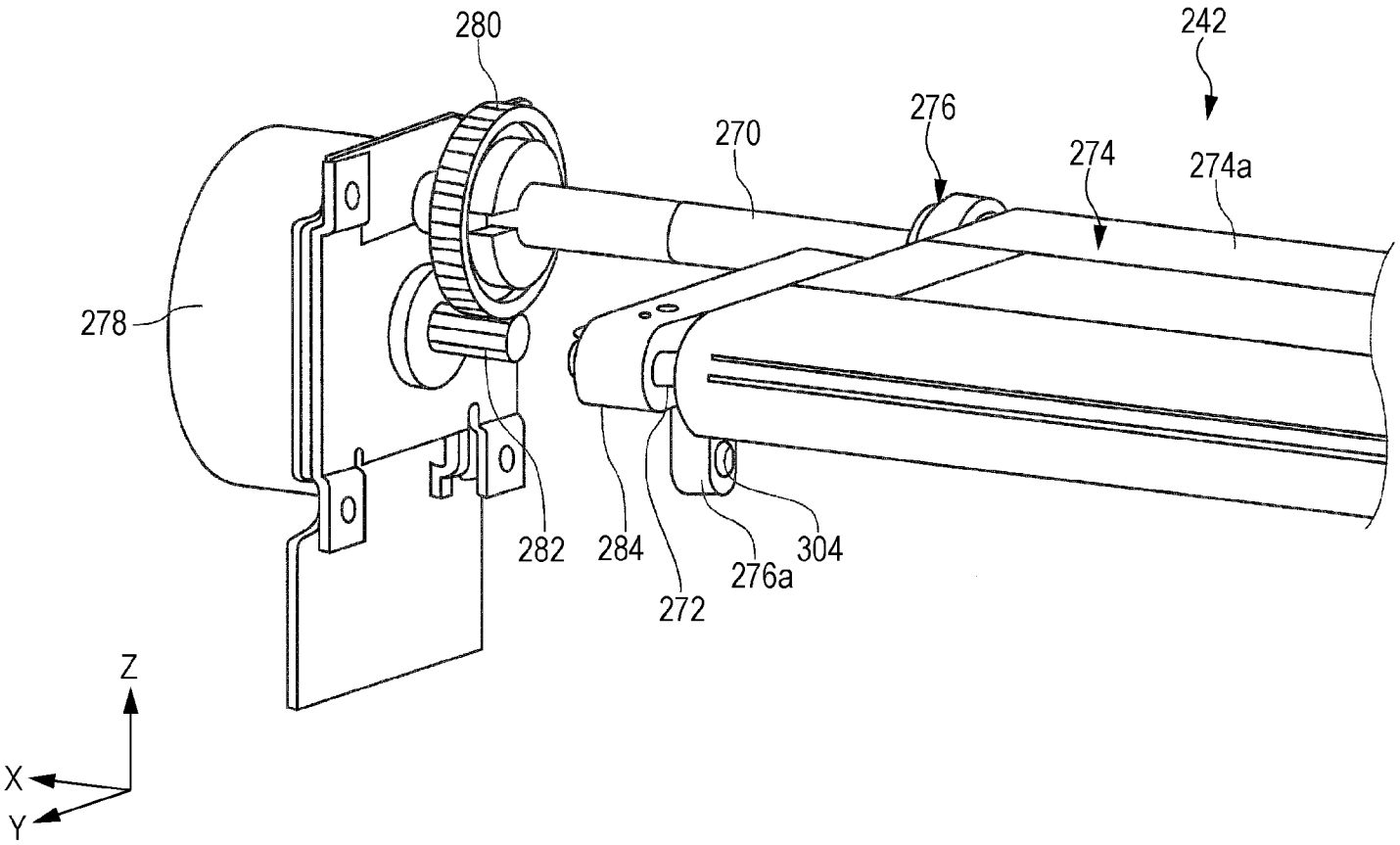
FIG. 38 is a perspective view illustrating a driving section in the belt transport section according to example 6.
Figure 39:
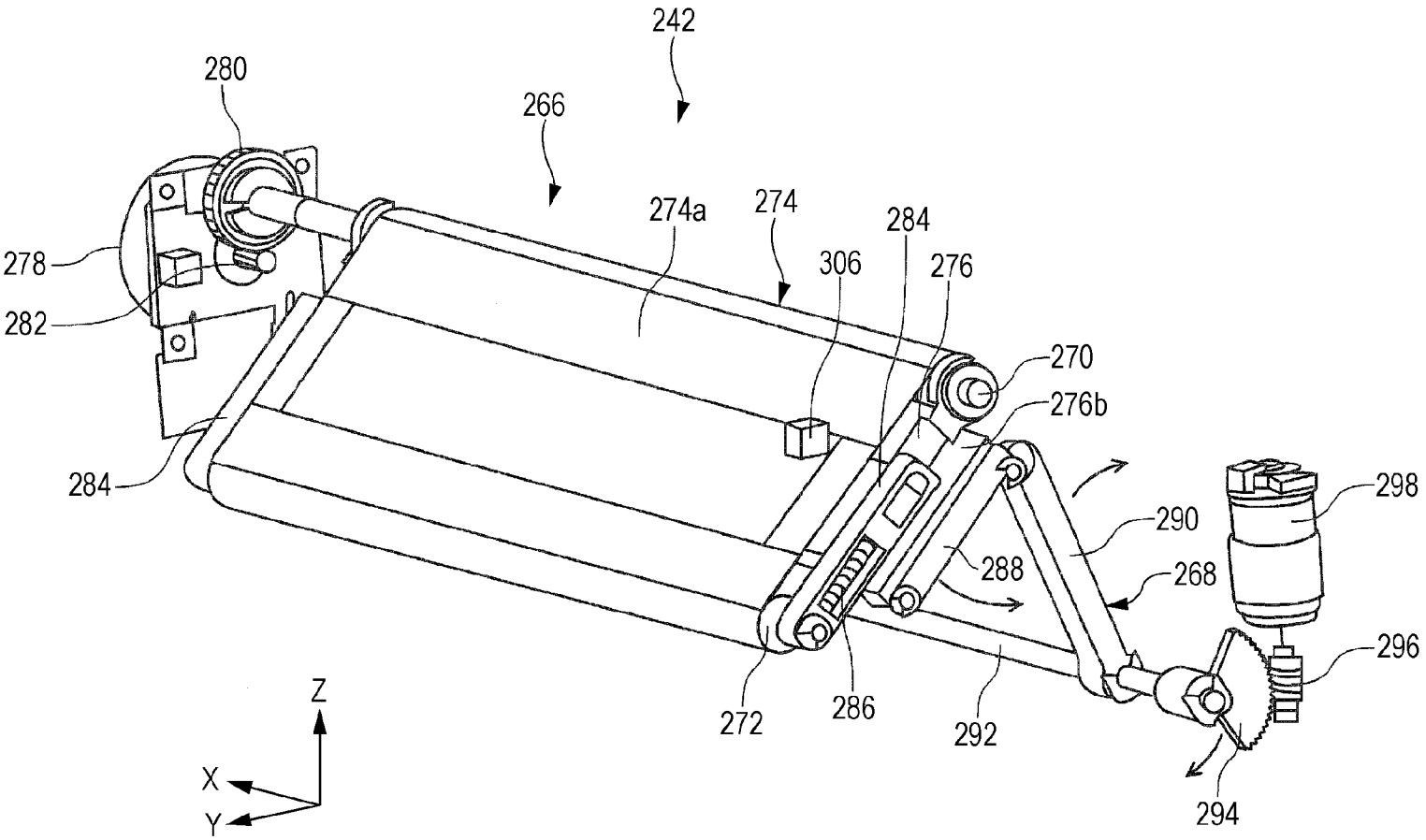
FIG. 39 is a perspective view illustrating a second state of the belt transport section according to example 6.
Figure 40:
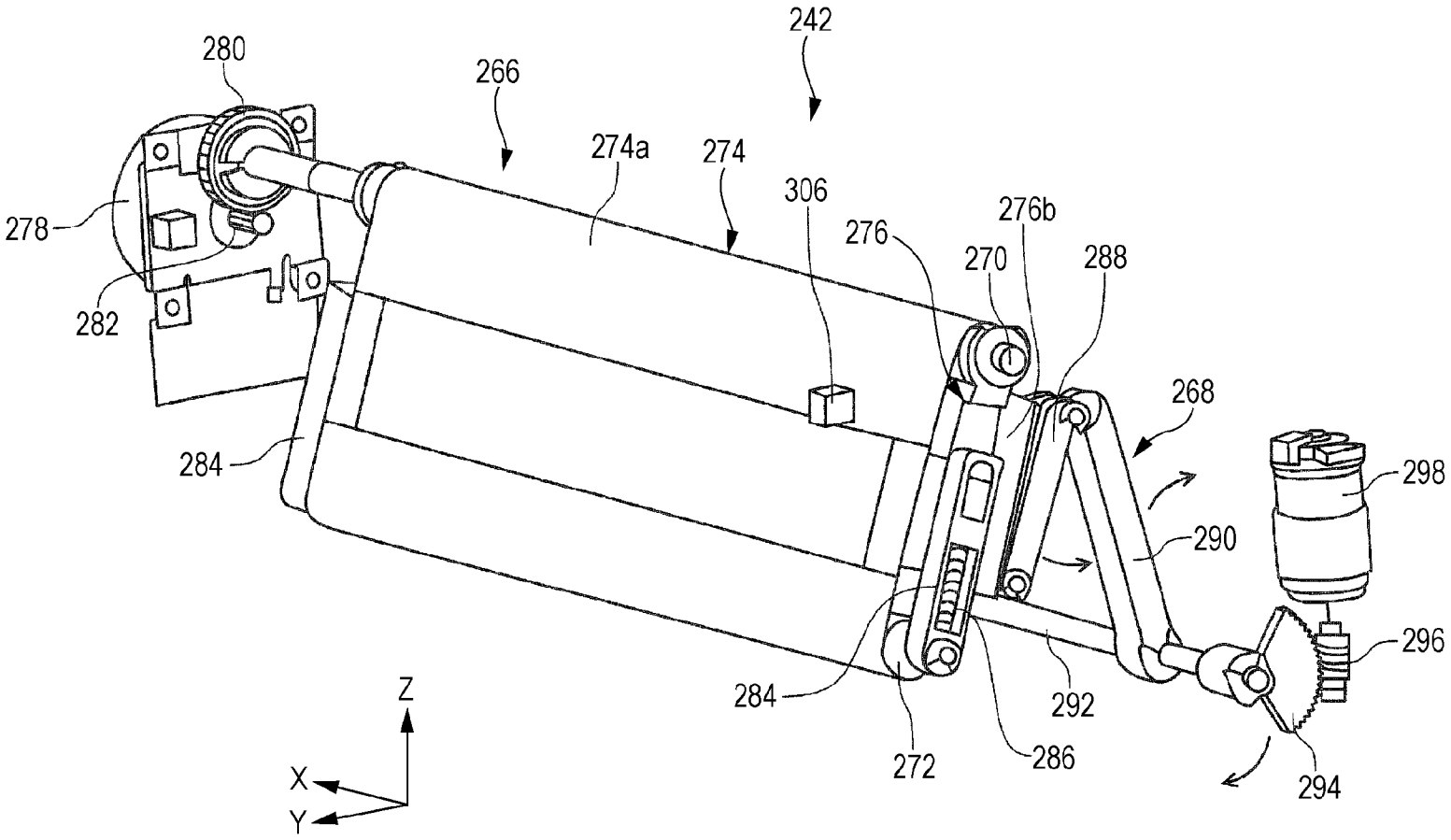
FIG. 40 is a perspective view illustrating a third state of the belt transport section according to example 6.

FIG. 36 is a perspective view illustrating a first state of the belt transport section according to the invention, FIG. 37 is a partial sectional view of a structure of an arm section which displaces the belt transport section in the belt transport section according to the invention, FIG. 38 is a perspective view illustrating a driving section in the belt transport section, FIG. 39 is a perspective view illustrating a second state of the belt transport section according to the invention, and FIG. 40 is a perspective view illustrating a third state of the belt transport section according to the invention.

Figure 41:
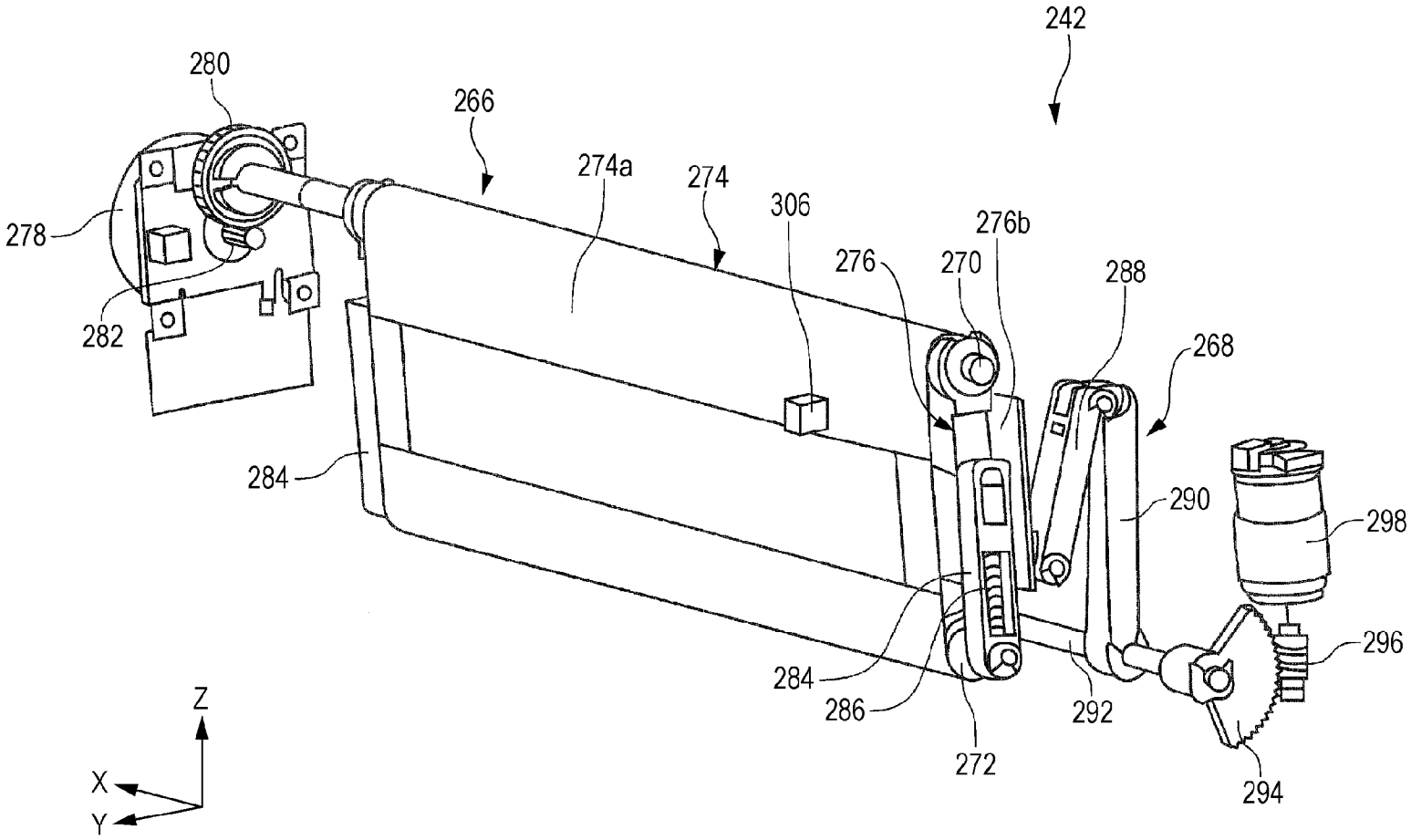
FIG. 41 is a perspective view illustrating a fourth state of the belt transport section according to example 6.
Figure 42:
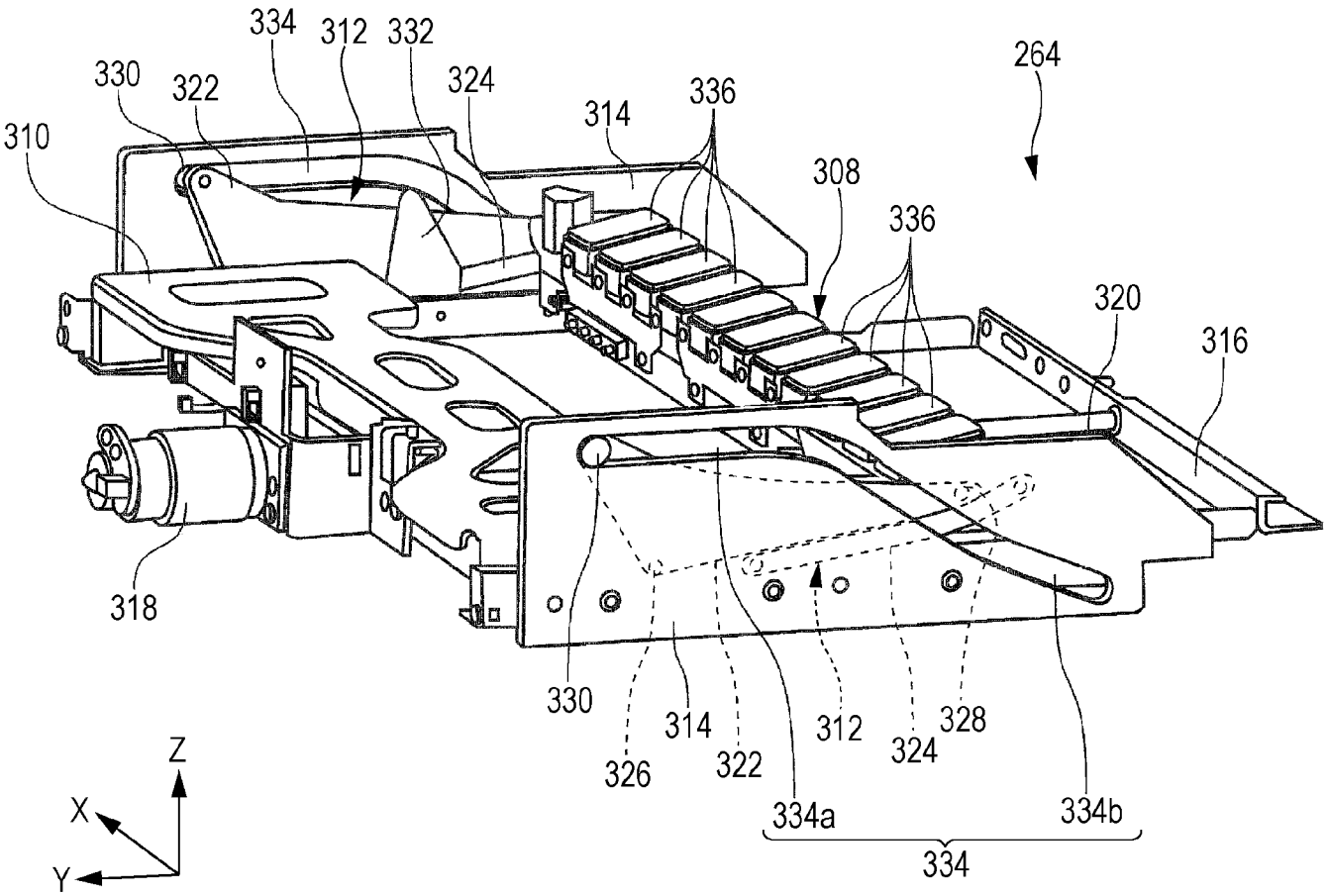
FIG. 42 is a perspective view illustrating a first state of the maintenance section according to example 6.
Figure 43:
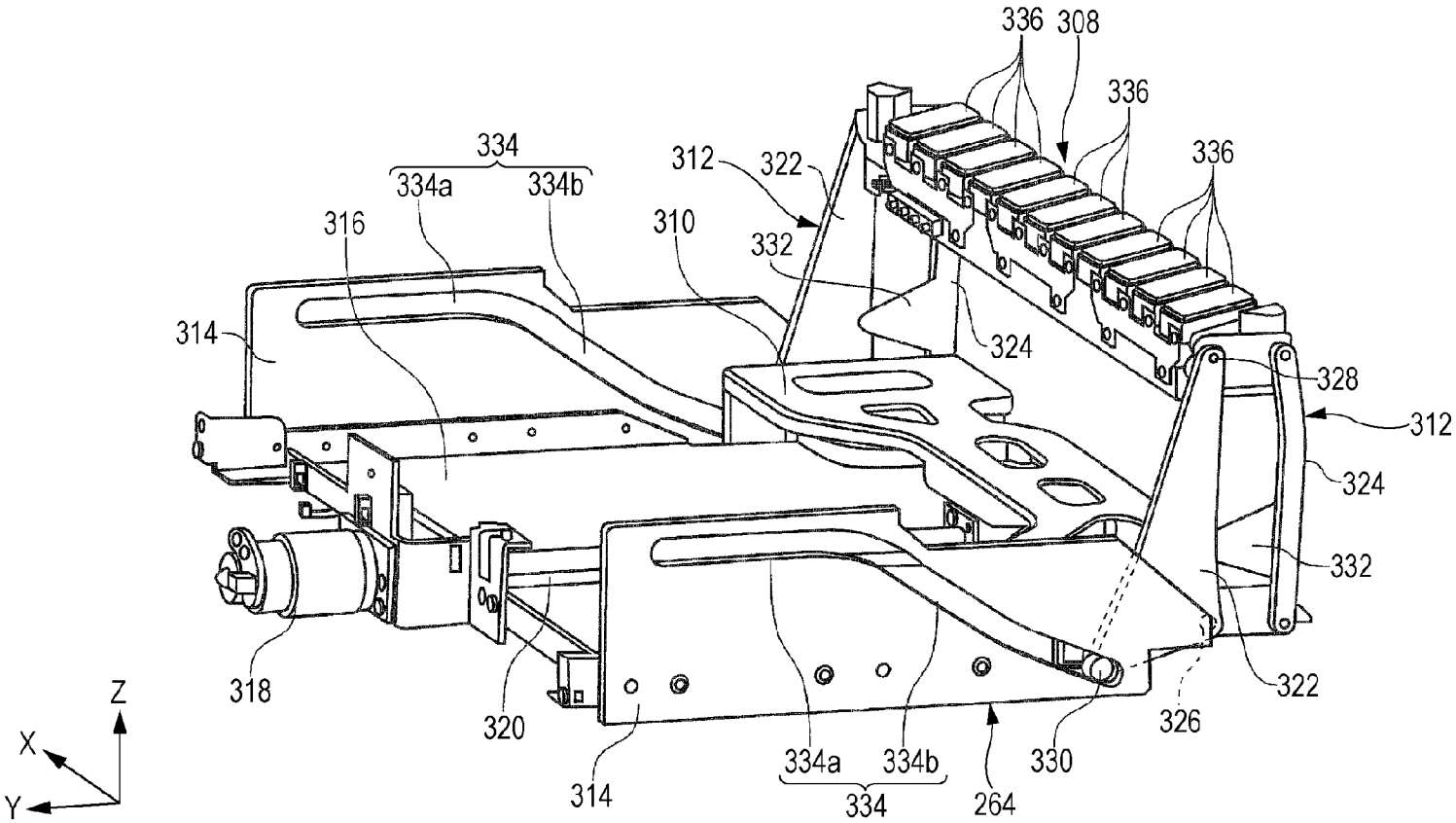
FIG. 43 is a perspective view illustrating a fourth state of the maintenance section according to example 6.
Figure 44:
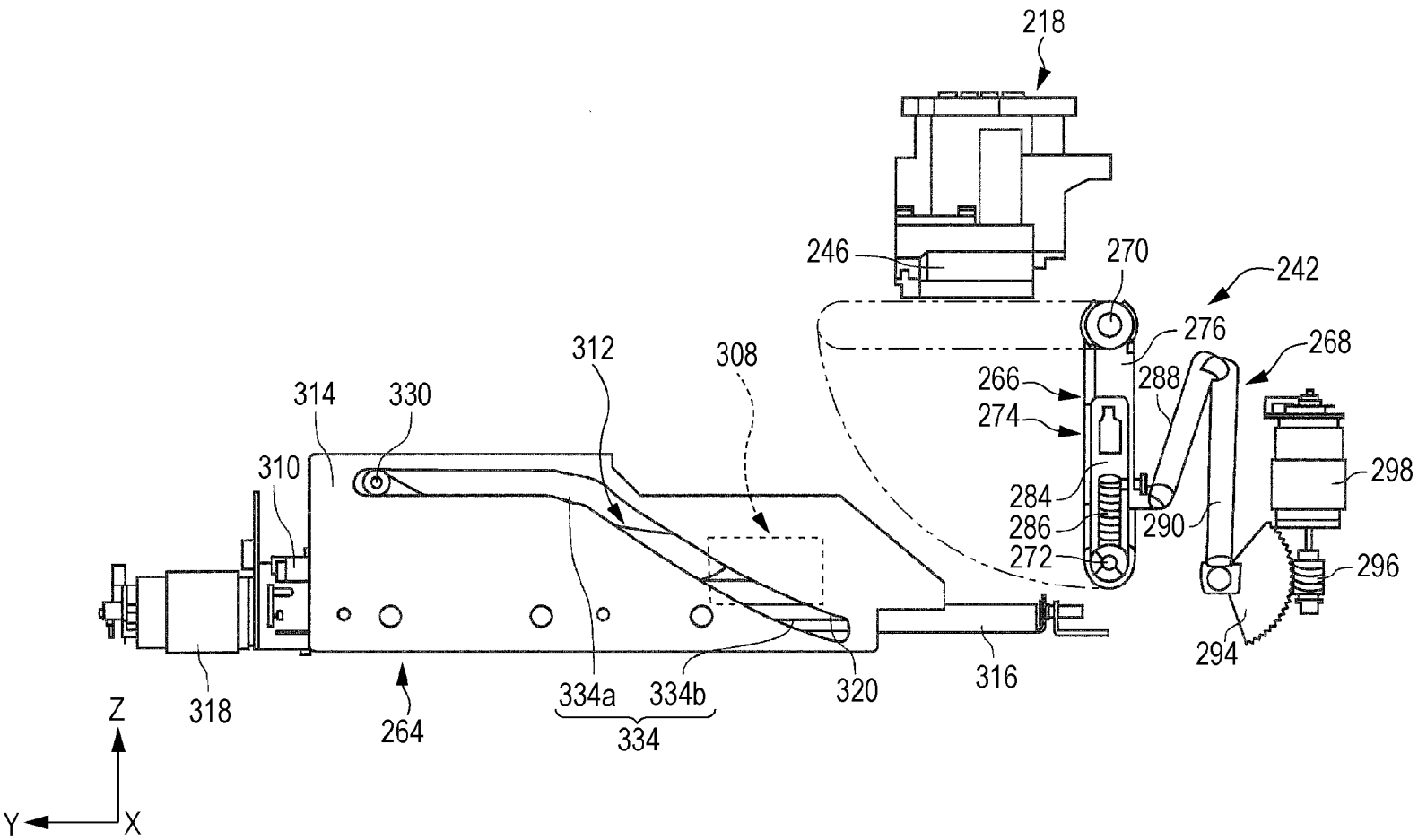
FIG. 44 is a side surface view illustrating the first state of the maintenance section according to example 6.
Figure 45:
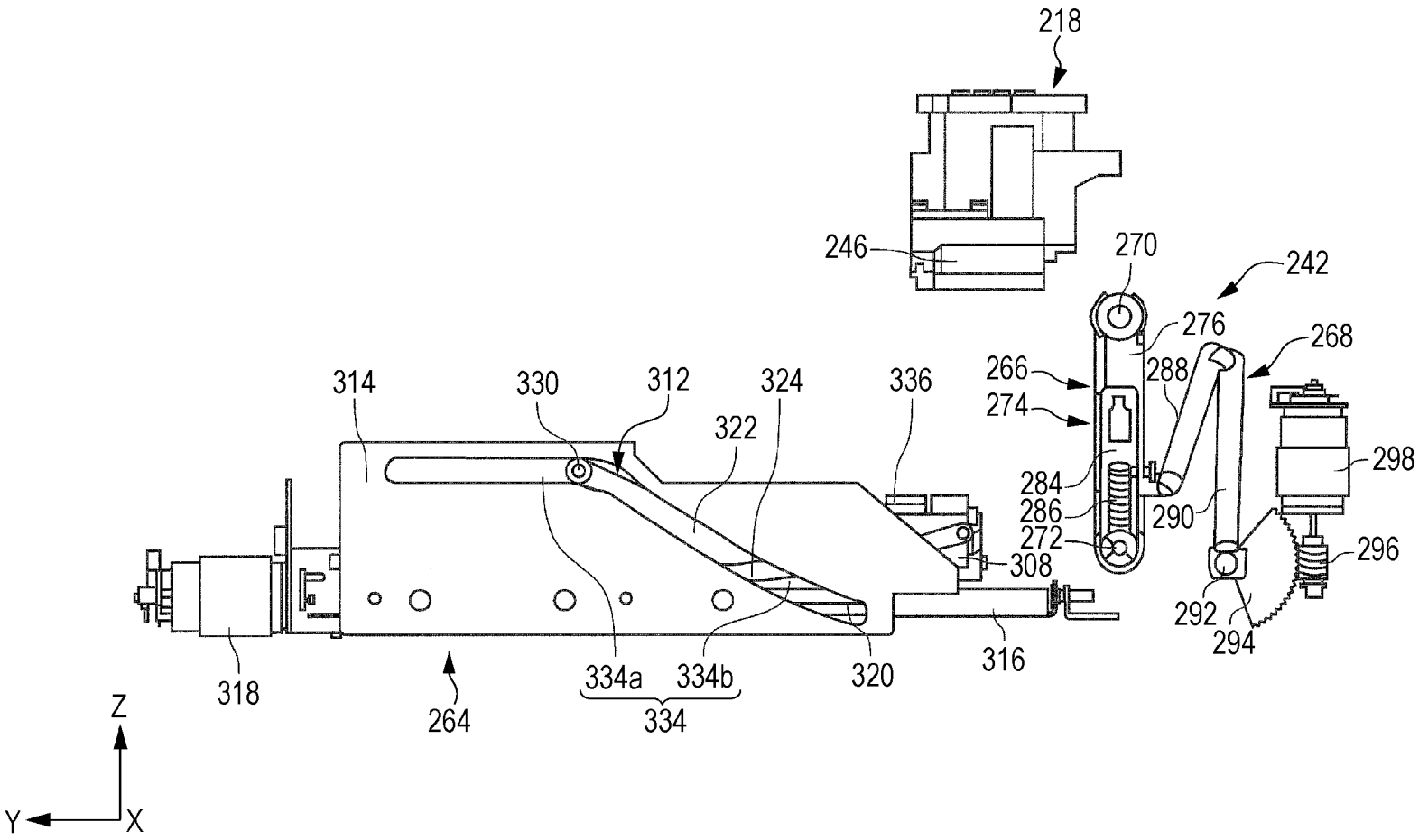
FIG. 45 is a side surface view illustrating a second state of the maintenance section according to example 6.

FIG. 41 is a perspective view illustrating a fourth state of the belt transport section according to the invention, FIG. 42 is a perspective view illustrating a first state of the maintenance section according to the invention, FIG. 43 is a perspective view illustrating a fourth state of the maintenance section according to the invention, FIG. 44 is a side surface view illustrating the first state of the maintenance section according to the invention, and FIG. 45 is a side surface view illustrating a second state of the maintenance section according to the invention.

Figure 46:
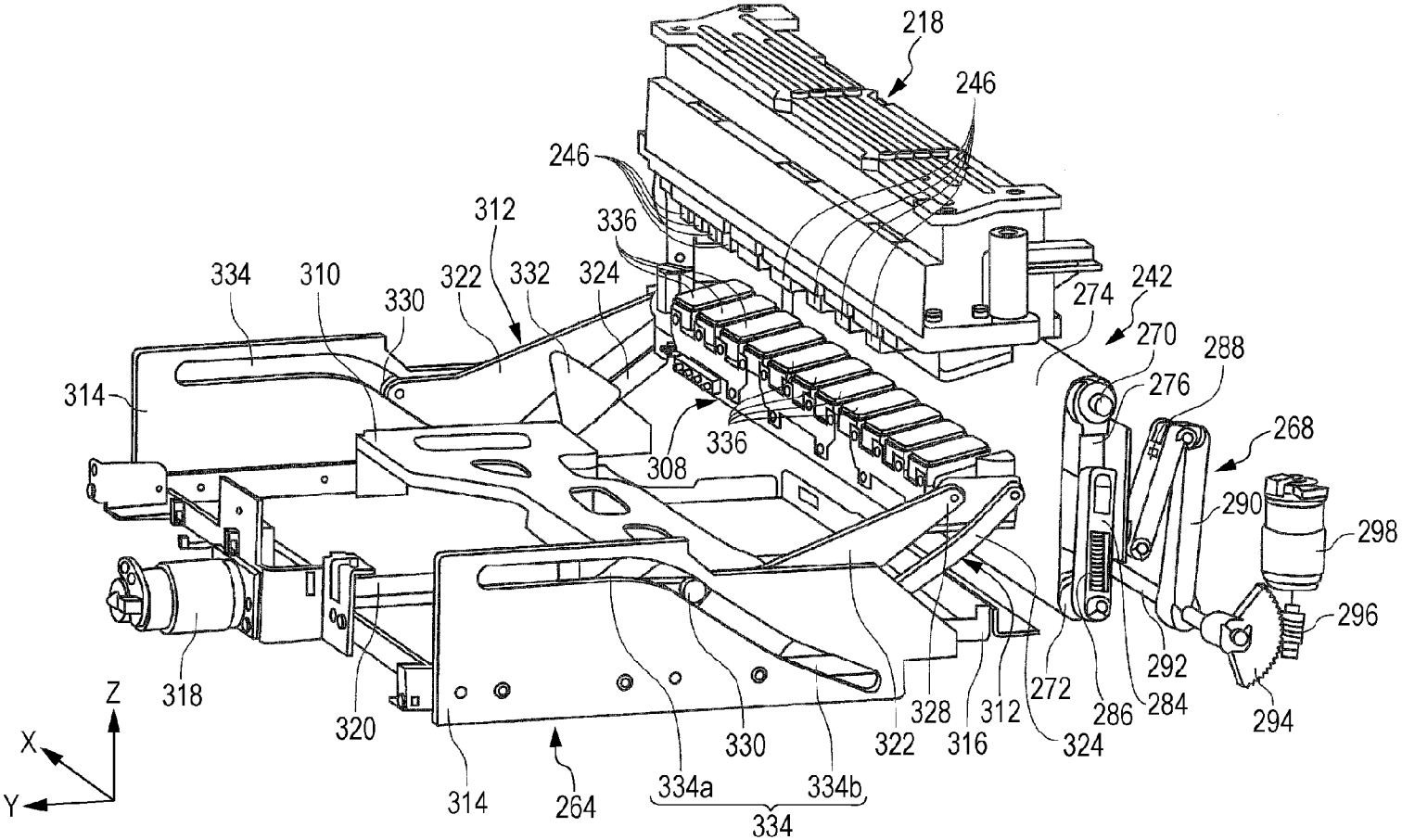
FIG. 46 is a perspective view illustrating a third state of the maintenance section according to example 6.
Figure 47:
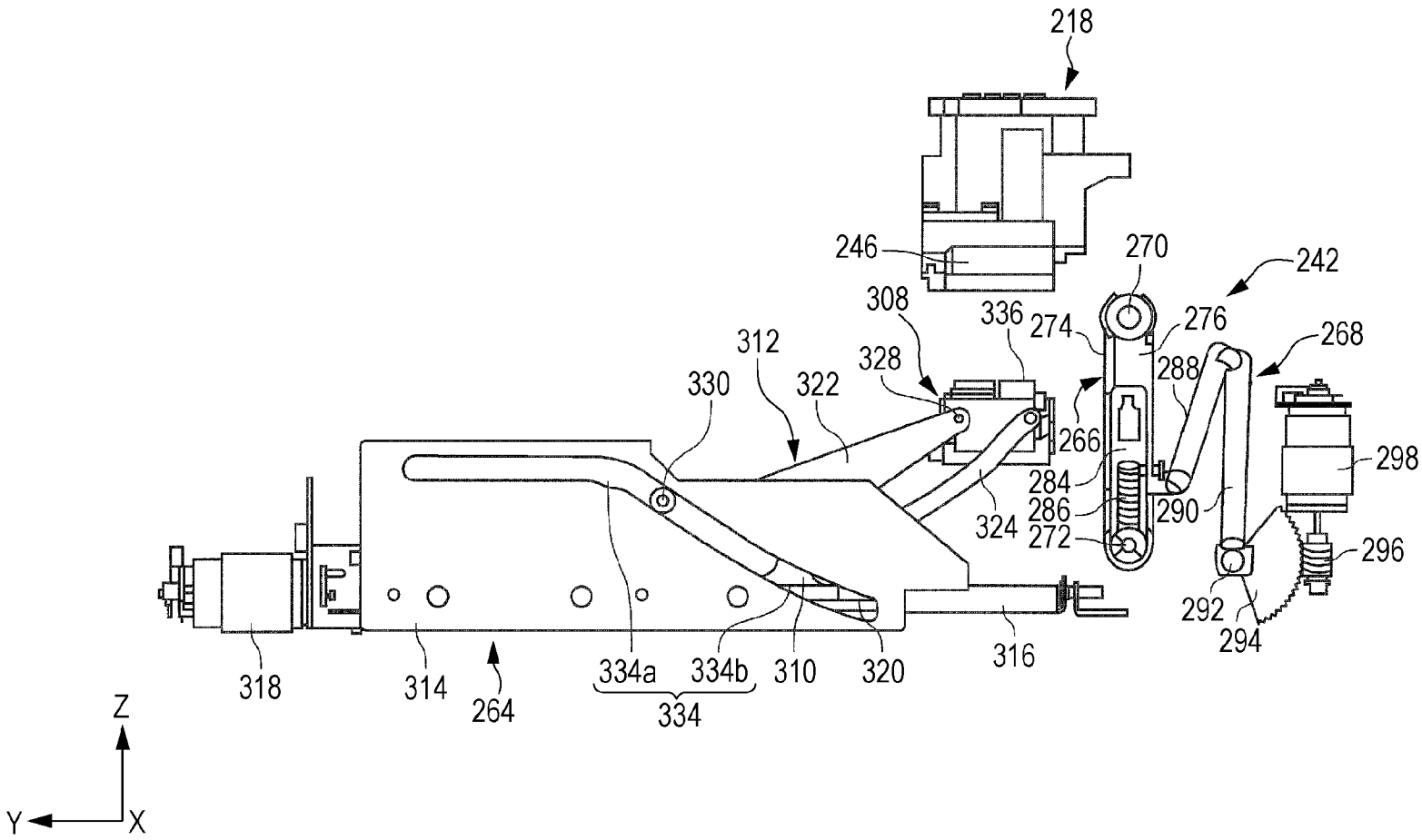
FIG. 47 is a side surface view illustrating the third state of the maintenance section according to example 6.
Figure 48:
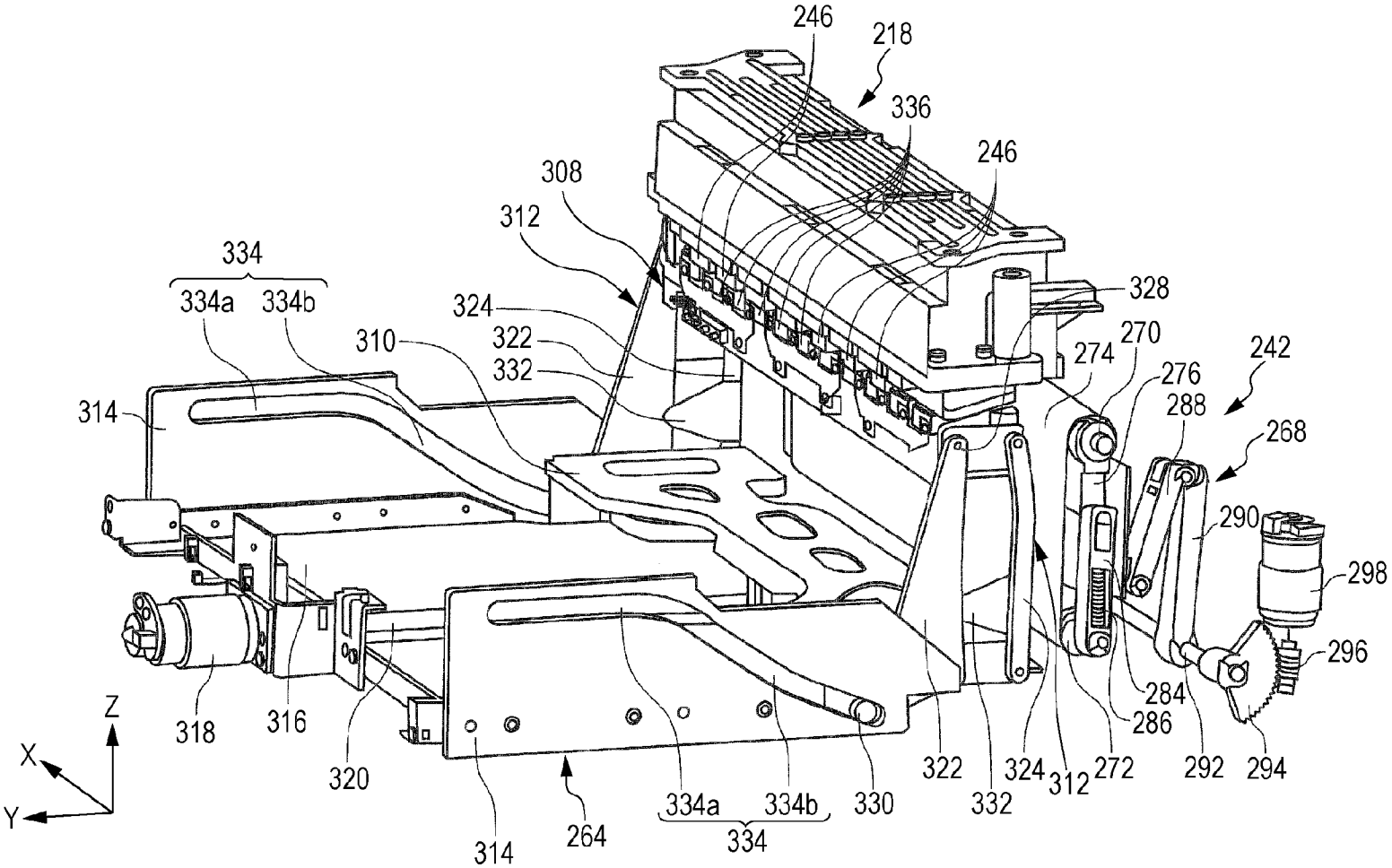
FIG. 48 is a perspective view illustrating a state in which the maintenance unit is adhered to the line head in the maintenance section according to example 6.
Figure 49:
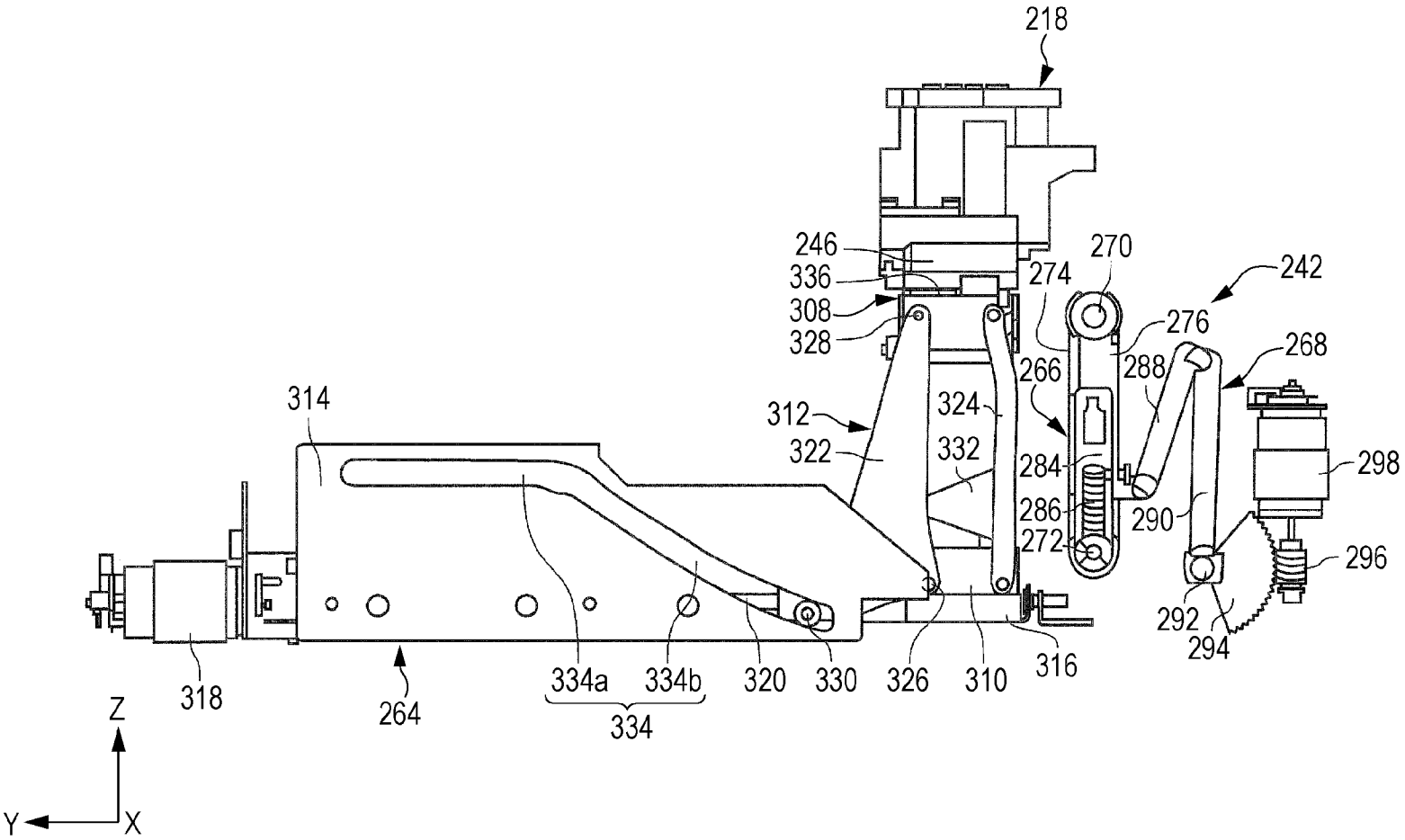
FIG. 49 is a side surface view illustrating a state in which the maintenance unit is adhered to the line head in the maintenance section according to example 6.
Figure 50:
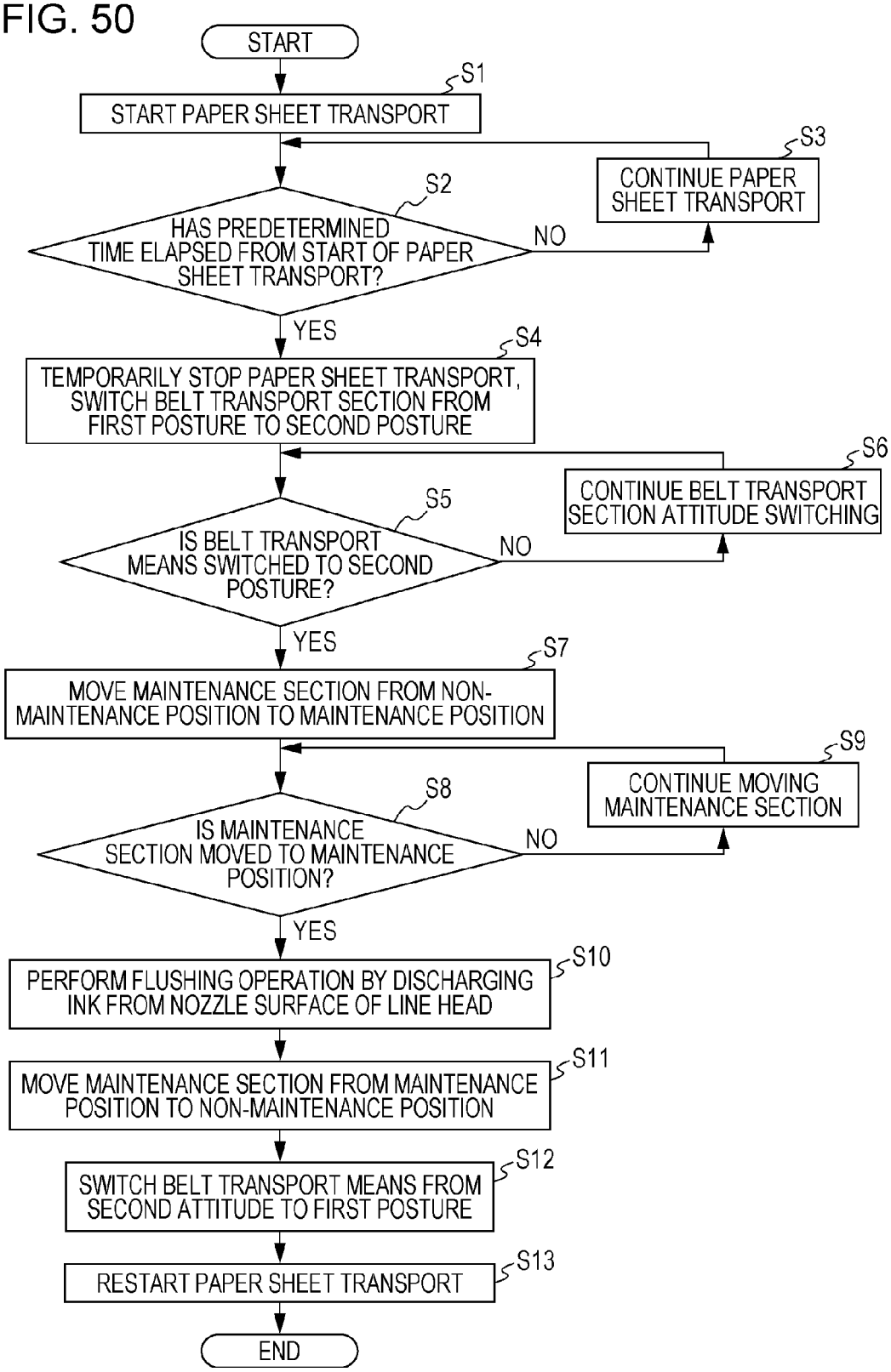
FIG. 50 is a flow chart of a maintenance operation in the belt transport section and the maintenance section according to example 6.

FIG. 46 is a perspective view illustrating a third state of the maintenance section according to the invention, FIG. 47 is a side surface view illustrating the third state of the maintenance section according to the invention, FIG. 48 is a perspective view illustrating a state in which the maintenance unit is adhered to the line head in the maintenance section according to the invention, FIG. 49 is a side surface view illustrating a state in which the maintenance unit is adhered to the line head in the maintenance section according to the invention, and FIG. 50 is a flow chart of a maintenance operation in the belt transport section and the maintenance section according to the invention.

In addition, in the X-Y-Z coordinate system illustrated in each of the drawings, the X direction (apparatus width direction) is the entire width direction of the paper sheet, the Y direction is the transport direction of the paper sheet, and the Z direction is a direction in which a distance (gap) between the recording head and the paper sheet is changed, that is, the apparatus height direction. Here, in each of the drawings, the −X direction is set as the apparatus front surface side, and the +X direction is set as the apparatus back surface side.

Summary of Printer

An ink jet printer 210 (hereinafter referred to as "printer 210") will be described as an example of the recording apparatus with reference to FIG. 31. The printer 210 is configured a multifunction machine which is provided with the apparatus main body 212 and a scanner unit 214. The apparatus main body 212 is provided with a plurality of paper sheet accommodating cassettes 216 (medium accommodating sections) which accommodate paper sheets P (refer to FIG. 32) as the "recording medium". Each paper sheet accommodating cassette 216 is attached so as to be detachable from the front surface side of the apparatus main body 212 (the −X axis direction side in FIG. 31). Here, in the specification, as examples, paper sheets P refers to paper sheets such as regular paper, thick paper, and photo paper.

In addition, in the apparatus height direction (Z axis direction) in the apparatus main body 212, a paper sheet receiving tray 220, which receives the paper sheet P on which recording is executed in a line head 218 which will be described later, is provided between the scanner unit 214 and the paper sheet accommodating cassette 216.

Paper Sheet Transport Path

Next, a transport path of the paper sheets P in the printer 210 will be described with reference to FIG. 32 and FIG. 33. Here, in FIG. 32 and FIG. 33, reference numerals are given only to main components of the transport path of the paper sheet P, and reference numerals are omitted for other components, in particular a plurality of spurs which are provided.

The printer 210 in the example is provided with a paper sheet transport path 222. The paper sheet transport path 222 is configured from a straight path 224, a switch-back path 226, an inversion path 228, a face-down discharge path 230, and a feed path 232 which is connects from the paper sheet accommodating cassette 216 to the straight path 224.

A feeding roller 234, a pair of separation rollers 236, and a pair of transport rollers 238 are provided in the feed path 232 in that order along the transport direction of the paper sheet P. The feeding roller 234 is rotatably driven by a driving motor which is not shown in the drawings. The pair of separation rollers 236 perform separation of the paper sheets P by nipping the paper sheets P. In the pair of transport rollers 238, one roller is configured as a driving roller which is driven so as to rotate by a driving motor which is not shown, and the other roller is configured as a driven roller.

Here, in the description below, out of each of the pair of transport rollers which appear in the specification, the one roller is configured as a driving roller which is driven so as to rotate by a driving motor which is not shown, and the other roller is configured as a driven roller.

The paper sheet P which is accommodated in the paper sheet accommodating cassette 216 is fed to the downstream side of the feed path 232 by the feeding roller 234. The paper sheet P which is fed from the feeding roller 234 toward the downstream side of the feed path 232 is nipped by the pair of separation rollers 236 and the pair of transport rollers 238 in that order. In addition, a pair of transport rollers 240 are provided on the downstream side in the transport direction of the pair of transport rollers 238.

In the example, the feed path 232 and the straight path 224 are connected at a position of the pair of transport rollers 240. That is, the feeding roller 232 is set as the path from the paper sheet accommodating cassette 216 to the pair of transport rollers 240.

The straight path 224 is configured as a path which extends in a straight line. The pair of transport rollers 240, the belt transport section 242 as a "support unit (support section)", the line head 218 as a "recording head", and a first flap 244 are provided in that order along the transport direction on the straight path 224. Here, in the example, the straight path 224 is set as a path from the pair of transport rollers 240 to the first flap 244. That is, the straight path 224 is through the line head 218, and is set as a path which extends to the upstream side and the downstream side of the line head 218.

The line head 218 is provided with a plurality of nozzle head sections 246. In the example, when the paper sheet P is transported to a region which faces the nozzle head sections 246, the line head 218 is configured so as to execute recording by discharging ink from a plurality of nozzles which are provided in the nozzle head sections 246 on the recording surface of the paper sheet P. In the example, the line head 218 is a recording head which is provided such that the nozzle, which, as one example, discharges ink, covers the entire width direction of the paper sheet, and is configured as a recording head which is able to record over the entire width of the paper sheet without accompanying movement in the paper sheet width direction.

In addition, the belt transport section 242 is disposed as the "support unit" in a region which faces the nozzle head section 246, that is, the line head 218. The belt transport section 242 transports the paper sheet P to the downstream side in the transport direction by belt driving. At this time, the belt transport section 242 supports the opposite side to the recording surface of the paper sheet P. Then, the recording surface of the paper sheet P which is supported by the belt transport section 242 faces the line head 218, and recording is performed on the recording surface of the paper sheet P by discharging ink from the nozzle head section 246. In addition, the belt transport section 242 specifies the distance (gap) between the recording surface of the paper sheet P and the head surface of the nozzle head section 246 by supporting the paper sheet P from below. Here, the belt transport section 242 will be described later in detail.

Next, the first flap 244 is positioned on the downstream side in the transport direction of the line head 218. The first flap 244 is configured so as to be swingable by the driving mechanism which is controlled by a control section 260 (refer to FIG. 34) that is provided inside the apparatus main body 212. The first flap 244 is configured so as to switchable between a posture in which the straight path 224 and the switch-back path 226 are connected (the state in FIG. 32), and a posture in which the straight path 224 and the face-down discharge path 230 are connected (the state in FIG. 33).

Here, in the example, the driving mechanism which drives the first flap 244 is configured by a solenoid. In addition, the posture switching operation of the first flap 244 is controlled by the control section 260 (refer to FIG. 34).

In a case where the first flap 244 has the posture in which the straight path 224 and the face-down discharge path 230 are connected (refer to FIG. 33), the paper sheet P is fed from the straight path 224 to the face-down discharge path 230 using the belt transport section 242.

The face-down discharge path 230 is inversely curved while extending from the straight path 224 to the upper side in the apparatus height direction. Then, a plurality of pairs of transport rollers 248 are provided in the face-down discharge path 230 at an appropriate gap in the transport direction.

The face-down discharge path 230 is set as a path from the first flap 244 to an outlet 250 which is positioned on the downstream side in the transport direction of the pair of transport rollers 248 that are positioned on the furthermost downstream side in the transport direction. That is, the face-down discharge path 230 is a transport path which is connected to the straight path 224, and is a path on which the paper sheet P is curved, inversed, and discharged through the line head 218.

The paper sheet P, on which recording is executed on the recording surface using the line head 218, is transported by being nipped in order by the pairs of transport rollers 248 which are positioned in order along the transport direction from the first flap 244 on the face-down discharge path 230. Then, the paper sheet P is discharged from the outlet 250 toward the paper sheet receiving tray 220.

Here, when the paper sheet P is transported on the face-down discharge path 230, the recording surface which is recorded on by the last line head 218 is transported with an upward orientation, next the recording surface is transported by being curved toward the inside of a curved portion on the face-down discharge path 230, and then the recording surface is discharged from the outlet 250 toward the paper sheet receiving tray 220 in a downward orientation.

Paper Sheet Transport Path in Two-Sided Recording

In a case where the first flap 244 has the posture in which the straight path 224 and the switch-back path 226 are connected (refer to FIG. 32), the paper sheet P is fed from the straight path 224 to the switch-back path 226 using the belt transport section 242.

In a case where recording is executed on a second surface after recording on the first surface on the paper sheet P, that is, in a case where two-sided recording is executed, the switch-back path 226 and the inversion path 228 are paths along which the paper sheet P passes. Here, in the same manner as in the case where recording is performed on the second surface although recording is not performed on the first surface, the paper sheet P passes along the switch-back path 226 and the inversion path 228. That is, in the specification, two sided-recording has the meaning of performing recording on the second surface by inverting the paper sheet P regardless of whether recording is performed on the first surface.

The switch-back path 226 is positioned inside the face-down discharge path 230 by inversely curving in the upward orientation in the apparatus height direction, and extends along the face-down discharge path 230. Then, the switch-back path 226 is provided with a pair of transport rollers 252.

In addition, in the example, the switch-back path 226 is set as a path from the second flap 254 which is provided above the first flap 244 to an opening 256 which is provided at the leading end of the switch-back path 226. When the switch-back path 226 is connected to the straight path 224 by the first flap 244 (refer to FIG. 32), the paper sheet P is fed through the belt transport section 242 from a region which faces the line head 218 to the switch-back path 226 via the first flap 244. The paper sheet P is fed to a position at which a rear end portion is nipped by the pair of transport rollers 252 in the transport direction on the switch-back path 226.

Here, a second flap 254 will be described. The second flap 254 is provided above the first flap 244 in the apparatus height direction (Z axis direction). Then, the second flap 254 is caused to swing by an interlocking mechanism which is not shown in the drawings, in conjunction with the operation of the first flap 244. That is, the second flap 254 is controlled by the control section 260 via the first flap 244 and the interlocking mechanism.

The second flap 254 has a posture in which connection of the switch-back path 226 and the inversion path 228 is blocked in a state in which the first flap 244 connects the straight path 224 and the switch-back path 226 (refer to FIG. 32). Meanwhile, the second flap 254 has a posture in which the switch-back path 226 and the inversion path 228 are connected (refer to FIG. 33) in a state in which the first flap 244 connects the straight path 224 and the face-down discharge path 230 (refer to FIG. 33). Here in FIG. 33, for illustration, the belt transport section 242 is illustrated in a posture of being separated from the nozzle head section 246, but the posture in which the belt transport section 242 faces the nozzle head section 246 is maintained during transport of the paper sheet P.

When the second flap 254 takes a posture in which the switch-back path 226 and the inversion path 228 are connected (refer to FIG. 33), the control section 260 rotates the pair of transport rollers 252 in the reverse direction to the direction in which the paper sheet P is fed on the switch-back path 226, the rear end side of the paper sheet P is set as the leading end side, and the paper sheet P is fed to the inversion path 228. That is, the paper sheet P is switched back.

The inversion path 228 is set as a path from the second flap 254 to the pair of transport rollers 240 of the straight path 224 through above the line head 218. A plurality of pairs of transport rollers 258 are provided on the inversion path 228 at an appropriate gap in the transport direction.

The outlet side of the inversion path 228 is configured so as to converge with the straight path 224 at an upstream position of the pair of transport rollers 240 on the straight path 224. Then, the paper sheet P is fed again on the straight path 224. That is, the inversion path 228 is a transport path which is connected to the switch-back path 226, is transported in the reverse direction, that is, the switched-back paper sheet P is inverted by detouring the upper side of the line head 218, and is set as a path on which the pair of transport rollers 240, which are positioned on the upstream side of the line head 218 in the straight path 224, is converged.

Then, when the paper sheet P is transported on the inversion path 228, the first surface and the second surface are inverted, and the paper sheet P is transported to a region which faces the line head 218 in the straight path 224, and recording is executed on the second surface. After this, the paper sheet P is discharged to the paper sheet receiving tray 220 through the face-down discharge path 230.

Control Section

The apparatus main body 212 is provided with the control section 260 (refer to FIG. 34) as an electrical circuit which is configured from a plurality of electronic components. The control section 260 controls the operations which are necessary for executing recording and image reading of the printer 210 such as feeding, transport, discharge, a recording operation, a document reading operation, a maintenance operation, and the like of the recording medium P in the scanner unit 214, the line head 218, the belt transport section 242, the first flap 244, the second flap 254, and a motor driver 262 and a maintenance section 264 which will be described later.

In addition, the control section 260 may control the operations which are necessary for executing recording and image reading of the printer 210 such as the document reading operation which is an instruction from the outside (PC or the like). In addition, the control section 260 controls discharge of ink which is in the nozzle head section 246 of the line head 218.

In addition, a plurality of motor drivers 262 which are controlled by the control section 260 are disposed inside the apparatus main body 212, and respectively control a plurality of driving motors which are not shown in the drawings, a belt driving motor 278 which will be described later, a swing drive motor 298, and a movable carriage driving motor 318. That is, in the example, the control section 260 controls driving of the feeding roller 234, the pair of separation rollers 236, and each pair of transport rollers 238, 240, 248, 252, and 258 via the motor driver 262 and the plurality of driving motors.

Summary of Belt Transport Section and Maintenance Section

Next, the line head 218, the belt transport section 242, and the maintenance section 264 will be described with reference to FIG. 32, FIG. 33, and FIG. 35. The belt transport section 242 and the maintenance section 264 are provided below the line head 218 in the apparatus height direction inside the apparatus main body 212.

The belt transport section 242 is configured so as to be switchable between a first posture (refer to FIG. 32) facing the nozzle head section 246 of the line head 218, and a second posture (refer to FIG. 33) which retreats from the position facing the nozzle head section 246. In addition, in the example, the maintenance section 264 is positioned on the downstream side in the transport direction of the belt transport section 242. Here, the maintenance section 264 will be described after the description of the belt transport section 242. Here, in FIG. 35, for illustration, only the configuration of the main sections of the line head 218, the belt transport section 242, and the maintenance section 264 are given reference numerals.

Belt Transport Section

The belt transport section 242 will be described with reference to FIG. 36 to FIG. 41. The belt transport section 242 is provided with a belt driving section 266 and a belt swinging section 268. First, the belt driving section 266 will be described. The belt driving section 266 is provided with a drive shaft 270 as a "first rotating body", a driven shaft 272 as a "second rotating body", a transport belt 274, and a swing base 276. In addition, the belt driving motor 278 is provided in the apparatus main body 212. A transmission gear 280 (refer to FIG. 38) is attached to one end portion of the drive shaft 270 so as to be rotatable with the drive shaft 270.

Then, the transmission gear 280 meshes with a drive gear 282 (refer to FIG. 38) which is attached to the drive shaft of the belt driving motor 278. That is, when the belt driving motor 278 is driven by the control section 260 so as to rotate, the drive shaft 270 is also driven so as to rotate via the drive gear 282 and the transmission gear 280. Here, in the example, the belt driving motor 278 is controlled by the control section 260.

In addition, with respect to the drive shaft 270, the driven shaft 272 is provided in a gap in a direction (the Y axis direction in FIG. 36) which intersects with the axis line direction (the X axis direction in FIG. 36) of the drive shaft 270. In the example, the drive shaft 270 is provided on the upstream side in the transport direction of the paper sheet P, and the driven shaft 272 is provided on the downstream side in the transport direction. Then, the transport belt 274 is rotatably attached between the drive shaft 270 and the driven shaft 272. Then, when the drive shaft 270 is driven so as to rotate, the transport belt 274 is also driven so as to rotate in the same direction as the rotation direction of the drive shaft 270.

In addition, in the example, the width of the transport belt 274 (the length in the X axis direction in FIG. 36) is set so as to be larger than the entire width of the paper sheet P. In addition, in the example, although not illustrated, beads are respectively attached across the entire circumference of the transport belt 274 at both end portions in the width direction of the transport belt 274. In the example, the beads which are not illustrated, are for example, formed as a rubber member of urethane resin. The beads which are not illustrated prevent shifting of the transport belt 274 with respect to the drive shaft 270 and the driven shaft 272 in the axis line direction (paper sheet width direction) of the drive shaft 270 and the driven shaft 272. In addition, in the example, the transport belt 274 is, for example, configured as an electrostatic adhesive belt.

In addition, the swing base 276 is disposed between the drive shaft 270 and the driven shaft 272. The swing base 276 is positioned between an upper side path 274*a* and a lower side path 274*b* of the transport belt 274 in the apparatus height direction. The swing base 276 extends in the axis line direction of the drive shaft 270. In addition, both sides of the swing base 276 axially support the drive shaft 270 so as to be rotatable.

In addition, a tension adjustment member 284 (refer to FIG. 37) is provided at both end portions of the swing base 276. One end of the tension adjustment member 284 axially supports the driven shaft 272 so as to be rotatable. In addition, the other end of the tension adjustment member 284 is attached to the swing base 276 so as to be slidable in a direction in which the driven shaft 272 comes into contact with and separates from the drive shaft 270. In addition, a biasing member 286 is disposed between the swing base 276 and the tension adjustment member 284. In the example, the biasing member 286 is configured as a spring member, one end of the biasing member 286 is attached to the swing base 276, and the other end is attached to the tension adjustment member 284.

In the example, the tension adjustment member 284 presses the swing base 276 in a direction in which the driven shaft 272 separates from the drive shaft 270 due to the biasing force of the biasing member 286. Accordingly, the driven shaft 272 which is axially supported on the tension adjustment member 284 is biased by the biasing member 286 via the tension adjustment member 284 so as to be separated from the drive shaft 270. Thereby, the transport belt 274 receives the biasing force of the biasing member 286 in a direction in which the driven shaft 272 separates from the drive shaft 270, and on the transport belt 274, tension is generated in the direction in which the transport belt 274 stretches. As a result, it becomes difficult for deflection to occur on the upper side path 274*a* and a lower side path 274*b* of the transport belt 274.

Accordingly, as shown in FIG. 32 and FIG. 36, in the first posture in which the belt transport section 242 faces the nozzle head section 246 of the line head 218, the upper side path 274*a* of the transport belt 274 supports the side opposite the recording surface of the paper sheet P which is fed to a region that faces the line head 218. That is, the belt transport section 242 has a function as a medium support member which supports the paper sheet P in the first posture.

Next, the belt swinging section 268 will be described. The belt swinging section 268 is provided with a first arm 288, a second arm 290, a swing shaft 292, a swing gear 294, a swing drive gear 296, and a swing drive motor 298 as a "driving source". One end portion of the first arm 288 is attached so as to be swingable with respect to the swing base 276. In addition, the other end portion of the first arm 288 is attached so as to be swingable with respect to the one end portion of the second arm 290. In addition, the second arm 290 is attached to the swing shaft 292 so as to rotate along with the swing shaft 292.

In addition, the swing gear 294 is attached to the end portion of the swing shaft 292 so as to rotate along with the swing shaft 292. In addition, the swing drive gear 296 is attached to the drive shaft of the swing drive motor 298. In the example, the swing drive gear 296 is configured, for example, as a worm gear. Then, the swing gear 294 and the swing drive gear 296 mesh.

In addition, in reference to FIG. 37, a biasing member 300 and a pressing member 302 are provided in the first arm 288. One end portion of the biasing member 300 is attached to the first arm 288. The other end portion of the biasing member 300 is attached to the pressing member 302. The pressing member 302 is attached to the first arm 288 so as to freely advance and retreat toward the one end portion of the first arm 288 along the longitudinal direction of the first arm 288 due to the biasing force of the biasing member 300.

In addition, a swing shaft 288*a* is provided at the one end portion of the first arm 288. In addition, a bearing section 276*a* for attaching the first arm 288 so as to be swingable is formed on the lower surface of the swing base 276. A bearing hole 304 with a long hole form is formed on the bearing section 276*a*. The swing shaft 288*a* is inserted into the bearing hole 304, and the first arm 288 is attached to the bearing section 276*a* so as to be swingable with respect to the bearing section 276*a*. In addition, since the bearing hole 304 is formed as a long hole, displacement of the swing shaft 288*a* is permitted with respect to the bearing section 276*a* in the swing operation in the belt transport section 242.

Here, as shown in FIG. 37, when the belt transport section 242 takes the first posture, the pressing member 302 presses the bearing section 276*a* of the swing base 276 using the biasing force of the biasing member 300. As a result, the swing base 276 is biased in an upward orientation in the apparatus height direction. Here, as shown in FIG. 36, an engaging section 276*b* is provided on the swing base 276. In addition, a belt positioning section 306 is provided in the apparatus main body 212.

In the example, when the belt transport section 242 takes the first posture, the engaging section 276*b* comes into contact with the belt positioning section 306. In the example, the biasing force of the biasing member 300 biases the swing base 276 in the upward orientation via the bearing section 276*a* and the pressing member 302. That is, since the biasing force of the biasing member 300 acts in a direction in which the engaging section 276*b* is pressed with respect to the belt positioning section 306, positioning in the apparatus height direction of the belt transport section 242 is performed by the belt positioning section 306. Thereby, the distance (gap) between the nozzle head section 246 of the line head 218 and the upper side path 274*a* of the transport belt 274 is specified.

Operation of Belt Transport Section

Again, the operation of the belt transport section 242 will be described with reference to FIG. 36, FIG. 39, and FIG. 40. FIG. 36 indicates a state in which the belt transport section 242 takes the first posture. In the example, the control section 260 drives the swing drive motor 298 so as to rotate, and the swing gear 294 is caused to swing in the clockwise direction in FIG. 36. Thereby, the swing shaft 292 rotates in the clockwise direction in FIG. 36. As a result, the second arm 290 which is attached to the swing shaft 292 swings in the clockwise direction in FIG. 36.

Here, the swing base 276 to which one end portion of the first arm 288 is attached regulates displacement upward in the apparatus height direction from a state in which the engaging section 276*b* abuts against the belt positioning section 306 due to the belt positioning section 306. Then, the one end portion of the first arm 288 swings about a support point in the counter clockwise direction in FIG. 36 accompanying the first arm 288 swinging in the clockwise direction of the second arm 290.

After this, the first arm 288 and the swing base 276 come to be in a state of being in contact (refer to FIG. 39), and furthermore when the second arm 290 continues to swing in the clockwise direction, the belt driving section 266 starts to swing in the counter clockwise direction in FIG. 39 with the drive shaft 270 as a swing support point. Here, in the example, even if the belt driving section 266 starts to swing, the transport belt 274 continues to be driven to rotate.

Furthermore, when continuing swinging of the second arm 290 in the clockwise direction in FIG. 39 by swinging the swing gear 294 in the clockwise direction, the state comes to be as shown in FIG. 40. From this state, furthermore when the second arm 290 is caused to swing in the clockwise direction in FIG. 40, the connection state of the first arm 288 and the swing base 276 is canceled (refer to FIG. 41). Then, the swing base 276 swings in the counter clockwise direction with the drive shaft 270 as a support point by pulling the one end portion of the first arm 288 accompanying swinging of the second arm 290 in the clockwise direction in FIG. 40. Then, when in the state shown in FIG. 41, the control section 260 stops the swing drive motor 298 being driven to rotate.

The posture of the belt transport section 242 which is shown in FIG. 41 is the second posture which retreats from the position which faces the nozzle head section 246. Here, in the example, the second posture of the belt transport section 242 is, for example, a posture of the belt driving section 266 along the apparatus height direction, that is, a substantially vertical direction. In addition, in the belt transport section 242 with the second posture, it is possible to swing the belt driving section 266 in the clockwise direction in FIG. 41, and switch the belt transport section 242 from the second posture to the first posture by swinging the swing gear 294 in the counter clockwise direction in FIG. 41.

Maintenance Section

Next, the maintenance section 264 will be described with reference to FIG. 42 to FIG. 49. With reference to FIG. 42 and FIG. 43, the maintenance section 264 is provided with a maintenance unit 308, a movable carriage 310, a parallel linking mechanism 312, a guide member 314, and a base member 316.

The base member 316 is attached to the apparatus main body 212. In addition, the base member 316 extends in the paper sheet width direction, guide members 314 face each other at both ends of the base member 316 in the paper sheet width direction, and are attached so as to extend upward in the apparatus height direction. In addition, the movable carriage driving motor 318 and a ball screw 320 are provided on the base member 316.

The movable carriage driving motor 318 is attached to the base member 316, and the ball screw 320 is attached to the drive shaft of the movable carriage driving motor 318. The ball screw 320 extends in the paper sheet transport direction in the base member 316. The movable carriage 310 is attached to the ball screw 320 via a nut member (not shown in the drawings) so as to be movable in the paper sheet transport direction according to the rotation direction of the ball screw 320. That is, the movable carriage 310 is able to reciprocate in the paper sheet transport direction by driving the movable carriage driving motor 318 so as to rotate with respect to the base member 316. Here, in the example, the movable carriage driving motor 318 is controlled by the control section 260.

The movable carriage 310 extends in the paper sheet width direction, and the parallel linking mechanism 312 is attached to both end portions of the movable carriage 310 in the paper sheet width direction. The parallel linking mechanism 312 is provided with a first link 322 as a link member, and a second link 324 as an auxiliary link member. In the example, the first link 322 is formed as member with a substantially triangular form.

A portion which corresponds to a first vertex of the first link 322 is configured as a linking section 326 (refer to FIG. 42) which links the movable carriage 310, and the first link 322 is able to rotate with respect to the movable carriage 310 with the linking section 326 as a rotation support point. In addition, a portion which corresponds to a second vertex is configured as a linking section 328 (refer to FIG. 42) which links the maintenance unit 308, and the first link 322 is able to rotate with respect to the maintenance unit 308 with the linking section 328 as a rotation support point. In addition, the guided section 330 is provided with a portion which corresponds to a third vertex. In the example, lines which connect each of the linking section 326, the linking section 328, and the guided section 330 in the first link 322 are configured to be formed in a substantially triangular form.

One end of the second link 324 rotatably links the movable carriage 310, and the other end rotatably links the maintenance unit 308. In addition, a reinforcing section 332 is provided in the second link 324. In the example, the reinforcing section 332 is formed in a substantially triangular form, and is provided between the one end and the other end of the second link. In addition, in the reinforcing section 332, a portion which corresponds to a vertex that protrudes from the second link 324 extends to the first link 322 side, and engages with the first link 322. Due to the reinforcing section 332 being engaged with the first link 322, when a force acts in the paper sheet width direction in the maintenance unit 308, it is possible to suppress displacement of the maintenance unit 308 in the paper sheet width direction by the first link 322 and the second link 324 supporting the maintenance unit 308 in the paper sheet width direction.

In addition, a guide groove 334 is provided in the guide member 314. The guided section 330 of the second link 324 is received in the guide groove 334, and the guide groove 334 guides the guided section 330. In addition, the guide groove 334 is provided with a first region 334*a* which extends in a straight line in the paper sheet transport direction (the Y axis direction in FIG. 42), and a second region 334*b* which is connected to the first region 334*a*, and which extends to the lower side in the apparatus height direction and to the upstream side in the paper sheet transport direction by diagonally intersecting with the first region 334*a*.

In addition, in the example, the guide member 314 is provided at a position which is away from a region that is necessary for swinging of the belt transport section 242 as shown in FIG. 44. That is, the guide member 314 is configured so as not to interfere with swinging of the belt transport section 242. Here, in the example, as shown in FIG. 32 and FIG. 33, the guide member 314 is positioned above the paper sheet accommodating cassette 216, and is disposed so as to be accommodated within a mounting region of the paper sheet P which is a region that is necessary for the apparatus configuration in the paper sheet transport direction. Here, in FIG. 44, the curved line which is drawn using a chain double-dashed line indicates a rotation locus of the belt transport section 242. Thereby, it is possible to suppress an increase of the dimension in the paper sheet transport direction of the apparatus.

The maintenance unit 308 is linked to the first link 322 and the second link 324. In addition, the maintenance unit 308 is provided with a plurality of caps 336. The number of caps 336 which are provided in the maintenance unit 308 corresponds to the number of nozzle head sections 246 which are provided in the line head 218.

In addition, the maintenance unit 308 in the maintenance section 264 is configured to be movable between a maintenance position that comes to be in a state in which the maintenance unit 308 that is illustrated in FIG. 43 is lifted up to the upper side in the apparatus height direction, that is, a state of facing the nozzle head section 246 of the line head 218, and a non-maintenance position which is a position at which the maintenance unit 308 that is illustrated in FIG. 42 retreats from a position which faces the nozzle head section 246.

Next, the operation of the maintenance section 264 will be described with reference to FIG. 35 and FIG. 44 to FIG. 49. In FIG. 35 and FIG. 44, the maintenance unit 308 in the maintenance section 264 is at the non-maintenance position. Here, a state after the belt transport section 242 is switched from the first posture to the second posture is illustrated in FIG. 35 and FIG. 44.

In this state, the control section 260 rotatably drives the ball screw 320 by rotatably driving the movable carriage driving motor 318. Thereby, the movable carriage 310 starts moving from the downstream side toward the upstream side in the paper sheet transport direction. As shown in FIG. 45, when the movable carriage 310 starts moving, the movable carriage 310 moves in a straight line from the downstream side toward the upstream side in the transport direction while the guided section 330 of the first link 322 is guided to the first region 334*a* of the guide groove 334. Thereby, the parallel linking mechanism 312 and the maintenance unit 308 which are linked to the move movable carriage 310 move to the upstream side in the transport direction.

Next, as shown in FIG. 46 and FIG. 47, when the movable carriage 310 further moves to the upstream side in the paper sheet transport direction, the guided section 330 is guided in the guide groove 334 and moves from the first region 334*a* to the second region 334*b* of the guide groove 334. Due to the guided section 330 moving from the first region 334*a* to the second region 334*b*, the first link 322 swings in the counter clockwise direction in FIG. 46 and FIG. 47 with the linking section 326 (refer to FIG. 42) of the movable carriage 310 as a support point.

As a result, the maintenance unit 308 is lifted diagonally upward in the apparatus height direction.

The second link 324 also swings in the counter clockwise direction following the operation of the first link 322 due to the operation of the maintenance unit 308. Here, in the state of FIG. 46 and FIG. 47, the position in the paper sheet transport direction of the cap 336 of the maintenance unit 308 is positioned below the nozzle head section 246 of the line head 218, and faces the nozzle head section 246.

Next, as shown in FIG. 48 and FIG. 49, when the movable carriage 310 is further moved to the upstream side in the paper sheet transport direction, and the guided section 330 is moved to the end portion at the upstream side in the paper sheet transport direction of the second region 334*b* along the guide form of the second region 334*b*. The first link 322 and the second link 324 of the parallel linking mechanism 312 continue to rotate in the counter clockwise direction in FIG. 48 and FIG. 49 accompanying the movement within the second region 334*b* of the guided section 330.

Due to the rotation of the first link 322 and the second link 324, the maintenance unit 308 is displaced from the position which is illustrated in FIG. 47 upward in a straight line in the apparatus height direction. Then, the cap 336 comes into contact with the nozzle head section 246 of the line head 218, and the nozzle surface of the nozzle head section 246 is set to the sealed state. Here, it is possible to improve adhesiveness between the cap 336 and the nozzle head section 246 by causing the cap 336 to come into contact with the nozzle head section 246 by being displaced in a straight line from the position in front of the nozzle head section 246 in a state in which the cap 336 faces the nozzle head section 246.

In this state, a flushing operation is performed which is an example of the maintenance operation by the control section 260 discharging ink from a plurality of nozzles which are provided on the nozzle surface of the nozzle head section 246 toward the cap 336. Here, the cap 336 is connected to a waste ink tank (which is not shown in the drawings) that is provided inside the apparatus main body 212 by a waste ink tube (which is not shown in the drawings), and the ink which is discharged inside the cap 336 is accommodated in the waste ink tank via the waste ink tube.

Here, in the example, in the sequence of operations of the maintenance section 264 which is illustrated in FIG. 44 to FIG. 49, since the maintenance unit 308 is attached so as to be rotatable with respect to the first link 322 and the second link 324, the maintenance unit 308, and thus the cap 336, is displaced from the non-maintenance position which is illustrated in FIG. 44 to the maintenance position which is illustrated in FIG. 49 while maintaining the horizontal posture.

Next, the flow of the maintenance operation during transport of the paper sheet P in the printer 210 will be described with reference to FIG. 50. As step S1, a paper sheet transport operation and recording operation are started in the printer 210. Here, the paper sheet transport operation is started, and the operation of the transport belt 274 of the belt transport section 242 is also started. As step S2, the control section 260 confirms whether or not a predetermined time has elapsed from the start of the paper sheet transport operation. Here, in the example, the predetermined time is set, for example, to 30 seconds. In a case where the predetermined time has not elapsed, as step S3, the paper sheet transport operation is continued.

In a case where the predetermined time has elapsed from the start of the paper sheet transport operation, as step S4, the transport operation of the paper sheet P is temporarily stopped. Then, the belt transport section 242 is switched from the first posture to the second posture. Here, in the example, even if the posture of the belt transport section 242 is switched, the control section 260 continues driving of the transport belt 274. As step S5, the control section 260 confirms whether the belt transport section 242 has switched to the second posture. Then, in a case where the belt transport section 242 is not switched to the second posture, as step S6, posture switching of the belt transport section 242 is continued.

In a case where the belt transport section 242 is switched to the second posture, as step S7, the control section 260 moves the maintenance section 264, and moves the maintenance unit 308 from the non-maintenance position (refer to FIG. 44) to the maintenance position (refer to FIG. 49). As step S8, the control section 260 confirms whether the maintenance unit 308 is moved to the maintenance position. Then, in a case where the maintenance unit 308 is not finished moving to the maintenance position, as step S9, the control section 260 continues to allow movement to the maintenance position of the maintenance unit 308.

In a case where the maintenance unit 308 finishes moving to the maintenance position, as step S10, ink is discharged from the nozzle surface of the nozzle head section 246 of the line head 218 toward the cap 336, and the flushing operation is performed. Then, when the flushing operation is complete, as step S11, the control section 260 moves the maintenance unit 308 from the maintenance position to the non-maintenance position.

Next, as step S12, the control section 260 switches the posture of the belt transport section 242 from the second posture to the first posture. Then, as step S13, the control section 260 restarts the transport operation of the paper sheet P. Here, in the example, the continuous operation of the belt transport section 242 and the maintenance section 264 from step S4 to step S13 is set so as to be completed in, for example, approximately two seconds.

Next, a state in which the maintenance unit 308 that is at a position at which maintenance is performed by abutting against a head surface 246*a* of the nozzle head section 246 (recording head) separates from the head surface 246*a* of the nozzle head section 246 and retreats will be described. FIGS. 53A to 53C and FIGS. 54A and 54B are schematic views for describing a state in which the maintenance unit 308 separates from the head surface 246*a* of the nozzle head section 246 and retreats, viewed from the apparatus width direction (the X axis direction).

A movement mechanism 265 is provided with the movable carriage 310 which moves in the transport direction (Y axis direction) of the paper sheet P at a position below the maintenance unit 308 in the apparatus height direction (Z axis direction), the guide member 314 (refer to FIG. 43) is provided with the guide groove 334 which extends in the transport direction of the paper sheet P, and the first link 322 (link member) has the guided section 330 which is guided by the guide groove 334, one side is rotatably linked to the movable carriage 310 by the linking section 326, and the other side is rotatably linked to the maintenance unit 308 by the linking section 328.

In addition, the movement mechanism 265 is provided with the second link 324 (auxiliary link member) in which one side is rotatably linked to the movable carriage 310 by the linking section 341, and the other side is rotatably linked to the maintenance unit 308 by the linking section 340.

Figure 53A:
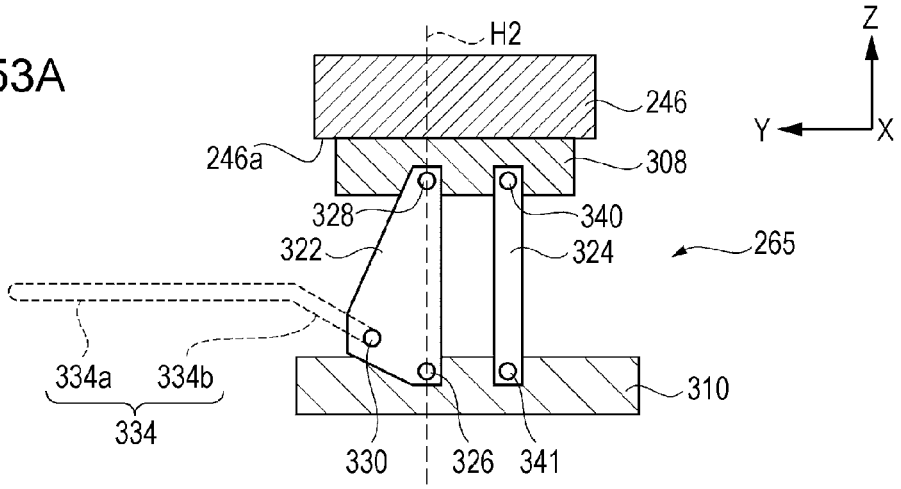
FIGS. 53A to 53C are schematic views for describing a state in which the maintenance unit separates from the recording head and retreats according to example 6.

The maintenance unit 308 in FIG. 53A is positioned facing the nozzle head section 246, and to perform maintenance by abutting against the head surface 246*a* of the nozzle head section 246. The guided section 330 is provided on the linking section 326 side of the first link 322, and the guided section 330 is provided in a state of penetrating into the guide groove 334 which is indicated by a broken line. The guided section 330 in FIG. 53A is positioned on the end portion on the right side of the drawing in the Y axis direction of the guide groove 334. At this time, the first link 322 and the second link 324 are in a state in which the longitudinal direction is a posture along the Z axis direction in the position of a broken line H2 in the Y axis direction.

Figure 53B:
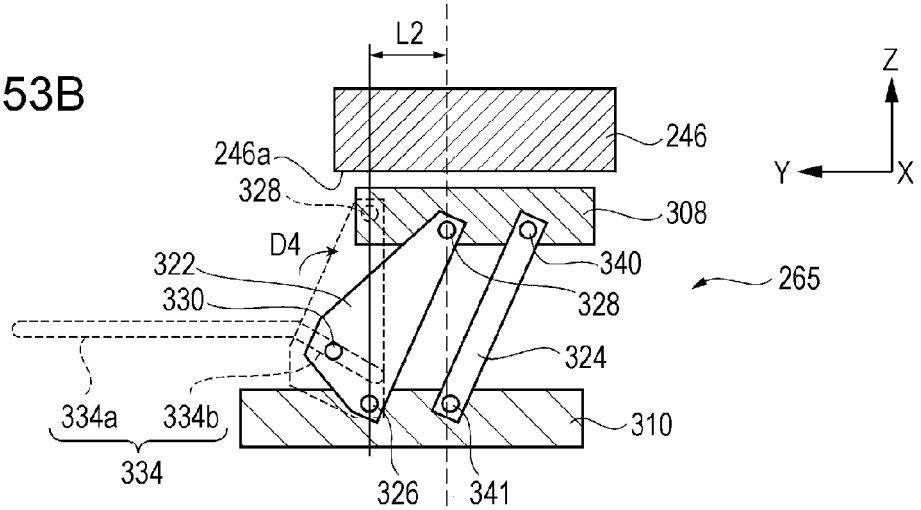

As shown in FIG. 53B, when the movable carriage 310 is moved to the left side of the drawing in the Y axis direction, the guided section 330 moves along the second region 334*b* in the guide groove 334, and the first link 322 is moved to the left side of the drawing in the Y axis direction while rotating in the direction D4 with the guided section 330 set as a support point.

Here, for description, the amount of movement in the Y axis direction of the linking section 328 will be described in each of a case where the first link 322 only performs the movement operation to the left side of the drawing, and a case where the first link 322 only performs the movement operation in the direction D4.

In the case where the first link 322 only performs the movement operation to the left side of the drawing without rotating, the first link 322 moves to the left side of the drawing in the Y axis direction while maintaining the longitudinal direction with the posture along the Z axis direction, and the amount of movement to the left side of the drawing in the Y axis direction of the linking section 328 at the position of the first link 322, which is indicated by the broken line in FIG. 53B, is a distance L2.

Meanwhile, in the case where the first link 322 performs only the rotation operation in the direction D4 without moving to the left side of the drawing in the Y axis direction, the amount of movement to the right side of the drawing in the Y axis direction of the linking section 328 is a distance L2.

Accordingly, when a movement operation to the left side of the drawing, and a movement operation in the direction D4 are simultaneously performed in the first link 322, the distance L2 as the amount of movement to the left side of the drawing is offset by the distance L2 as the amount of movement to the right side of the drawing in the Y axis direction of the linking section 328. For this reason, when the movable carriage 310 is moved to the left side of the drawing in the Y axis direction, the maintenance unit 308 moves downward (lower side in the drawing) in a direction which is orthogonal to the head surface 246*a* (Z axis direction) at the position of the broken line H2. Thereby, since the maintenance unit 308 does not slide on the head surface 246*a* of the nozzle head section 246 in the Y axis direction, wear to the head surface 246*a* due to the maintenance unit 308 is suppressed. Here, the result of a numerical value where the distance L2 as the amount of movement to the left side of the drawing is offset by the distance L2 as the amount of movement to the right side of the drawing may be a value close to 0.

Figure 53C:
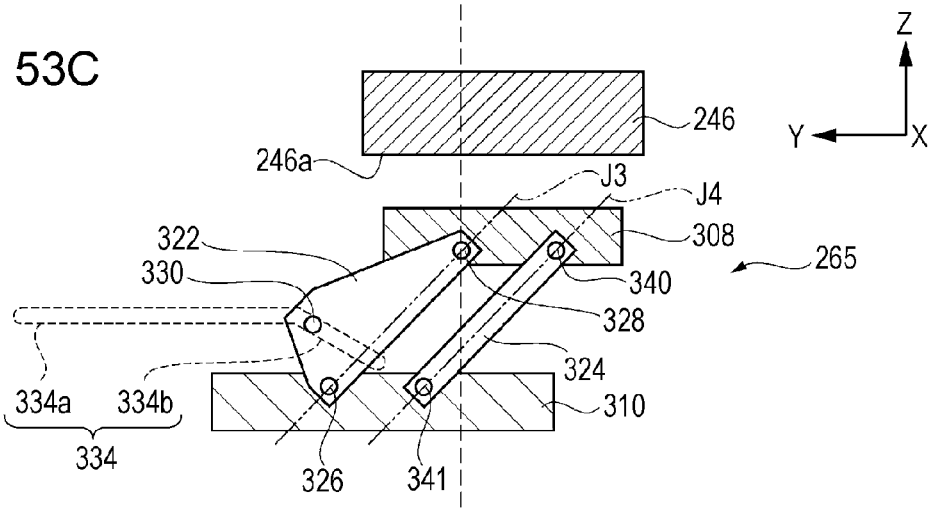

Furthermore, as shown in FIG. 53C, when the movable carriage 310 is moved to the left side of the drawing, the guided section 330 moves to the left side of the drawing and upward along the second region 334*b* in the guide groove 334, and the first link 322 is moved to the left side of the drawing in the Y axis direction while rotating in the direction D4 with the guided section 330 set as a support point.

Figure 54A:
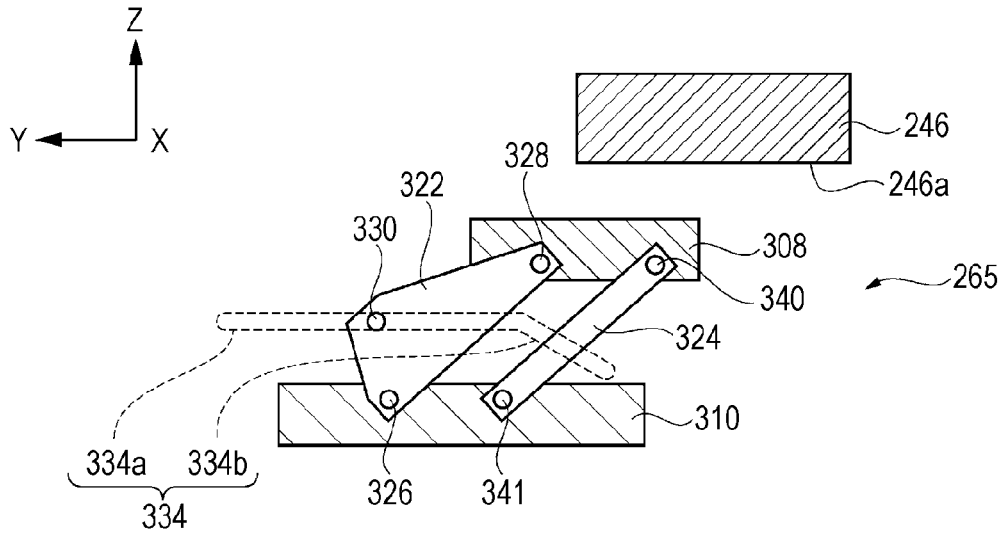
FIGS. 54A and 54B are schematic views for describing a state in which the maintenance unit separates from the recording head and retreats according to example 6.
Figure 54B:
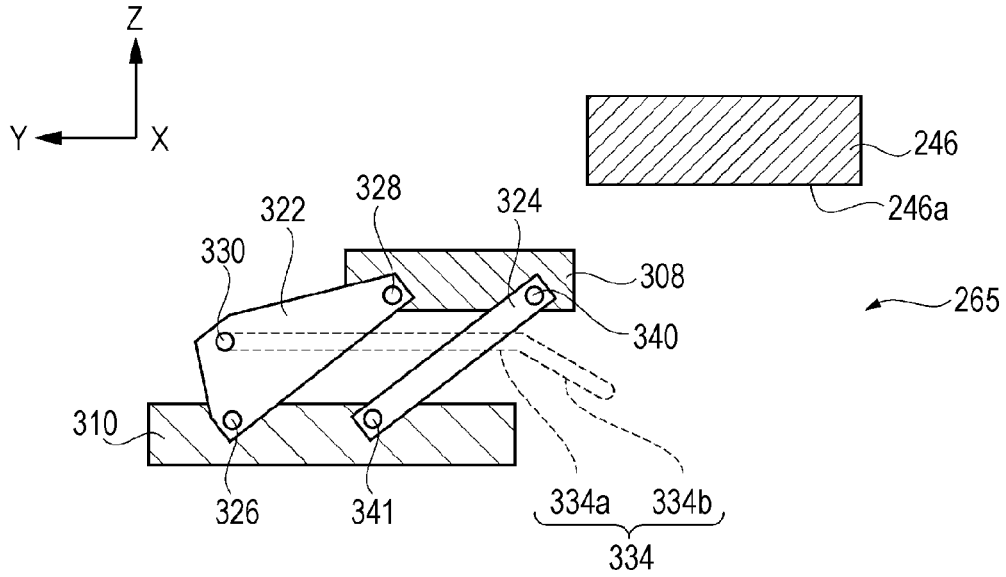

Furthermore, as shown in FIG. 54A, the guided section 330 is guided along the first region 334*a* in the guide groove 334, and the maintenance unit 308 moves to the left side of the drawing. Then, as shown in FIG. 54B, the guided section 330 is positioned in the end portion on the left side of the drawing in the guide groove 334, and the maintenance unit 308 comes to be at the retreat position.

The state in which the maintenance unit 308 is moved downward when the maintenance unit 308 is separated from the head surface 246*a* of the nozzle head section 246 is described using FIG. 53B, and in the same manner, when the maintenance unit 308 which is at the retreat position is set to come close to the head surface 246*a* of the nozzle head section 246, the maintenance unit 308 moves upward in the Z axis direction (to the upper side in the drawing). Thereby, since the maintenance unit 308 does not slide on the head surface 246*a* of the nozzle head section 246 in the Y axis direction, wear to the head surface 246*a* due to the maintenance unit 308 is suppressed.

A line J3 in FIG. 53C which connects the linking section 328 to the linking section 326 is parallel to a line J4 which connects the linking section 340 and the linking section 341. Thereby, when the first link 322 and the second link 324 move in the Y axis direction while rotating accompanying the movement of the movable carriage 310, the maintenance unit 308 is movable in a state in which the posture is held in the horizontal direction. For this reason, it is possible to suppress leaking of ink (liquid) from the maintenance unit 308.

Here, when the maintenance unit 308 is separated from the nozzle head section 246 or comes close to the nozzle head section 246, the movement direction of the maintenance unit 308 may be a diagonal direction with respect to a direction which is orthogonal to the head surface 246*a* of the nozzle head section 246.

To summarize the above description, in the printer 210 in the example, the maintenance section 264 which is used in maintenance of the line head 218 is displaced between the non-maintenance position and the maintenance position by the movement operation which includes a displacement operation along the paper sheet transport direction. Accordingly, it is not necessary to set the retreat position of the maintenance section 264 on the lower side of the line head 218, and it is possible to achieve suppression of the dimension of the printer 210 in the height direction.

In addition, in the example, it is possible to easily construct a configuration in which the maintenance unit 308 is advanced and retreated with respect to the line head 218 by the parallel linking mechanism 312.

In addition, in the example, since the maintenance unit 308 is provided with the cap 336 which seals the nozzle head section 246 of the line head 218, and is displaced between the maintenance position and the non-maintenance position while maintaining the horizontal posture of the cap 336, it is possible to suppress leaking of liquid from the cap 336.

In addition, in the example, since the maintenance unit 308 moves along a direction which is orthogonal to the head surface of the nozzle head section 246 of the line head 218 in the displacement region from in front of the maintenance position to the maintenance position, it is possible to effectively and precisely seal the head surface.

In addition, in the example, since the guide member 314 is provided outside a swinging region which is necessary for swinging of the belt transport section 242, the guide member 314 does not inhibit the swing operation of the belt transport section 242.

In addition, in the example, the drive shaft 270 is a rotating body which is driven so as to rotate using the belt driving motor 278 as a "driving source", and since the driven shaft 272 is a rotating body which is driven so as to rotated, it is possible to obtain a configuration for causing the belt transport section 242 to swing with the drive shaft 270 as the center of oscillation with a simple configuration at low cost. Additionally, it is not necessary to stop driving of the drive shaft 270 when the belt transport section is caused to swing, and it is possible to secure a control degree of freedom. Furthermore, since the drive shaft 270 continues to be driven to rotate when the belt transport section 242 is caused to swing with the drive shaft 270 as the center, it is not necessary to secure the time for stopping or starting driving of the drive shaft 270, and it is possible to shorten the time for swinging the belt transport section 242.

Modification Examples of Examples (1) The example has a configuration in which the belt transport section 242 is disposed in the paper sheet transport direction on the upstream side in the transport direction, and the maintenance section 264 is disposed on the downstream side in the transport direction, but in place of this configuration, a configuration may be set in which the belt transport section 242 is disposed on the downstream side in the transport direction, and the maintenance section 264 is disposed on the upstream side in the transport direction.

(2) The example has a configuration in which driving of the transport belt 274 continues even during the swing operation of the belt transport section 242, but in place of this configuration, a configuration may be set in which driving of the transport belt 274 is stopped when the belt transport section 242 is switched from the first posture to the second posture, and the driving of transport belt 274 is started when the belt transport section 242 is switched from the second posture to the first posture.

(3) In the example, the maintenance operation is, for example, a flushing operation, but is not limited to this configuration, and a wiping operation or a capping operation in which the remaining ink inside the nozzle is suctioned is included in the maintenance operation.

(4) The example has a configuration in which the swing operation of the belt transport section 242 and the transport operation between the maintenance position and the non-maintenance position of the maintenance section 264 are driven by separate driving members, but in place of this configuration, one driving motor may be used to drive by providing an interlocking mechanism such as a cam member.

(5) In the example, the non-maintenance position of the maintenance unit 308 is a position at which the maintenance unit 308 retreats from a region that faces the nozzle head section 246 to a region which is entirely away in the paper sheet transport direction, but a portion of the maintenance unit 308 may set a position which faces the nozzle head section 246 as the non-maintenance position.

(6) The example has a configuration in which the belt transport section 242 is provided in a region which faces the line head 218, but in place of this configuration, a configuration may be set in which a medium support member (platen) which supports a medium is disposed in the region which faces the line head 218. In this case, it is possible for the medium support member to be provided in the same manner as the belt transport section 242 so as to be swingable with the upstream side in the transport direction as a support point. Here, in a case where the non-maintenance position of the maintenance unit 308 is positioned on the upstream side in the transport direction with respect to a line head 218 which is different from the examples, the medium support member is able to be provided so as to be swingable with the downstream side in the transport direction as a support point.

To summarize the above description, the printer 210 is provided with the line head 218 which performs recording on the paper sheet P, the belt transport section 242 which supports the paper sheet P at a position that faces the line head 218, and the maintenance unit 308 which faces the line head 218 by switching the belt transport section 242, and is used in maintenance of the line head 218. The belt transport section 242 has a center of oscillation upstream or downstream in the paper sheet transport direction, and switches between the first posture which faces the line head 218 and the second posture which retreats from the position facing the line head 218 according to the swing. The maintenance unit 308 is displaced between the maintenance position which faces the line head 218 by the movement operation which includes the displacement operation along the paper sheet transport direction, and the non-maintenance position which is on the downstream side with respect to the line head 218 in a case where the center of oscillation of the belt transport section 242 is upstream in the paper sheet transport direction, or the non-maintenance which is on the upstream side with respect to the line head 218 in a case where the center of oscillation of the belt transport section 242 is downstream in the paper sheet transport direction.

The belt transport section 242 is rotatably attached to the drive shaft 270 and the driven shaft 272, has the transport belt 274 which supports the paper sheet P and which transports the paper sheet P, and the drive shaft 270 is set as the center of oscillation. The drive shaft 270 is positioned on the upstream side in the paper sheet transport direction, and the driven shaft 272 is positioned on the downstream side in the paper sheet transport direction.

The maintenance section 264 is provided with the movable carriage 310 which moves along the paper sheet transport direction and is positioned below the maintenance unit 308, the parallel linking mechanism 312 which is formed by being provided with the first link 322 and the second link 324 which link the movable carriage 310 and the maintenance unit 308, the guided section 330 which is provided at a position that is away from the line J3, (refer to FIG. 53C) which connects the linking section 328 of the first link 322 and the maintenance unit 308 and the linking section 326 of the first link 322 and the movable carriage 310 in the first link 322, to the downstream side in the paper sheet transport direction, and the guide member 314 which is provided with the guide groove 334 that guides the guided section 330, and is provided with a configuration in which the first link 322 and the second link 324 swing, and the maintenance unit 308 advances and retreats with respect to the line head 218, due to the displacement by the guided section 330 inside the guide groove 334 accompanying the movement of the movable carriage 310.

By the guided section 330 being provided at a position that is away from the line J3, which connects the linking section 328 and the linking section 326, to the downstream side in the paper sheet transport direction, it is possible to suppress an increase in the dimension in the paper sheet transport direction of the printer 210 since it is possible to dispose the swinging region which is necessary for swinging of the belt transport section 242 (the space section which is necessary for displacement of the support section) close to the maintenance unit 308 side in the paper sheet transport direction.

The guide groove 334 has the first region 334*a* which extends in a straight line along the paper sheet transport direction, and the second region 334*b* which is connected to the first region 334*a*, is provided further to the line head 218 side than the first region 334*a*, and extends in a direction going away from the line head 218 that is a direction which diagonally intersects with the first region 334*a*. Thereby, as long as the swinging region which is necessary for swinging of the belt transport section 242 is secured upward in the apparatus height direction of the second region 334*b*, it is possible to suppress an increase in the apparatus height direction.

The maintenance unit 308 is provided with the cap 336 which seals the line head 218, and is displaced between the maintenance position and the non-maintenance position while maintaining the horizontal posture of the cap 336. Furthermore, the maintenance unit 308 moves along the direction which is orthogonal to the head surface of the nozzle head section 246 of the line head 218 in the displacement region from in front of the maintenance position to the maintenance position.

In addition, the guide member 314 is provided outside the swinging region which is necessary for swinging of the belt transport section 242. The printer 210 is provided with the paper sheet accommodating cassettes 216 which accommodate the paper sheet P. The guide member 314 is disposed above the paper sheet accommodating cassette 216 inside the mounting region of the paper sheet P in the paper sheet accommodating cassette 216.

Here, in the example, since the line head 218 is provided toward the right in the apparatus left and right direction as shown in FIG. 32, it is possible to easily dispose the guide member 314 within the paper sheet mounting region above the paper sheet accommodating cassette 216.

In addition, the drive shaft 270 is a rotating body which is driven so as to rotate using the belt driving motor 278, and the driven shaft 272 is a rotating body which is driven so as to rotate.

Furthermore, the drive shaft 270 continues to be driven to rotate when the belt transport section 242 is caused to swing centered on the drive shaft 270.

Here, in the examples described above, the line head 218 as the recording head is a type which discharges liquid in a fixed state without moving, but the invention is not limited thereto, and it is possible to also apply the invention to a type which discharges liquid from a nozzle of the recording head while the recording head moves in a predetermined direction.

In addition, in the example, an ink jet printer is applied as an example of a recording apparatus with the belt transport section 242 and the maintenance section 264 according to the invention, but it is also possible to generally apply the invention to other liquid ejecting apparatuses.

Here, a liquid ejecting apparatus is not limited to a recording apparatus such as a printer, a copier, or a facsimile which uses an ink jet recording head, and performs recording on the recording medium by discharging ink from the recording head, and includes an apparatus which adheres liquid to the recording medium by ejecting the liquid which corresponds to use in place of ink on the recording medium which is equivalent to the recording medium from a liquid ejecting head which is equivalent to the ink jet recording head.

As the liquid ejecting head, in addition to the recording head, there are examples of a color material ejecting head which is used for manufacturing a color filter for a liquid crystal display or the like, an electrode material (conductive paste) ejecting head which is used for forming electrodes such as an organic EL display or a surface emission display (FED), a biological organic matter ejecting head which is used for manufacturing biochips, a sample ejecting head as a precision pipette, and the like.

Here, the invention is not limited to the examples described above, and various modifications are possible within the scope of the invention described in the claims which can be said to include the inventions included in the scope of the invention.

The entire disclosure of Japanese Patent Application No.: 2014-182424, filed Sep. 8, 2014, 2015-034991, filed Feb. 25, 2015 and 2015-13340, filed Jul. 2, 2015 are expressly incorporated by reference herein.

What is claimed is:

1. A recording apparatus comprising:

a recording head which performs recording on a recording medium;

a support section which is displaced between a support position which faces the recording head and supports the recording medium and a position which is retreated from the support position;

a maintenance unit which carries out maintenance on the recording head at a facing position which faces the recording head by switching the support section; and a movement mechanism which moves the maintenance unit between the facing position and the position which is retreated from the facing position in a transport direction of the recording medium, wherein the movement mechanism includes:

a movable carriage which moves in the transport direction at a position below the maintenance unit in the vertical direction, a guide member which is provided with a guide groove that extends in the transport direction, and a link member which has a guided section that is guided by the guide groove, of which one side is rotatably linked to the movable carriage, and of which the other side is rotatably linked to the maintenance unit, and the maintenance unit moves in the transport direction with the movement of the moveable carriage in the transport direction, accompanying movement in the transport direction of the movable carriage, when the maintenance unit comes close to the facing position, or separates from the facing position, by the link member rotating using the guided section as a support point, the amount of movement in the one direction in the transport direction of the maintenance unit is offset by the amount of movement in the other direction in the transport direction of the guided section, wherein the movement distance of the maintenance unit is shorter than the movement distance of the moveable carriage by the offset.

2. The recording apparatus according to claim 1, wherein the guide groove has a first region which extends in a straight line along the transport direction, and a second region which is connected to the first region and extends along a direction which diagonally intersects with the first region.

3. The recording apparatus according to claim 2, wherein the guided section is provided at a position on a side opposite to the support section away from a line which connects a linking section of the link member and the maintenance unit, and a linking section of the link member and the movable carriage, and the second region extends in a direction going away from the recording head in the intersecting direction.

4. The recording apparatus according to claim 1, wherein the maintenance unit is provided with a cap which seals the recording head, and the movement mechanism is moved between the facing position and the position which retreats from the facing position while maintaining the horizontal posture of the cap.

5. The recording apparatus according to claim 4, further comprising:

an auxiliary link member of which one side is rotatably linked to the movable carriage, and of which the other side is rotatably linked to the maintenance unit, wherein the line which connects the linking section of the link member and the maintenance unit, and the linking section of the link member and the movable carriage is parallel to a line which connects the linking section of the auxiliary link member and the maintenance unit, and the linking section of the auxiliary link member and the movable carriage.

6. The recording apparatus according to claim 1, wherein the support section has a support surface which supports the recording medium, and is displaced between the support position and the position which is retreated from the support position while maintaining a direction of the support surface.

7. The recording apparatus according to claim 1, wherein a center of oscillation of the support section is provided on the upstream or the downstream in the transport direction, and due to the support section swinging, the support section is displaced between the support position which faces the recording head and supports the recording medium and the position which is retreated from the support position, and the maintenance unit retreats from the recording head to the downstream side in a case where the center of oscillation is on the upstream, and retreats from the recording head to the upstream side in a case where the center of oscillation is on the downstream in the transport direction, and the guide member is provided outside a swinging region which is necessary for swinging of the support section in a width direction of the recording medium which intersects with the transport direction.

8. The recording apparatus according to claim 7, wherein the support section includes a first rotating body which is driven so as to rotate by a driving source, a second rotating body which is driven so as to be rotated, and a transport belt which is wound around the first rotating body and the second rotating body, and on which the recording medium is supported and transported, the support section is provided to be swingable with the first rotating body as the center of oscillation, and when the support section swings, the first rotating body continues to be driven to rotate.

9. The recording apparatus according to claim 1, further comprising:

a medium accommodating section which accommodates the recording medium, wherein the guide member is disposed inside a mounting region of the recording medium in the medium accommodating section in the transport direction.

* * * * *